US010703617B2

(12) United States Patent
Melrose

(10) Patent No.: US 10,703,617 B2
(45) Date of Patent: Jul. 7, 2020

(54) METHOD FOR CONTROLLED CONTAINER HEADSPACE ADJUSTMENT

(71) Applicant: David Murray Melrose, Mt. Eden (NZ)

(72) Inventor: David Murray Melrose, Mt. Eden (NZ)

( * ) Notice: Subject to any disclaimer, the term of this patent is extended or adjusted under 35 U.S.C. 154(b) by 407 days.

(21) Appl. No.: 15/275,450

(22) Filed: Sep. 25, 2016

(65) Prior Publication Data

US 2017/0008745 A1 Jan. 12, 2017

Related U.S. Application Data

(63) Continuation-in-part of application No. 13/884,954, filed as application No. PCT/NZ2011/000243 on (Continued)

(30) Foreign Application Priority Data

| | | |
|---|---|---|
| May 19, 2008 | (NZ) | 568439 |
| Dec. 19, 2008 | (NZ) | 573865 |
| Nov. 19, 2010 | (NZ) | 589386 |
| Mar. 4, 2011 | (NZ) | 591553 |

(51) Int. Cl.
*B67C 3/22* (2006.01)
*B67C 7/00* (2006.01)
(Continued)

(52) U.S. Cl.
CPC ..... *B67C 3/222* (2013.01); *B65B 31/006* (2013.01); *B67B 3/2066* (2013.01); *B67C 3/14* (2013.01);
(Continued)

(58) Field of Classification Search
CPC . B67B 3/2013; B67B 3/2033; B67B 2201/08; B67B 3/2066; B67C 7/004; B67C 2003/2697; B67C 2003/2694; B67C 2003/2688; B67C 2003/228; B67C 2003/226; B67C 3/222; B67C 3/14; B67C 3/045; B65B 31/006; B65D 79/005
(Continued)

(56) References Cited

U.S. PATENT DOCUMENTS 4,450,878 A * 5/1984 Takada et al. ..... B65B 63/08 141/48
4,602,473 A * 7/1986 Hayashi et al. ..... B67C 3/222 53/432
(Continued)

FOREIGN PATENT DOCUMENTS

DE 1119700 B * 12/1961 ..... B67C 3/222
DE 1158398 B * 11/1963 ..... B67C 3/14
(Continued)

*Primary Examiner* — Stephen F. Gerrity
(74) *Attorney, Agent, or Firm* — Rothwell, Figg, Ernst & Manbeck, P.C.

(57) ABSTRACT

A sealing and pressure dosing apparatus, and container filling method, including a capping machine (102) which receives containers (1). Closures (80) are applied to the containers (1) immediately following the raising of pressure within the containers (1) by a pressure dosing system in a pressure sealing chamber (84). Preferably a cooling system is integrated with the capping machine.

16 Claims, 40 Drawing Sheets

Related U.S. Application Data

Nov. 18, 2011, now abandoned, said application No. 15/275,450 is a continuation-in-part of application No. 12/993,253, filed as application No. PCT/NZ2009/000079 on May 18, 2009, now abandoned.

(51) Int. Cl.

| | |
|---|---|
| ***B67C 3/14*** | (2006.01) |
| ***B67B 3/20*** | (2006.01) |
| ***B65B 31/00*** | (2006.01) |
| ***B67C 3/04*** | (2006.01) |

(52) U.S. Cl.
CPC ..... *B67C 7/00* (2013.01); *B67C 3/045* (2013.01); *B67C 2003/226* (2013.01)

(58) Field of Classification Search
USPC ..... 53/88, 127, 282, 281, 471, 440
See application file for complete search history.

(56) References Cited

U.S. PATENT DOCUMENTS

| | | | | |
|---|---|---|---|---|
| 7,219,480 | B2 * | 5/2007 | Winters et al. | B65B 31/006 141/64 |
| 2005/0011580 | A1 * | 1/2005 | Ziegler | B65B 31/006 141/2 |
| 2007/0125742 | A1 * | 6/2007 | Simpson, Jr. et al. | B67C 3/045 215/376 |
| 2007/0184157 | A1 * | 8/2007 | Stegmaier | A23L 2/02 426/399 |
| 2010/0119743 | A1 * | 5/2010 | Thomasset | B65B 3/04 428/35.1 |
| 2010/0212260 | A1 * | 8/2010 | Clusserath | B67B 3/00 53/403 |
| 2014/0090744 | A1 * | 4/2014 | Chiang et al. | B65B 31/006 141/4 |
| 2018/0127126 | A1 * | 5/2018 | Delage | B65B 31/006 |

FOREIGN PATENT DOCUMENTS

| | | | | | |
|---|---|---|---|---|---|
| DE | 3611391 | A1 * | 10/1987 | | B67B 1/04 |
| DE | 29719203 | U1 * | 11/1988 | | B65D 1/0223 |
| DE | 3927491 | A1 * | 2/1991 | | B67B 3/2033 |
| DE | 102008033818 | A1 * | 1/2010 | | B65B 31/046 |
| GB | 1561143 | A * | 2/1980 | | B65B 31/08 |
| GB | 2050319 | A * | 1/1981 | | B65B 61/00 |
| JP | 56113515 | A * | 9/1981 | | B65B 31/00 |
| WO | WO-9425347 | A1 * | 11/1994 | | B65B 31/025 |
| WO | WO-0218213 | A1 * | 3/2002 | | B65D 1/0223 |
| WO | WO-2004028910 | A1 * | 4/2004 | | B65D 1/0276 |
| WO | WO-2005070814 | A1 * | 8/2005 | | B67C 3/007 |
| WO | WO-2005070815 | A1 * | 8/2005 | | B67C 3/007 |
| WO | WO-2005085082 | A1 * | 9/2005 | | B65B 31/00 |
| WO | WO-2005115908 | A1 * | 12/2005 | | B67C 3/045 |
| WO | WO-2009142510 | A1 * | 11/2009 | | B65B 31/006 |
| WO | WO-2011062512 | A1 * | 5/2011 | | B65B 1/006 |

* cited by examiner

STEP ONE

Bottle Capped

STEP TWO

Bottle Pressurized

STEP THREE

Cap sealed/Ball closed to maintain pressure

STEP ONE

Bottle Capped

STEP TWO

Bottle Pressurized

STEP THREE

Cap sealed/Push closed to maintain pressure

METHOD FOR CONTROLLED CONTAINER HEADSPACE ADJUSTMENT

CROSS REFERENCE TO RELATED APPLICATIONS

This application is a continuation-in-part of U.S. Ser. No. 13/884,954 filed May 11, 2013, published as US2013/0239522, which is a National Stage of international Application No. PCT/NZ2011/000243, filed Nov. 18, 2011, published as WO2012/067524, claiming priority to NZ589386 filed Nov. 19, 2010, and NZ591553 filed Mar. 4, 2011. This application is also a continuation-in-part of U.S. Ser. No. 12/993,253 filed Nov. 17, 2010, which is a National Stage of International Application No. PCT/NZ2009/000079, published as WO09142510, claiming priority to NZ568439 filed May 19, 2008, and NZ573865 filed Dec. 19, 2008. All of the foregoing applications and publications, and PCT/NZ2010/000231 filed Nov. 17, 2010 and published as WO2011/062512, claiming priority to NZ581313 filed Nov. 18, 2009, U.S. Ser. No. 13/510,881 filed Nov. 17, 2010, and published as US2012/0311966, and U.S. Ser. No. 14/722,086 filed May 26, 2015, are incorporated herein by reference.

TECHNICAL FIELD OF THE INVENTION

The present invention relates generally to a sealing and pressure dosing apparatus and more particularly to a capping and/or sealing apparatus for applying closures to containers at high speed, and even more particularly to a capping apparatus including a pressure dosing system for providing a pressure medium into a head space of each of the containers prior to closure application by the apparatus. The pressure sealing may be undertaken either during the initial sealing of the container, or as a secondary operation after the initial sealing of the container. The headspace pressurization increases the internal pressure within the container, providing for increased top-load capability of the container. This invention may further relate to hot-filled and pasteurized products packaged in heat-set polyester containers and for controlling the cooling of any containers filled with a heated liquid.

BACKGROUND

It is known in the art to provide a method of displacing some of the headspace gases in a filled beverage container with gaseous nitrogen. Headspace gas typically contains air, being approximately 78% Nitrogen and 21% Oxygen. The common method of 'inerting' a headspace is desirable to provide a reduction in oxygen within a headspace in order to prevent oxidation of sensitive beverages. The displacement of Oxygen by an inert Nitrogen or Carbon Dioxide environment reduces the oxidation of the product that would rapidly occur after sealing therefore, from contact between the headspace O2 and the liquid product.

The methods of displacing headspace gas with gaseous introduction of Nitrogen do not cause a rise in pressure in the headspace, however, as the container is not sealed and the incoming gas simply replaces the existing headspace gas—with the existing gas being ejected or displaced from the container with a resulting maintenance of ambient pressure values.

Once a liquid has been filled into a beverage to a fill-point, the headspace gas above the liquid will have a first pressure prior to sealing with a cap—ambient fill pressure.

It is impossible to introduce a gas (in its natural 'gaseous' form) into an unsealed headspace and cause an appreciable rise in pressure that can then be sealed within the container unless the gas is first introduced in a liquefied form and allowed to subsequently transform to its gaseous form.

For this reason, the only known method for causing a rise in headspace pressure through introduction of a gas has been through the introduction of liquid Nitrogen—whereby the liquid Nitrogen is still rapidly expanding as the cap is placed on the container. Soon after the cap is applied there is a build-up of pressure as the boiling Nitrogen expands but is unable to escape the sealed container. See Zenger U.S. Pat. Nos. 5,033,254 and 5,251,424 both of which are incorporated by reference in their entirety.

Most production facilities are searching for ways to reduce costs as a small savings on the cost of each single container, for a food or beverage packer, this quickly adds up to tremendous savings, based on the large number of containers processed. Utilizing lighter weight containers or reducing utility costs are good savings methods.

However, lighter weight containers for noncarbonated products can collapse when stacked unless special handling requirements are satisfied.

For this reason one typical method used to increase stacked weight capability, or top-load strength, in cold fill containers is to dose the container with liquid nitrogen prior to capping. When dosed into a container, liquid nitrogen will provide some internal pressure, which allows the containers to be stacked several pallets high.

As the nitrogen disperses immediately upon injection, however, the process for controlling accurate dosing is limited. Some of the nitrogen will escape prior to capping, thus rendering the process inexact in terms of pressure control. Additionally, handling nitrogen systems can be costly and dangerous.

Following capping there is a subsequent rise in internal pressure as the nitrogen continues to expand but cannot escape the sealed container. However, as the nitrogen is dosed prior to sealing there is loss of some of the nitrogen dose prior to sealing. This varies according to many factors, including variations in product temperature, small variations in actual bottle size resulting in larger or smaller headspace volumes, and fill point variations in the container further affecting the size of headspace volumes between containers This leaves the process inexact in terms of identifying the dose actually in the container after sealing, as the 'shot' of liquid Nitrogen is held at a constant volume whereas the shot required is varying. It is accepted that this will always be a value less than the dose introduced to the open container prior to sealing.

The use of nitrogen, however, does provide for a build-up of internal pressure within a container following capping. This is more practical in the case of beverages filled into the container cold, than when used in conjunction with hot fill beverages. In both cases it is possible that all dosed nitrogen disperses prior to sealing the container, for example if there is a stoppage on the line post dosing and prior to capping. However, in a cold filled application the result would be a container that at least is capped at ambient pressure and will remain at ambient pressure. While the benefit of increased top load and sidewall strength would be lost, the result is not particularly damaging as the container would still look attractive to the consumer when purchased.

Plastic bottles need to be pressurized at all line speeds, and if control over the exact pressure achieved inside a container is compromised then the speed of the system will also be compromised in order to correctly pressurize each container.

In the case of a hot filled beverage, an insufficient dose results in the container being sealed at ambient pressure and possessing little ability to pressurize the container following sealing. As the liquid contents of the container subsequently cool, and contract, a vacuum will build and the container will distort as a result. This is not attractive for the consumer.

Additionally, the dosing process becomes even more difficult to control in the hot fill environment, particularly at fast line speeds. When liquid nitrogen is introduced into a container under ambient pressure conditions and on top of a heated liquid, the nitrogen will be much more volatile than if the liquid was cold. It will disperse much more quickly prior to capping or sealing leaving the consistency of dose even more uncertain. A stoppage in the line is therefore more damaging to consistency of dose. For this reason, containers are often overdosed as a precautionary measure, and this is still not ideal.

A typical 18 fl oz (600 ml) polyethylene terephthalate (PET) bottle with a 1 fl oz (30 ml) headspace and pressure specification of 17 psig will need approximately 0.001411 oz (0.04 g) of liquid nitrogen. The dose of liquid nitrogen will boil away and expand to 1.163 fl oz (34.4 ml) of room temperature nitrogen gas after the container is sealed. Add 1.163 fl oz of gas to a sealed volume of 1 fl oz, and you end up with 17 psig.

The challenge for the liquid nitrogen dosing equipment manufacturer is to control the boiling liquid and deliver the 0.001411 oz consistently at speeds from 40 bottles/min to more than 1,000 bottles/min. The dosing equipment can control the liquid nitrogen up to the dosing point, but as already now disclosed it cannot control the liquid nitrogen's behavior once it has been dosed into the container. The liquid nitrogen will boil away rapidly as the container travels to the capper or seamer. An attempt to minimize this problem by placing the <loser as close as possible to the capper prior to sealing is disclosed in U.S. Pat. No. 7,219,480 to Winters et al, which is also incorporated herein by reference in its entirety Another aspect to consider is consistent container fill levels. Conventionally, the dosage of liquified gas dispensed into a container is based on an average expected fill level of the containers in a continuous fill operation. Using this method, any variation in head-space volume due to variations in fill level would cause under and over pressurized containers. For example, suppose the bottle previously mentioned had an 18 fl oz fill with a 1 fl oz headspace, and the next bottle on the production line had a fill of 18.3 fl oz (610 ml) with a 0.6 fl oz (20 ml) headspace. Both bottles receive a 0.001411 oz charge of liquid nitrogen. The liquid nitrogen dosing is consistent; however, in accordance with basic gas laws, the final bottle pressure on the 18 fl oz fill is 17 psig and the bottle with a 18.3 fl oz fill has 25.5 psig final pressure.

Problems of uniform pressurization remain as a major problem with liquid nitrogen dosing, especially when used with hot-fill beverages.

So called 'hot fill' containers are well known in prior art, whereby manufacturers supply PET containers for various liquids which are filled into the containers and the liquid product is at an elevated temperature, typically at or around 85 degrees C. (185 degrees F.).

The container is manufactured to withstand the thermal shock of holding a heated liquid, resulting in a 'heat-set plastic container. This thermal shock is a result of either introducing the liquid hot at filling, or heating the liquid after it is introduced into the container. In typical prior art filling situations, containers are filled with a heated liquid above 70 degrees C., and more often subjected to filling temperatures of between 70 degrees C. and 95 degrees C. Once capped, or in other words sealed, the product must be maintained at a certain high temperature for a certain critical time in order to complete the process of pasteurization within the container. Even further, the container must also be inverted or at least tipped sideways for a certain time in order to sterilize the underneath of the seal or cap.

It is preferable for example to maintain a temperature of above 80 degrees C. for a 2 minute period after sealing for many beverages prior to starting the cooling process. Therefore the typical cooling of containers to bring them down to around 30 degrees C. does not start until at least some time after the inversion of the container so that the core temperature of the liquid within the container is maintained high enough to sterilize the underneath of the cap and complete sterilization of the internal container contents.

Once the cooling process is finally allowed to be deployed on the container it is usually cooled rapidly in a heat exchanger or cooler in order to provide a container that may be subsequently labelled and packed into boxes or the like for transportation away from the filling line.

Therefore, in prior art it is not considered feasible to provide cooling simultaneously with the capping of filled containers, or the temperature of the contents is compromised before it may be utilized for internal sterilization purposes. Not only would there be substantial risk in introducing foreign matter into the container prior to sealing, but the temperature of the product would be compromised and the efficacy of the pasteurization model would be corrupted.

Once the liquid cools down in a capped container, however, the volume of the liquid in the container reduces, creating a vacuum within the container. This liquid shrinkage results in vacuum pressures that pull inwardly on the side and end walls of the container. This in turn leads to deformation in the walls of plastic bottles if they are not constructed rigidly enough to resist such force.

Typically, vacuum pressures have been accommodated by the use of vacuum panels, which distort inwardly under vacuum pressure. Prior art reveals many vertically oriented vacuum panels that allow containers to withstand the rigors of a hot fill procedure. Such vertically oriented vacuum panels generally lie parallel to the longitudinal axis of a container and flex inwardly under vacuum pressure toward this longitudinal axis.

In addition to the vertically oriented vacuum panels, many prior art containers also have flexible base regions to provide additional vacuum compensation. Many prior art containers designed for hot-filling have various modifications to their end-walls, or base regions to allow for as much inward flexure as possible to accommodate at least some of the vacuum pressure generated within the container.

Even with such substantial displacement of vacuum panels, however, the container requires further strengthening to prevent distortion under the vacuum force.

The liquid shrinkage derived from liquid cooling, causes a build-up of vacuum pressure. Vacuum panels deflect toward this negative pressure, to a degree lessening the vacuum force, by effectively creating a smaller container to better accommodate the smaller volume of contents. However, this smaller shape is held in place by the generating vacuum force. The more difficult the structure is to deflect inwardly, the more vacuum force will be generated. In prior art proposals, a substantial amount of vacuum may still be present in the container and this tends to distort the overall shape unless a large, annular strengthening ring is provided in horizontal, or transverse, orientation typically at least a ⅓ of the distance from an end to the container.

The present invention relates to both cold and hot-fill containers and may be used by way of example in conjunction with the hot fill containers described in international applications published under numbers WO 02/18213 and WO 2004/028910 (PCT specifications) which specifications are also incorporated herein in their entirety where appropriate.

The PCT specifications background the design of hot-fill containers and the problems with such designs that were to be overcome or at least ameliorated and in particular the use of pressure compensation elements.

A problem exists when locating such transversely oriented panels in the container side-wall, or end-wall or base region, even after vacuum is removed completely from the container when the liquid cools down and the panel is inverted. The container exits the filling line just above a typical ambient temperature, and the panel is inverted to achieve an ambient pressure within the container, as opposed to negative pressure as found in prior art. The container is labelled and often refrigerated at point of sale.

This refrigeration provides further product contraction and in containers with very little sidewall structure, so-called 'glass look-a-like' bottles, there may therefore be some paneling that occurs on the containers that is unsightly. To overcome this, an attempt is made to provide the base transverse panel with more extraction potential than is required, so that it may be forced into inversion against the force of the small headspace present during filling.

This creates a small positive pressure at fill time, and this positive pressure provides some relief to the situation. As further cool down occurs, for example during refrigeration, the positive pressure may drop and may provide for an ambient pressure at refrigerated temperatures, and so avoid paneling in the container.

This situation is very hard to engineer successfully, however, as it depends on utilising a larger headspace in order to compress at base inversion time, and it is less desirable to introduce a larger headspace to the container than is necessary in order to retain product quality.

While it is desirable to have the liquid level in the container drop, to avoid spill when opened by the consumer, it has been found that providing too much positive pressure potential within the base may cause some product spill when the container is opened, particularly if at ambient temperatures.

In most filling operations, containers are generally filled to a level just below the containers highest level, at the top of the neck finish.

Maintaining as small a container headspace as possible is desirable in order to provide a tolerance for subtle differences in product density or container capacity, to minimize waste from spillage and overflow of liquids on a high-speed package filling line, and to reduce container contraction from cooling contents after hot fill.

Headspace contains gases that in time can damage some products or place extra demands on container structural integrity. Examples include products sensitive to oxygen and products filled and sealed at elevated temperatures. A problem in prior art is the amount of Oxygen present in the headspace gas, typically as a 21% percentage of air.

Filling and sealing a rigid container at elevated temperatures can create significant vacuum forces when excessive headspace gas is also present.

Accordingly, less headspace gas is desirable with containers filled at elevated temperatures, to reduce vacuum forces acting on the container that could compromise structural integrity, induce container stresses, or significantly distort container shape. This is also true during pasteurization and retort processes, which involve filling the container first, sealing, and then subjecting the package to elevated temperatures for a sustained period.

Those skilled in the art are aware of several container manufacturing heat-set processes for improving package heat-resistant performance. In the case of the polyester, polyethylene terephthalate, for example, the heat-setting process generally involves relieving stresses created in the container during its manufacture and to improve crystalline structure.

In hot filling of beverages in PET containers, the thermal stability of the material of the container also constitutes a challenge. PET has a low glass transition point of approximately 75 degrees C. When the headspace of a container is pressurized while the liquid contents are above about 70 degrees C., the container walls are subjected to particularly damaging forces. This occurs following the capping of a lightweight container filled with a heated liquid, even when additional pressure is not applied to the container. The build-up of pressure comes from the headspace increasing in temperature immediately following capping and exerting expansion forces against the lightweight surfaces of the container.

In the current art for both cold and hot filled beverage applications, the containers may be conveyed through a nitrogen-dosing unit where nitrogen may be dripped into the unsealed bottles and shortly afterwards the bottles are sealed. This method is also referred to as the nitro-dose process. Liquefied gas may be injected by an apparatus such as that disclosed in US Patent Application No. 2005/011580 A1 to Siegler et al., which is incorporated herein by reference in its entirety.

Typically, a polyethylene terephthalate container intended for a cold-fill carbonated beverage has higher internal stresses and less crystalline molecular structure than a container intended for a hot-fill, pasteurized, or retort product application. However, even with containers such as described in the abovementioned PCT specifications where there is little residual vacuum pressure, the neck finish of the container is still required to be very thick in order to withstand the temperature of fill.

In nitro-dose applications there is significant container distortion when the PET material is above about 70 degrees C. to 75 degrees C. due to the high level of nitrogen pressure within the container. Such distortion is non-recoverable. The container effectively grows in volume and the base is disfigured and unstable.

Also for example, structures in the sidewall, such as ribbing, may be similarly affected causing uncontrolled container growth and distortion. This distortion causes a weakness in any strengthening structures and is very undesirable.

Typically, at present, hot closed bottles will be transported to the bottle cooler preferably by means of at least one conveyor belt. In the cooling device or heat exchanger, the hot bottle is cooled down close to room temperature or to around 30 degrees C. to 35 degrees C.

Typical hot fill operations utilize ambient water to slowly cool hot filled packages after they are sealed, until they return to ambient temperature. This usually occurs several minutes after the product has been filled into the container, whereby the container walls are subjected to temperatures above the glass transition point of PET.

The temperature of the filled contents take a period of time to cool from a typical 85-95 degrees C. of fill temperature to below approximately 60 degrees C. At 60 degrees C. and below the PET does not distort under stress of internal pressure in the way it does above its glass transition point.

My PCT patent specification WO 2005/085082 describes a previous proposal for a headspace displacement method which is incorporated herein in its entirety where appropriate by way of reference.

Where reference in this specification is made to any prior art, this is not an acknowledgment that it forms part of the common general knowledge in any country or region.

SUMMARY OF THE INVENTION

According to one aspect of the present invention, there is a method and system provided for pressure dosing and sealing a filled container containing either a cold or hot liquid. The container is filled and presented to the pressure dosing apparatus with a first air pressure in the headspace above the liquid. The pressure dosing apparatus includes a sealing chamber that seals the first headspace pressure inside the open container. The pressure dosing apparatus increases the first headspace pressure to a second, substantially higher second pressure. The container is then sealed with the second higher headspace pressure captured within prior to, and during, sealing.

According to a further embodiment of the present invention, the temperature of the container sidewall (including the base) is modified, conditioned or cooled within the first 2 minutes of filling with a heated liquid in order to prevent the heated sidewall from increased stress while under pressurized conditions and during initial pasteurization processing.

According to a further embodiment of the present invention, the container is filled and at least partially sealed and allowed to continue full pasteurization for approximately up to 2 minutes prior to entering the pressure dosing apparatus in order to reduce container sidewall stress even further and to even further increase pasteurization control. Additionally, the sidewall (including the base) of the container may be further temperature controlled prior to entry to the cooling tunnel of the processing line.

According to a further embodiment of the present invention, the container is filled and sealed, fully pasteurized and cooled prior to entering the pressure dosing apparatus. The vacuum created within the pasteurized container is removed by the pressure dosing apparatus by opening the sealed container, and increasing the headspace pressure then resealing the container.

Preferably, a sealing and pressure dosing apparatus is provided, including a sealing machine having a linear driven arrangement or rotary driven turret for serially receiving a plurality of containers, at least one sealing head for applying seals or caps to the containers as they are moved about in a path by the turret, a pressure sealing chamber for isolating a neck finish end of the containers and accessing the headspace of the containers, the pressure sealing chamber having an integrated pressure dosing system for raising the pressure within the sealed containers received by the sealing machine prior to sealing.

Preferably, a capping and pressure dosing apparatus embodying the principles of the present invention includes a rotary capping machine including a rotatable driven turret for serially receiving a plurality of containers, typically bottles. The apparatus of the present invention includes a pressure dosing system including a sealing chamber which is positioned to isolate and seal the upper neck finish of the containers and the mouth of each container as the container moves through the capping machine. By this arrangement, pressure control is highly optimized, enhancing operating efficiency. In the preferred form, operation of the pressure sealing system is electronically coordinated with operation of the capping machine to facilitate consistent operation, permitting the pressure system to be operated either continually, or intermittently, as desired.

Preferably, the rotary capping machine of the apparatus includes a plurality of capping heads for applying closures to respective containers as the containers are moved about a generally circular path by the rotary turret of the capping machine. The capping machine may be of a generally conventional configuration, with associated rotary conveyors, or starwheels, operating to receive filled, but unsealed containers and supplying filled and sealed containers, or operatively associated with a first conventional capping machine for receiving filled and sealed containers and supplying filled, and sealed, containers having an increased pressure within the headspace.

OBJECT OF THE INVENTION

It is thus an object of the present invention in its various embodiments to overcome or at least alleviate problems in prior art proposals to the present time.

A further and alternative object of the present invention is to at least provide the public with a useful choice.

The pressure dosing system of the present apparatus preferably includes a pressure sealing chamber connected to the capping head within the circular path about which the containers are moved by the capping machine, at a position over each container and the respective one of the closures held by one of the capping heads. The pressure dosing system includes a control valve to selectively permit intermittent or continuous dispensing of pressure medium, for example nitrogen or highly filtered air or steam, with a control system provided for coordinating operation of the pressure dosing system with operation of the capping machine.

The pressure sealing chamber preferably defines a downwardly connecting sealing surface for engagement with either the upper part of each container or the cap of each container. By this configuration of the sealing chamber, pressure medium is directed downwardly through the open mouth of each container as it is being moved by the capping machine, with closure application initiated simultaneously after each container is moved passed the capping head.

Turning then to the situation whereby nitrogen liquid is dropped into a hot-filled bottle, it will be appreciated that following capping an immediate and severe increase in both temperature and pressure is experienced against the sidewalls. With the container walls experiencing temperatures of between 85 degrees C. and 95 degrees C. in most situations, and a need to maintain this temperature above 80 degrees C. for up to 2 minutes to complete pasteurization after capping, it will be appreciated that the walls of the container will be severely stressed while above 70 degrees C. in the case of PET as this is the glass transition temperature.

The present invention may therefore provide for immediate cooling or conditioning of the walls of the container, even prior to the rise in internal pressure within the container, and does so in a manner allowing the internal product temperature to be maintained above approximately 80 degrees C. for up to approximately a 2 to 3 minute period.

In other words, the present invention in another aspect provides a method of pressurizing a container filled with a heated liquid and controlling a differential temperature between the sidewalls of the container and the internal contents of the container.

In this way, the sidewalls may be kept at a temperature below approximately 70 degrees C. in the case of PET, while maintaining a higher internal temperature of between 80 degrees C. and 95 degrees C.

Therefore one aspect of the present invention is to provide method of filling a container with a fluid including introducing the fluid through an open end of the container so that it, at least substantially, fills the container, heating the fluid before or after its introduction into the container, providing a seal or cap, providing an opening or aperture between said seal or cap and said container, providing at least one fluid through the opening or aperture, sealing the opening or aperture under increased pressure conditions, so as to compensate for subsequent pressure reduction in a headspace of the container under the seal or cap following the cooling of the heated contents, and cooling at least a part of outside walls of the containers substantially immediately after sealing or capping said containers.

According to a still further aspect of the present invention there is provided a method of filling a container with a fluid including introducing the fluid through an open end of the container so that it, at least substantially, fills the container, heating the fluid before or after its introduction into the container, applying a seal or cap to said container, providing an opening or aperture in said seal or cap, providing at least one fluid or gas through the opening or aperture, sealing the opening or aperture, so as to compensate for pressure reduction in a headspace of the container under the seal or cap following the cooling of the heated contents.

The present invention may also provide a low pressure environment within the container immediately after sealing. Typically in a nitrogen dose method, the container will experience pressures of between 15 psi and 30 psi during the first 2 minutes after sealing. In the present invention, the pressure may be modified downwardly to between 1 psi and approximately 8 psi. This significantly reduces internal stresses on the container while the product must be maintained at high temperature to complete pasteurization after sealing.

To summarise, in prior art situations, once a heated liquid is filled into the container the material of the container walls, for example Polyethylene Terephthalate (PET), will experience a rapid rise in temperature. Once the material temperature rises above the glass transition value, for example above 70 degrees C. in the case of PET, the sidewalls are subject to severe distortion. This distortion force will be present until the container is able to be cooled to bring the core temperature of the product down to below approximately 70 degrees C. and more typically to approximately 30 degrees C. following a period of time in a cooling heat exchanger.

In the current art of filling hot or heated beverages, the bottom and sides of the bottles may be rapidly cooled anywhere in the filling line from the blow moulding machine through to the filling machine and through to the labelling process by means of air or water jets. This process is designed to lower the internal temperature of the container contents.

US Patent Application No. 2007/0125742 to Simpson et al., which is incorporated herein by reference in its entirety, describes the step of placing the container in a cooling apparatus after capping.

US Patent Application No. 2007/0184157 A1 to Stegmaier, which is incorporated herein by reference in its entirety, describes a process for hot filling and quick chilling a container after capping, in particular to retain maximum flavour profiles following acceptable sterilization procedure after capping containers.

Also well known in the current art is the method of blowing or forcing air onto containers after filling and capping, and often to either cool bottles or dry them. In the case of pressurized containers it is well known that removal of liquid droplets from the surface of the container as quickly as possible removes stress concentration points on the surface of the container.

The present invention provides for not only a lowering of internal pressure to below approximately 10 psi, and more preferably to between 5 psi and 10 psi, and even more preferably to between 1 psi and 5 psi, but the present invention may also provide for a method of differentially cooling the outside walls of a container immediately prior to capping or during capping and for a controlled period afterwards to ensure correct product pasteurization and for the sidewalls to be simultaneously protected from excessive force.

In the present invention, the pressure is raised within the container to minimal levels, and the cooling process of the container may be started earlier than in prior art. In the present invention the cooling process may be undertaken within the capping or sealing device itself, which has not been described, developed or achieved before in the art.

More particularly, in the present invention, the outside shell of the filled container may be temperature controlled to ensure a maximum internal temperature is retained for any given time period, while maintaining a differential temperature on the outside surface or shell. The application of such control allows for some products to be cooled in a minimum time to retain maximum flavour profiles, or to be cooled in maximum time for maximum pasteurisation while maintaining thermal control over the PET container itself In view of the above, it is an object of one possible embodiment of the present invention to provide a pressure sealing method and headspace modification method that can provide for increased pressure within the sealed container such that there is increased top load capability.

It is a further object of one possible embodiment of the present invention to provide a pressure sealing method and headspace modification method that can provide for increased pressure within the sealed container such that there is increased top load capability, utilising a gas other than nitrogen such as simple clean or filtered air.

It is a further object of one possible embodiment of the present invention to provide a pressure sealing method and headspace modification method that can provide for removal of vacuum pressure such that there is substantially no remaining force within the container utilising a gas other than nitrogen, such as simple clean or filtered air.

It is a further object of one possible embodiment of the present invention to provide a pressure sealing method and headspace modification method that can provide for removal of vacuum pressure such that there is substantially no remaining force within the container utilising a simple heated liquid such as water.

It is a further object of one possible embodiment of the present invention to provide a headspace compression method whereby air, or some other gas or liquid or combination thereof, is charged into the headspace under sealed pressure to create an increased pressure in order to negate the effect of vacuum pressure created during cooling of the product.

It is a further object of one possible embodiment of the present invention to provide a headspace modification method whereby sterile or heated liquid, or air, or some other gas or combination thereof, is charged into the headspace under sterile conditions to create a positive pressure in order to negate the effect of vacuum pressure created during cooling of the product.

It is a further object of one possible embodiment of the present invention to provide a headspace modification method whereby sterile air, or some other gas or liquid or combination thereof, is charged into the headspace under sealed pressure to negate the effect of vacuum pressure created during cooling of the product.

It is a further object of one possible embodiment of the present invention to provide a headspace modification method whereby a compressive seal is applied to the neck finish of the container.

It is a further object of one possible embodiment of the present invention to provide a headspace displacement method whereby a compressive seal is applied to the neck finish that is forcibly displaceable into the container prior to cooling the liquid contents, such that a positive pressure may be induced into the container.

A further and alternative object of the present invention in all its embodiments, all the objects to be read disjunctively, is to at least provide the public with a useful choice.

The pressure sealing method of the present invention may provide for the seal of a container to be finally closed within an increased pressure environment rather than at ambient pressure. In this way an exact pressure can be achieved within the container at the moment of sealing, ensuring consistency of headspace pressure in every container. This prevents any variability caused by inconsistent timing of bottle presentation to a capper, inconsistent fill levels within a container, inconsistent container sizes and so forth.

The present invention may improve upon dosing techniques for expanding gases such as nitrogen, by ensuring the seal is finalised only when the correct dose is applied inside the container.

The present invention may also provide for the use of non-expanding gases to be used, such as air, filtered air, steam or other inert gas.

The present invention may also provide for fluid or liquid to be introduced under pressure into the headspace of a container as opposed to expanding or non-expanding gas. The liquid may be either, heated and contractible or heatable and non-contractable.

The present invention may be suitable for cold filled and aseptic filling lines as a way of controlling nitrogen dosing into containers for increased top load to ensure consistent dose application.

The present invention may be suitable for cold filled and aseptic filling lines as a way of increasing top load in containers but avoiding the use of nitrogen by instead increasing the pressure within containers through the introduction of some other medium, for example filtered air or water, which may be sterile and/or heated and/or cold.

The present invention may provide for the pressure to be increased within the container immediately prior to and during capping.

The present invention may provide for the pressure re-sealing of a container that has been initially sealed in a conventional, ambient pressure manner.

The present invention may provide for pressurisation of the container to provide compensation for any cooling of heated contents within the container, either before or after the contents have cooled, and with greater control over the structure of the container through the critical high heat and high pressure cycle period within the first few minutes of post filling.

The pressure sealing method of the present invention may provide for on-line gaseous or liquid dosage calibration in a conventional container filling line. The amount of pressure within the headspace may be controlled precisely at the time of sealing and may be readily adjusted to deliver consistent dosage to each container which corresponds to the container's individually measured head-space volume.

The system may generally include an empty container in-feed station, a continuous container conveying system, a container product fill station, a container head-space dosing station, an optional liquified gas dispensing station, an optional gas dispensing station, an optional liquid dispensing station, a container sealing station, a container internal pressure sensing station, a discharge conveyor and a reject apparatus.

One preferred embodiment of the present invention may provide for the container sealing station to incorporate the optional gas, liquefied gas, liquid and container internal pressure sensing stations.

The system may provide for the on-line control of the head-space volume of each container after it has been filled with product and following the addition of liquid or gas. The head-space volume measurement may be precisely controlled at the time of sealing so that the dosage of liquid or gas delivered to each container may correspond directly to its individually measured head-space, and generally does not alter once immediately sealed, except for variations caused by temperature changes within the contained liquid.

With dosages being exactly correlated to the individually measured requirements of each container, very uniform pressure ranges may be obtained, as opposed to dosages based on expected fill levels or after-the-fact average measurements. Therefore, containers can be down gauged as they will not be required to accommodate a wide pressure range. Furthermore, the system may achieve lower spoilage rates due to improperly pressurized containers because the system immediately self adjusts for fill variations as containers receive a dosage of liquid or gas.

A particular advantage of the present method and system may be the greater and more precise control allows for much lower pressure dosing for hot fill containers. In prior methods a minimum pressure value can only be assured by over pressurisation on average, such that the lowest dose achieved will meet specifications. This has resulted in generally high pressures achieved during the early stages of hot fill, when the container is hot and malleable. As a result the container is stressed significantly in most occasions, necessitating the need for example for petaloid bases and container designs more suitable to carbonated or pressure vessels. This reduces significantly the design options available for containers, and requires additional weight in the container surrounding the base in order to achieve reasonable results.

Other advantages and aspects of the invention will become apparent upon making reference to the specification, claims, and drawings to follow.

According to one aspect of the present invention there is provided a container for use in hot or cold filling operations and having a seal or cap adapted to provide a temporary opening or aperture into said container, said opening or aperture providing for the introduction under pressure of one or more liquids and/or gases, said seal or cap providing with a neck of said container, in use, a container headspace having a pressure, substantially at the moment of sealing, greater than existed prior to introduction of said one or more liquids and/or gases.

According to a further aspect of the present invention there is provided an expandable container having a seal or cap that is applied to the container under an increased pressure environment such that the container headspace has a positive pressure value substantially at the exact moment of sealing to provide for increased pressure inside the container.

According to a further aspect of the present invention there is provided a container having a seal or cap that is applied to the container under an increased pressure environment such that the container headspace has a positive pressure value substantially at the exact moment of sealing to provide for increased pressure inside the container to negate the effects of a subsequent cooling of a liquid that is heated either before or after filling into the container.

According to a further aspect of the present invention there is provided a container having a seal or cap that is finally closed on a container under a controlled environment such that the container headspace has a controlled pressure value substantially at the exact moment of sealing to provide for increased pressure inside the container to negate the effects of a cooling of a liquid that is heated either before or after filling into the container.

According to a further aspect of the present invention there is provided a capping unit that seals the open end of a container from the outside environment and applies pressure to the inside of the container prior to and during application of a cap or seal such that the container headspace has a positive pressure value substantially at the exact moment of sealing to provide for increased pressure inside the container.

According to a further aspect of the present invention there is provided a capping unit that seals the open end of a container from the outside environment and applies pressure to the inside of the container prior to and during application of a cap or seal such that the container headspace has a positive pressure value substantially at the exact moment of sealing to provide for increased pressure inside the container to negate the effects of a subsequent cooling of a liquid that is heated either before or after filling into the container.

According to a further aspect of the present invention there is provided a container having a seal or cap having a temporary opening or aperture into said container, said aperture providing for the introduction under pressure of a gas, or liquid or both, said aperture also being sealable under compression to provide a controlled raising of internal pressure within the container prior to cooling of the heated contents.

According to a further aspect of the present invention there is provided a container having a seal or cap temporarily applied such that an opening or aperture into said container is provided by an incomplete seal being formed between the cap and the neck finish of the container, said aperture providing for the introduction under pressure of a gas, or liquid or both, said aperture also being sealable under torque compression to provide a controlled raising of internal pressure within the container prior to cooling of the heated contents.

According to a further aspect of the present invention there is provided a container having a seal or cap providing a temporary seal immediately post-filling and an aperture or opening being accessible under both ambient or sterile conditions to provide for the introduction of a medium, heated or sterile, gas or liquid or both, said aperture or opening also further being sealable under sterile conditions to provide a controlled raising of internal pressure within the container following cooling of the heated contents.

Preferably, a system and process provides for pressurising the headspace of a container following the introduction of a heated or heatable liquid and sealing the container so that the pressure is retained within the container, and to cool the container sidewalls to a temperature less than the central core temperature of the liquid contents.

Preferably, a sealing device raises the pressure inside a container prior to sealing, and applies a cooling method to the container sidewalls for a period of time after sealing until the temperature of the liquid contents fall below a threshold value.

Preferably, this is achieved by means of a device for sealing and/or capping containers that can also pressurize containers prior to sealing and/or capping, and that may also preferably initiate the differential cooling process to prevent the sidewall temperature exceeding approximately 70 degrees C.

As the containers exit the capper unit, the differential temperature regulation must be maintained until pasteurization is complete within the container, and therefore often through the typical inversion process of the container and for a set period of time afterwards. Once the critical time period is reached to deem pasteurization has been satisfied, then the product temperature may be more aggressively reduced in order to bring the product temperature down to below approx. 70 degrees C. Thus, the process is no longer differential in object, whereby as high an internal temperature as possible is maintained against a cool outer shell of container sidewall. The process may be more aggressive in order to bring the internal temperature down. This period of cooling is the more traditional approach of relatively unregulated cooling application and is found in all prior art process. In the present invention it is preferably mandated to occur, however, until the core temperature of the product has reached below approximately 70 degrees C. In prior art there is no such mandate and the cooling is applied as soon as pasteurization is complete and it is applied until the product is brought down to an exit temperature of approximately 30 degrees C.

In the present invention, the cooling may be stopped after the product has decreased in temperature to approximately 60 degrees C. to 70 degrees C. More traditional cooling may be applied at any time after this, and could be up to 10 minutes afterwards in situations where containers are held in collection bays for example.

In the present invention the cooling method may be by the use of any typical medium such as water or air.

It will be appreciated that in order to maintain as high a core temperature as possible against a shell temperature below 70 degrees C., then it would be preferable to use a water temperature below 70 degrees C. The higher the temperature of the applied medium then the higher the temperature maintenance within the container until pasteurization is complete. The lower the temperature application to the sidewalls then the more danger the internal temperature is reduced too rapidly.

It will be further appreciated that in order to save energy cost it is preferable to apply an ambient temperature medium. Therefore in order to maintain correct internal temperatures the flow and application rate of the cooling medium must be carefully controlled to keep internal temperatures high.

Notwithstanding this, it will be appreciated that should mediums be applied at more typical cooling temperatures, then these must be very carefully controlled to maintain correct differential between the shell temperature and the core temperature.

According to a further aspect of the invention a method of filling a container with a liquid includes introducing the liquid through an open end of the container, providing a seal or cap having, or adapted to have, an opening or aperture, providing at least one gas and/or liquid through the opening or aperture and sealing the opening or aperture to increase the pressure in a headspace of the container.

According to a further aspect of the invention a method of filling a container with a fluid includes introducing the fluid through an open end of the container so that it, at least substantially, fills the container, heating the fluid before or after its introduction into the container, providing a seal or cap having an opening or aperture, said opening or aperture being initially sealed, providing for the heated contents to cool, providing a method of subsequently accessing the opening or aperture under controlled conditions and injecting gas and/or liquid through the opening or aperture and sealing the opening or aperture under controlled conditions, so as to compensate for the pressure reduction in the headspace of the container following the cooling of the heated contents.

According to a further aspect of the present invention there is provided a container having an upper portion with an opening into said container, said upper portion having a neck finish adapted to include, subsequent to the introduction of a heated or heatable liquid into the container, a moveable seal, said seal being inwardly compressible or mechanically moveable while the liquid is in a heated state, or prior to heating, so as to increase the pressure of the headspace.

According to a further aspect of the invention a method of filling a container with a fluid includes introducing the fluid through an open end of the container so that it, at least substantially, fills the container, heating the fluid before or after its introduction into the container, providing a moveable seal for the open end to cover and contain the fluid, said seal being capable of mechanical compression of the headspace of the container so as to compensate for subsequent pressure reduction in a headspace of the container under the seal as the heated contents are cooled.

According to a further aspect of the invention a method of sealing a container with a gas or liquid includes capping the container with the entire capping station being pressurized.

Further aspects of the invention which should be considered in all its novel aspects will become apparent from the following description.

DETAILED DESCRIPTION OF PREFERRED EMBODIMENTS

Figure 1B:
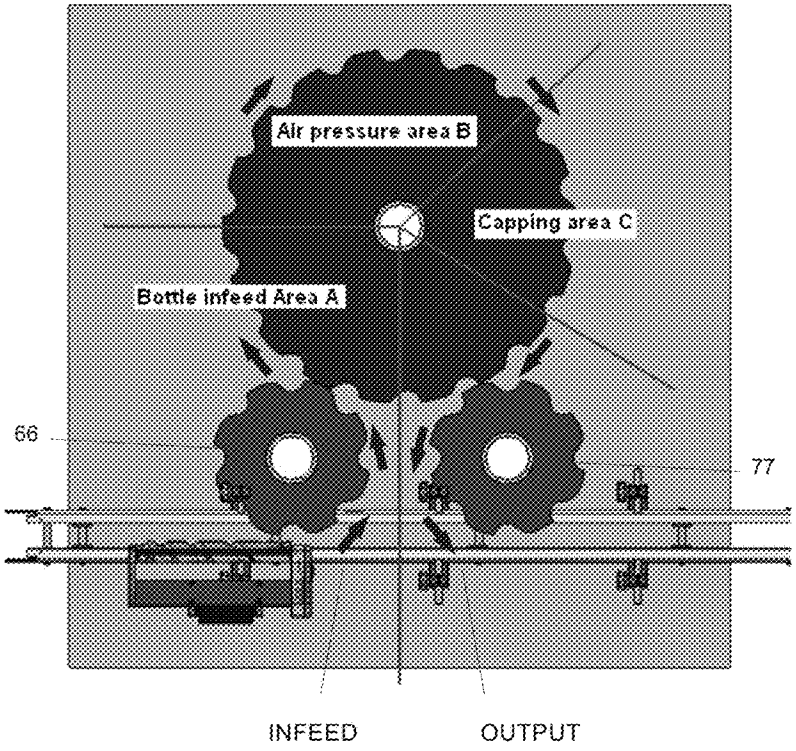
FIG. 1B shows a plan, diagrammatic view of a capping and pressure dosing apparatus embodying the principles of part of one embodiment of the present invention.

The present invention in one particular embodiment is directed to an apparatus that includes a capping and gas pressure dosing system configured to overcome shortcomings associated with previously known arrangements by injection of a medium in any state, for example gas, liquid, steam or any combination into containers at about the time of sealing a container by the apparatus.

In the present specification, including the claims, the term "fluid" covers both liquids and gases unless the context clearly indicates otherwise.

While the present invention is capable of various embodiments, there is shown in the drawings and specification some presently preferred embodiments, or parts of presently preferred embodiments, with the understanding that the present disclosures are to be considered as exemplifications of the invention, and are not intended to limit the invention to any specific embodiments illustrated. It will be appreciated that the terms capping and sealing may be used interchangeably at times.

Figure 1A:
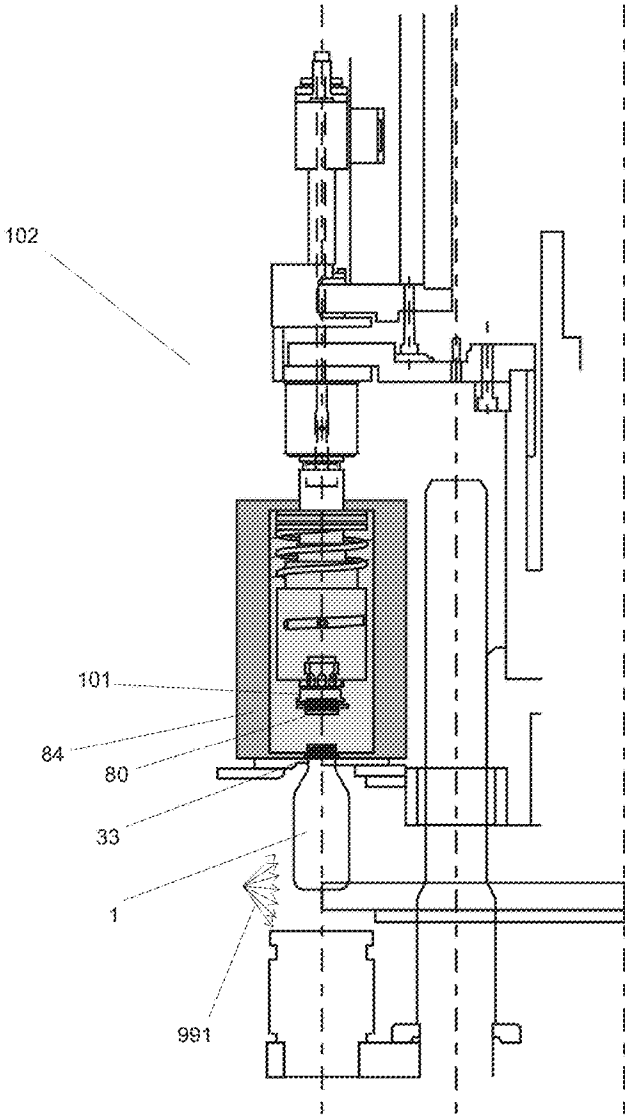
FIG. 1A shows a side elevational, diagrammatic view of a capping and pressure dosing apparatus embodying some of the principles of one embodiment of the present invention.

With reference to FIGS. 1*a-b*, a capping and pressure dosing apparatus 102 is disclosed embodying some of the principles of the present invention. As will be further described, the present apparatus includes a rotary capping machine which is configured for high speed application of closures to associated bottles or like containers. As will be recognized by those familiar with the art, this type of machine serially receives filled bottles from an associated in-feed conveyor or so-called star-wheel, with a machine being configured to substantially continuously apply threaded closures to respective ones of the containers as they are moved through the machine about a generally circular path. The closures are typically applied by rotation to inter-engage the screw threads of each closure with its respective container before the container is moved out of the machine and received by an associated output conveyor or star-wheel. While such equipment exemplifies the configuration of the present invention, it is to be understood that the present capping and pressure dosing apparatus can be configured to operate in accordance with the principles of the present invention by use of other, like equipment, including linear or in-line capping machines.

The pressure dosing system of the present apparatus may also be generally configured in accordance with known capping systems, such as disclosed in U.S. Pat. No. 7,219,480 to Winters et al, which is incorporated in its entirety by reference.

In distinction from arrangements known heretofore, the pressure dosing system of the present system has been electronically integrated within the capping machine to facilitate injection of pressure medium into each of the containers being filled simultaneously with the application of the closure to the container. In accordance with the present invention, this is effected by providing the pressure dosing system within a sealing chamber which is positioned to extend generally over and seal off the upper neck finish or cap of the filled containers as they are moved by the capping machine.

With further reference to FIGS. 1A-B, the present apparatus includes a capping machine 102, as described above. Capping machine 102 is configured to receive containers 1, such as bottles, from an infeed conveyor or starwheel 66 along a circular path 666 in FIG. 1*b*, and to deliver the filled and sealed containers to an output conveyor or starwheel 77 along a circular path 777 in FIG. 1B. The capping machine 102 includes a rotatably driven carrier or turret 1022 which rotates around a centerline (FIG. 1A) and moves the containers 1 along and about a generally circular path which intersects the circular paths defined by the input and output starwheels 66 and 77.

As the containers 1 are moved about the circular path by the capping machine 102, the closures 80 are applied to a respective one of the containers. To this end, the capping machine includes a plurality of capping heads 101. Each of the capping heads 101 is rotatably driven so that a closure 80 received thereby can be positioned above a respective one of the containers 1, and the closure rotated downwardly onto the container into sealing relationship therewith, closing the container and completing packaging of its contents.

As containers 1 are handled by the capping machine 102, the containers each move along the generally circular path defined by the capping machine from an input point to an output point. As will be recognized by those familiar with the art, the input point is sometimes referred to as the transfer point, that is, the theoretical point at which filled container 1 is positioned for receiving a closure thereon, and shown as the bottle infeed area 1023.

In accordance with the present invention, pressure dosing with any medium, for example compressed air or nitrogen in FIG. 1B, is effected within a sealing chamber 84 to facilitate consistent dosing of the containers 1. To this end, the present invention includes a pressure dosing system within operative association with the pressure sealing chamber 84, which is integrally connected to the capping or sealing head of the capping machine 102.

By this configuration, the pressure sealing chamber is positioned to dispense a medium not only to surround and envelope the upper end of the container 1 or cap 80, but also downwardly directly through the opening or mouth of each of the containers 1 received by the rotary turret of the capping machine 102 within the air/fluid pressure area 1024 just prior to final application of a closure or seal to each of the containers within the capping or sealing area 1025 by one of the capping heads 101.

Not only does the present apparatus provide consistent positioning of the container package for pressurization, the container is substantially stabilized, reducing or eliminating further potential for product spillage, allowing for full pressurization. Additionally, dosing simultaneously with closure application prevents any pressure dissipation.

In the preferred form of the present invention, electronic controls are provided which are operatively connected with the electronic controls of the capping machine for accurate timing of the pressure dosing system. The pressure sealing chamber or pressure delivery mechanism supplying the sealing chamber can be provided with a suitable fitting which permits a suitable device to be positioned for controlling and monitoring operation of the system. By electronically controlling the pressure dosing system, and coordinating its operation with the capping machine 102, the present apparatus provides extremely accurate pressure dosing throughout the entire speed range of the capping machine.

Figure 1C:
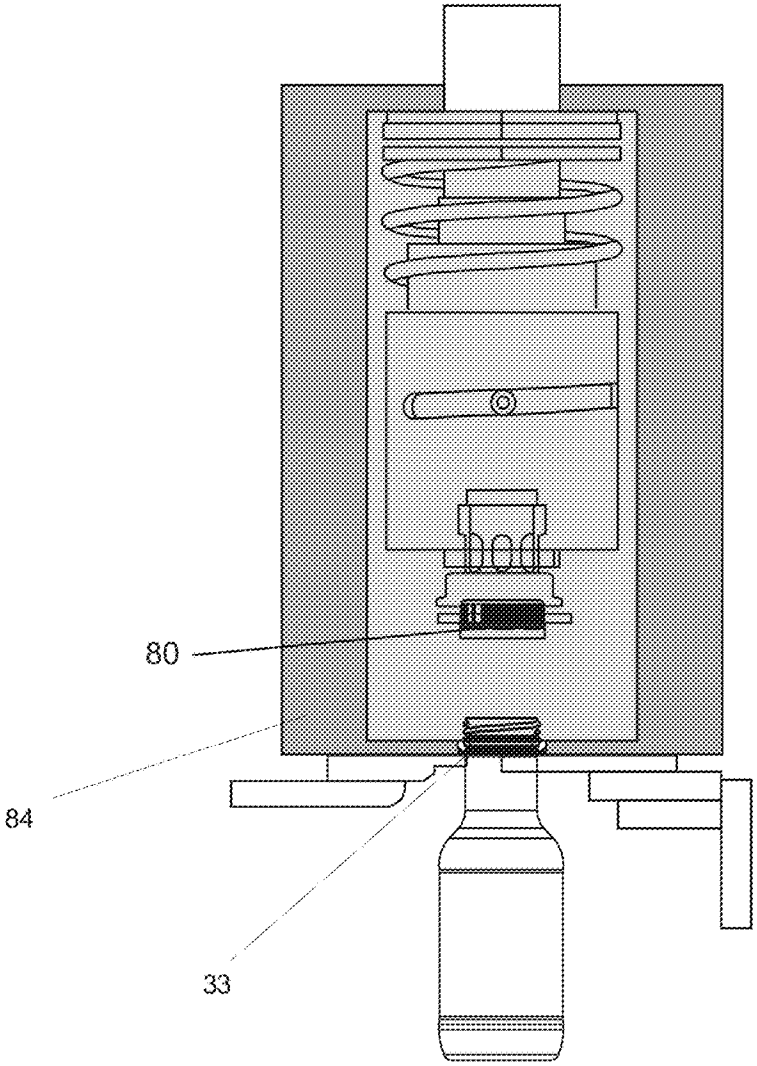
FIG. 1C shows a side elevational, diagrammatic view of a sealing chamber.

FIG. 1C shows in closer detail one example of a sealing chamber. The chamber is capable of sealing under the neck support ring of a container, and prior to applying a cap. The sealing chamber could be one of many such chambers for example on a rotary system for torque sealing the cap to the container. Sealing under the neck provides for multiple changes in container styling without the need for change parts providing each container has the same neck finish diameters. Further, by providing for support under the neck the container may be raised upwardly and supported in the capper to avoid any top load pressure and to also allow for multiple bottle heights without the need for change parts also.

Figure 2:
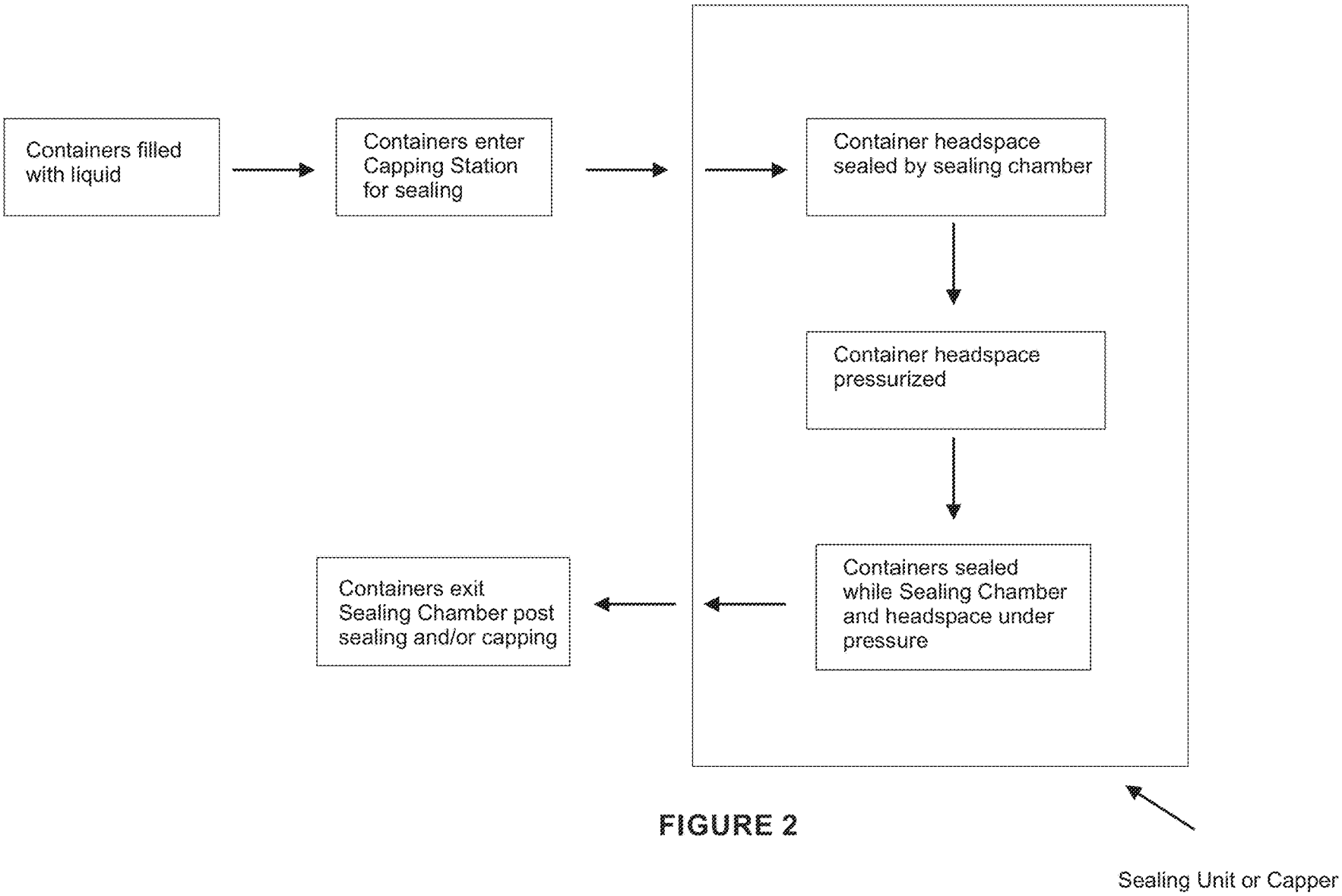
FIG. 2: shows a method according to part of an embodiment of the invention with a Sealing Unit or Capper capable of pressurizing the headspace of a container prior to capping or sealing.

Referring to FIG. 2, a method of pressurizing containers is illustrated whereby the sealing unit or capper receives the filled containers, subsequently seals the headspace from everything but the internal chamber of a sealing chamber, pressurizes the headspace within the sealing chamber and therefore the headspace within the container, and subsequently seals or caps the container so that a raised pressure exists in the sealed container which is then ejected from the pressure sealing unit.

Figure 3C:
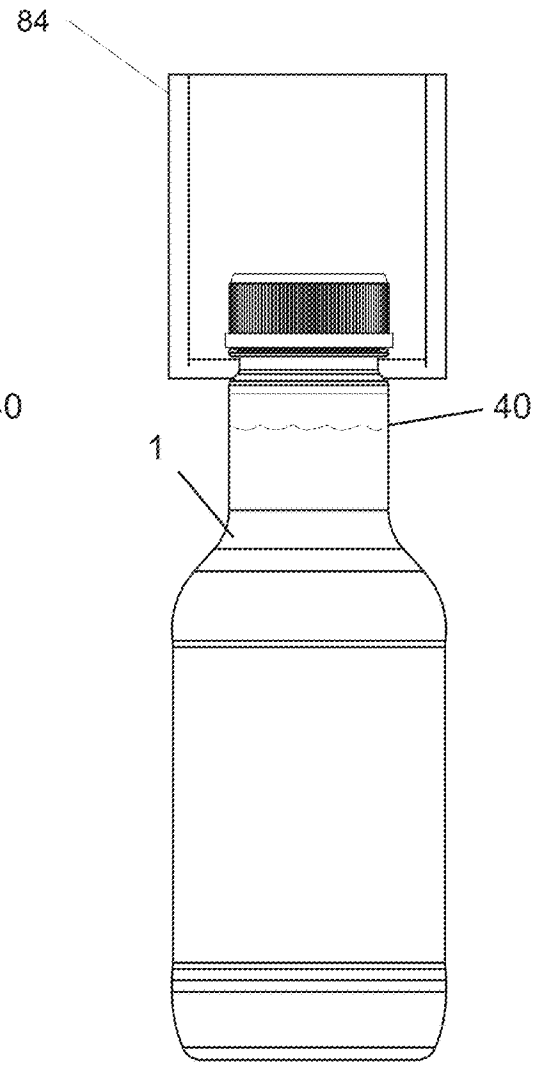
FIGS. 3A-C show a container and Sealing Chamber according to part of an embodiment of the invention.
Figure 3B:
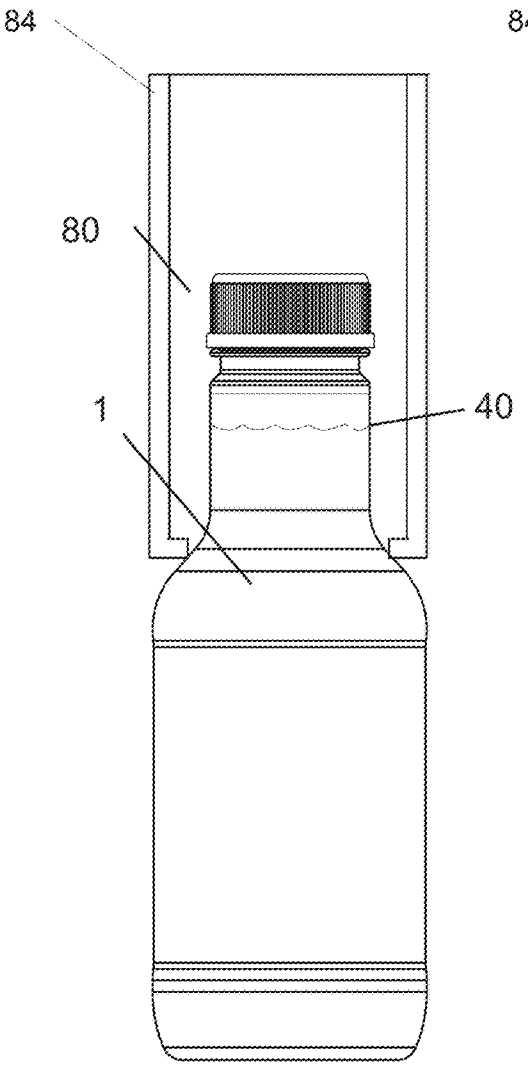
Figure 3A:
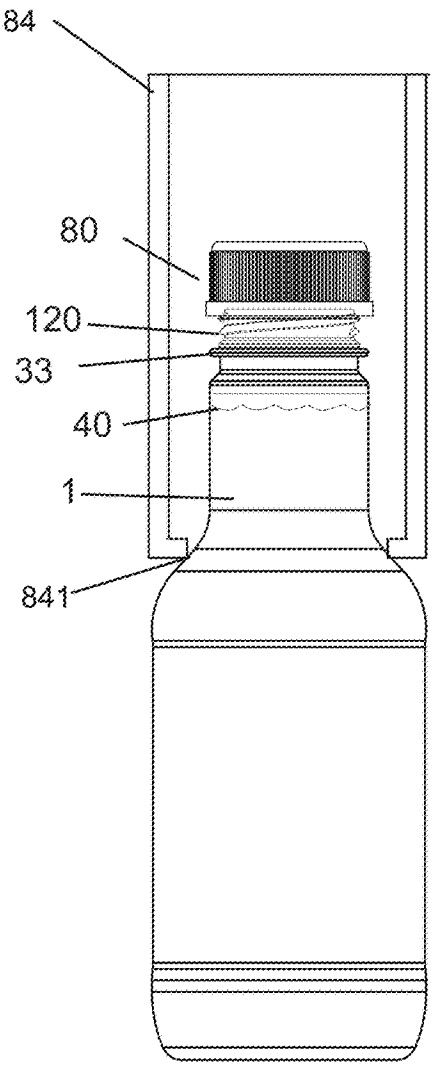

Referring to FIGS. 3A-C, part of an exemplary embodiment of the present invention is shown with a cap 80 engaged with the container neck finish 120. According to one aspect of the present invention a container 1 may enter a capping or sealing station after being filled with liquid contents such that a headspace exists above the fluid level 40. The upper neck region of the container is sealed from the ambient environment by a sealing chamber 84 that has a sealing surface 841 in contact with a sidewall of the container. According to the invention, prior to tightening or applying torque to the cap to seal the headspace finally, a pressure is applied within the sealing chamber 84 such that the internal chamber of the container is pressurized, more particularly the headspace above the liquid is pressurized. Once pressurized the cap is tightened down by the capping or sealing station such that the container has a raised internal pressure prior to release from the unit, as seen in FIG. 3B.

The sealing mechanism may be of many styles, but there is distinct advantage in ensuring the size of the pressure sealing chamber is kept to a minimum. This ensures rapid pressurization of the chamber in high speed rotary situations.

In this embodiment it is envisaged that standard caps are applied to the containers and the pressure capping unit applies internal pressure to the container prior to applying caps.

The sealing mechanism may be of any style, for example the chamber could seal some distance from the neck finish 120 of the container and down the shoulder region, as illustrated in FIG. 3B, or more preferably immediately under the neck support ring 33, as illustrated in FIG. 3C.

Figure 4C:
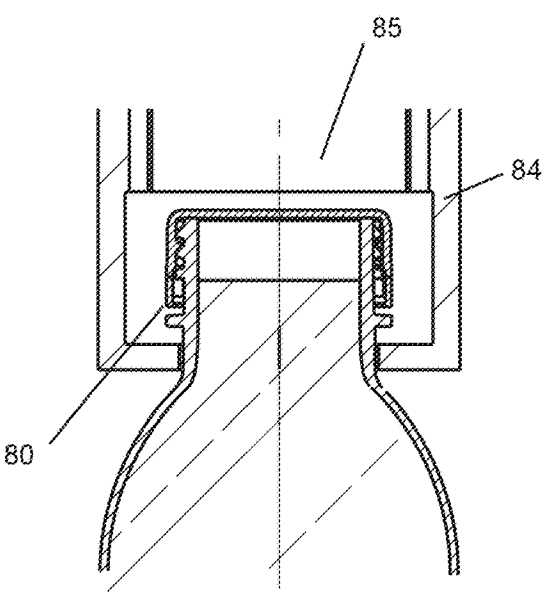
FIGS. 4A-C show a method and Sealing Chamber according to a further embodiment of the invention with a Sealing Unit or Capper capable of pressurizing the headspace of a container.
Figure 4B:
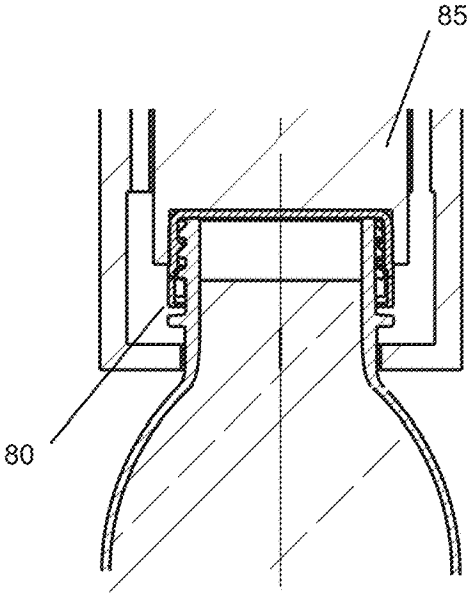
Figure 4A:
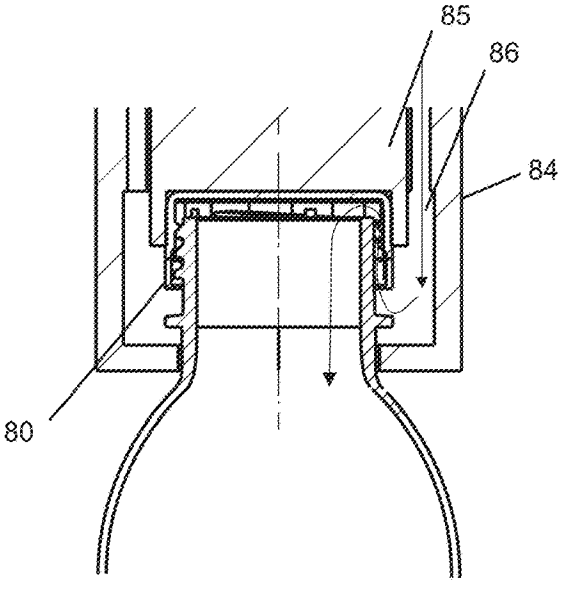

With reference to FIGS. 4A-C, the process within the sealing chamber for the method of a further embodiment is shown whereby a typical cap applied by a standard capping unit but without having been forcibly torqued into position is shown on the container. The neck finish is enclosed within the chamber 84 of the pressure sealing unit. Following the introduction of fluid or gas or medium under pressure, the liquid or gas is forced into the container through the gap between the cap and the thread mechanisms of the neck finish, as shown by passage of liquid 86. Once the desired pressure is obtained, the cap, as shown in FIG. 4B, can then be torqued into position by advancing the torque rod 85 within the chamber 84 while holding the container headspace at pressure. In this embodiment the method may be achieved using standard caps or modified caps as will be discussed next. FIG. 4C illustrates removal of the torque rod 85, correctly torqued cap 80, immediately prior to ejecting the container head from the chamber 84.

It will be appreciated that the present invention offers multiple choices in carrying out a headspace modification procedure. Such a piece of machinery could easily be employed to also provide the function of capping the container in addition to modifying the headspace during the procedure. Various examples are disclosed in my further PCT specifications WO 2009/142510 and WO 2011/062512, both of which are incorporated in their entirety by reference.

In facilitating the present invention, the complete or substantial removal of vacuum pressure by displacing the headspace prior to the liquid contraction now results in being able to remove a substantial amount of weight from the sidewalls due to the removal of mechanically distorting forces.

As discussed above, to accommodate vacuum forces during cooling of the liquid contents within a heat set container, containers have typically been provided with a series of vacuum panels around their sidewalls and an optimized base portion. The vacuum panels deform inwardly, and the base deforms upwardly, under the influence of the vacuum forces. This prevents unwanted distortion elsewhere in the container. However, the container is still subjected to internal vacuum force. The panels and base merely provide a suitably resistant structure against that force. The more resistant the structure the more vacuum force will be present. Additionally, end users can feel the vacuum panels when holding the containers.

Typically at a bottling plant the containers will be filled with a hot liquid and then capped before being subjected to a cold-water spray resulting in the formation of a vacuum within the container that the container structure needs to be able to cope with.

Figures onward from FIG. 4A all refer to upper portions of containers as similarly shown in FIG. 3A.

Figure 5C:
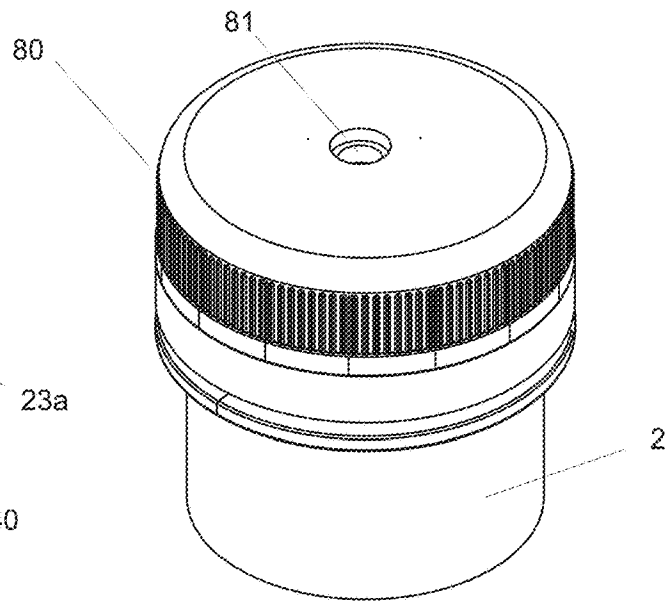
FIGS. 5A-C show enlarged views of part of one possible embodiment of the cap of FIGS. 3A-C.
Figure 5B:
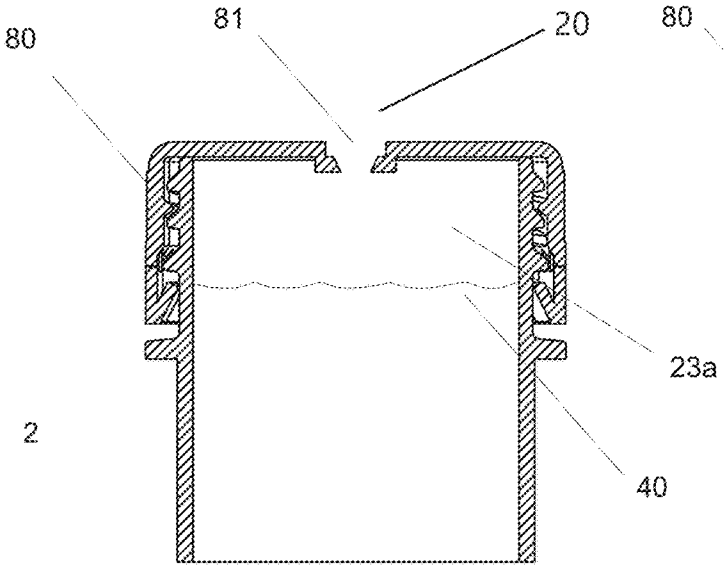
Figure 5A:
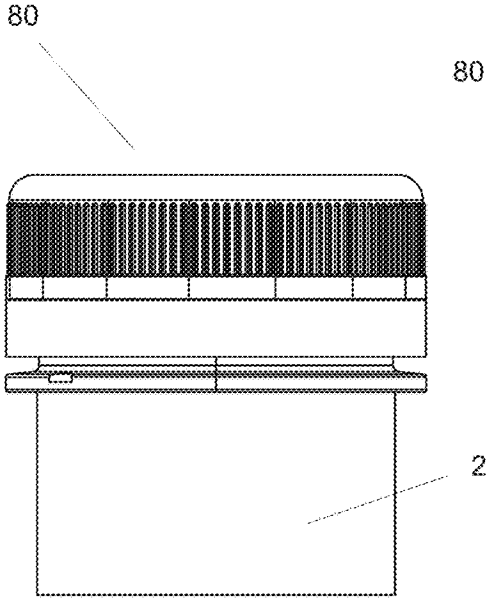

According to a further embodiment of the present invention, and referring to FIGS. 5A-C, following the introduction of a liquid, which may be already heated or suitable for subsequent heating, a cap may be applied to the open end 20, the cap including a small opening or aperture 81. Thus a headspace 23*a* is contained under the main cap body 80 and above the fluid level 40 in the container. The headspace 23*a* is communicating with the outside air at this stage and is therefore at ambient pressure and allowing for the fluid level 40.

Figure 6C:
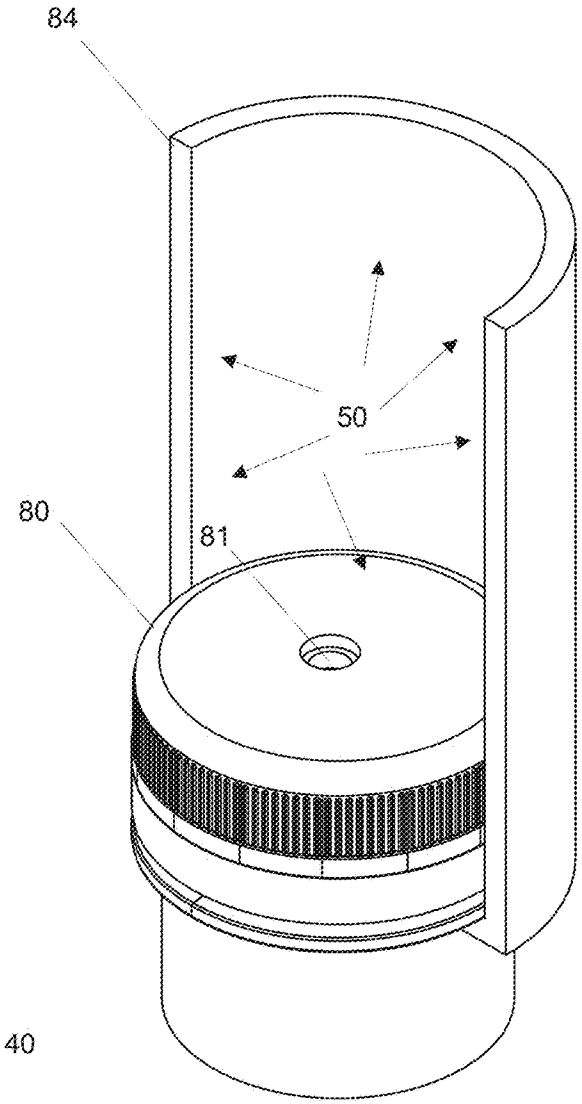
FIGS. 6A-C show part of one embodiment of enclosing the cap of FIG. 5 with a pressure application device.
Figure 6B:
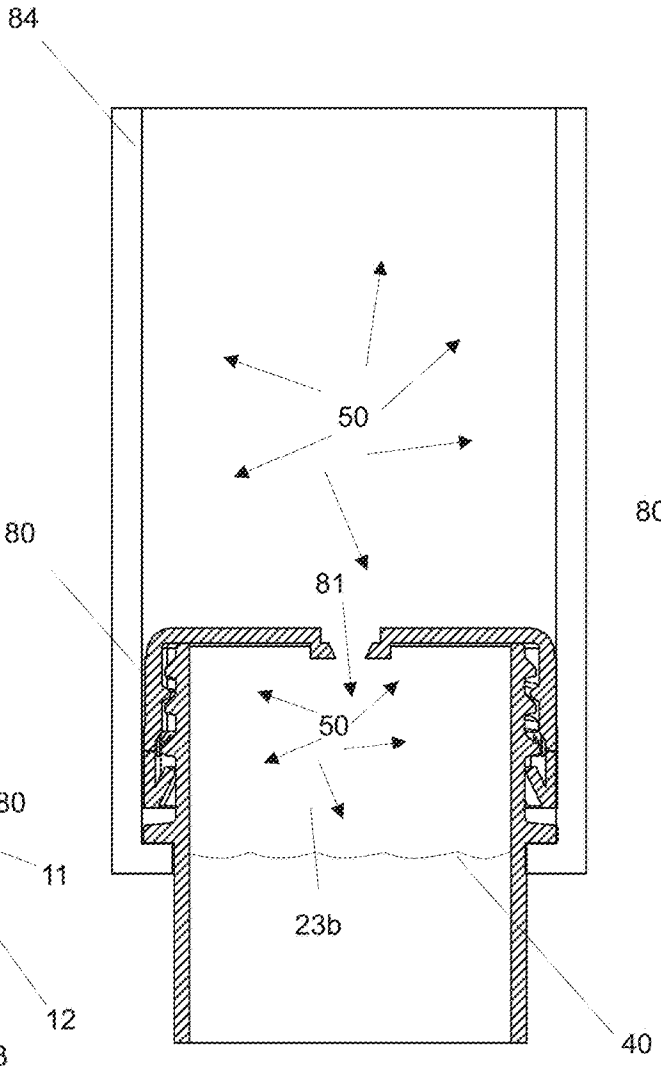
Figure 6A:
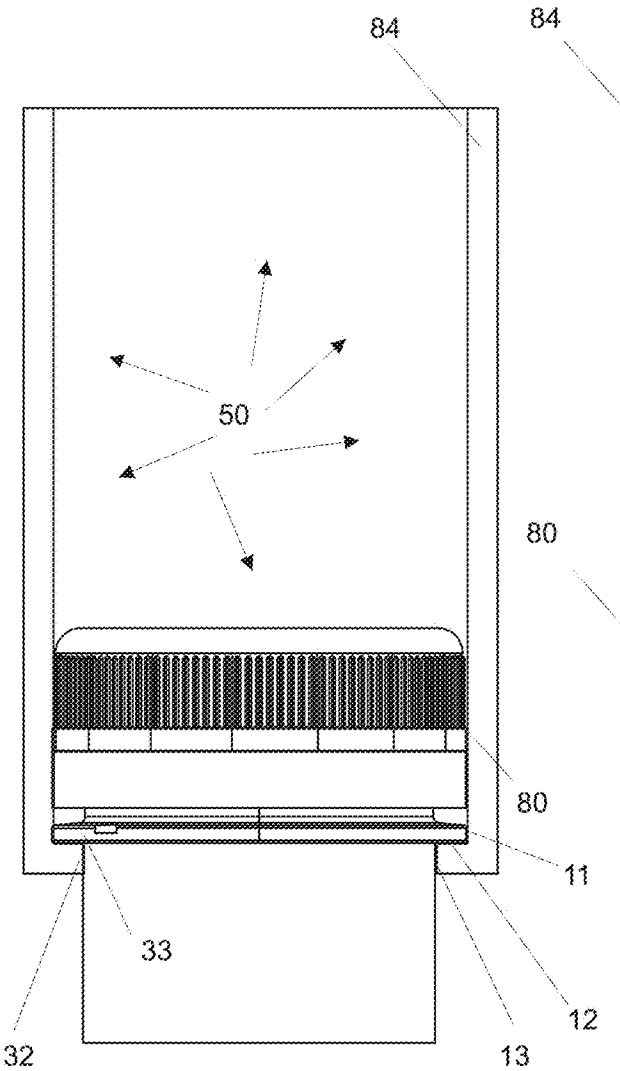

As seen in FIGS. 6A-C, in part of one embodiment, a sealing chamber 84 is applied over the neck finish and cap combination to seal the liquid from the outside air (the upper, closed end of the structure 84 is not shown). As shown, the lower portion of the chamber 84 may seal against the outer border 11 of the neck support ring, a horizontal border 12 of the neck support ring and below the neck support ring 13. Following the introduction of a compressive force 50, for example by way of injecting air or some other gas, the increased pressure within the sealing chamber provides for a subsequent increase in pressure within the headspace 23*b* and also forces the fluid level 40 to a lower point due to the subsequent expansion of the plastic container.

As an alternative to the injection of gas, a heated liquid could be injected, for example heated water. This would provide further advantage, in that the liquid injected would not be subject to the expansion that would normally occur when injecting gas into a heated environment. Thus less force would be ultimately applied to the sidewalls of the container during the early hot-fill stages.

Even further, the injected liquid would contract less than a gas when subsequently cooled. For this reason less liquid is necessarily required to be injected into the headspace to provide compensation for the anticipated vacuum forces that would otherwise occur.

As a further alternative, steam could also be injected into the headspace, providing for the increased pressure environment.

Figure 7C:
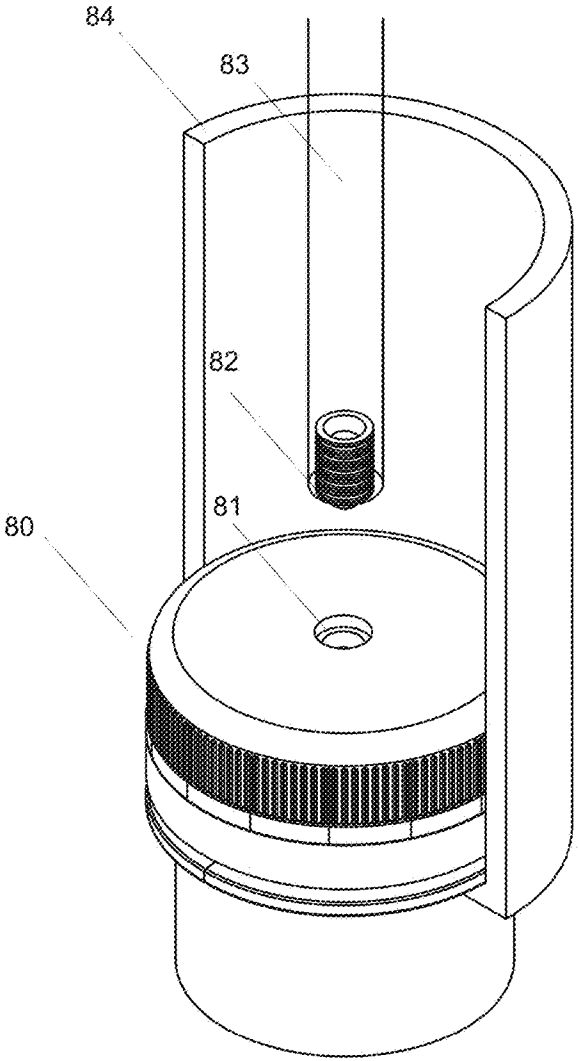
FIGS. 7A-C show part of one embodiment of a cap-sealing device suitable for use in the pressure application device of FIGS. 6A-C.
Figure 7B:
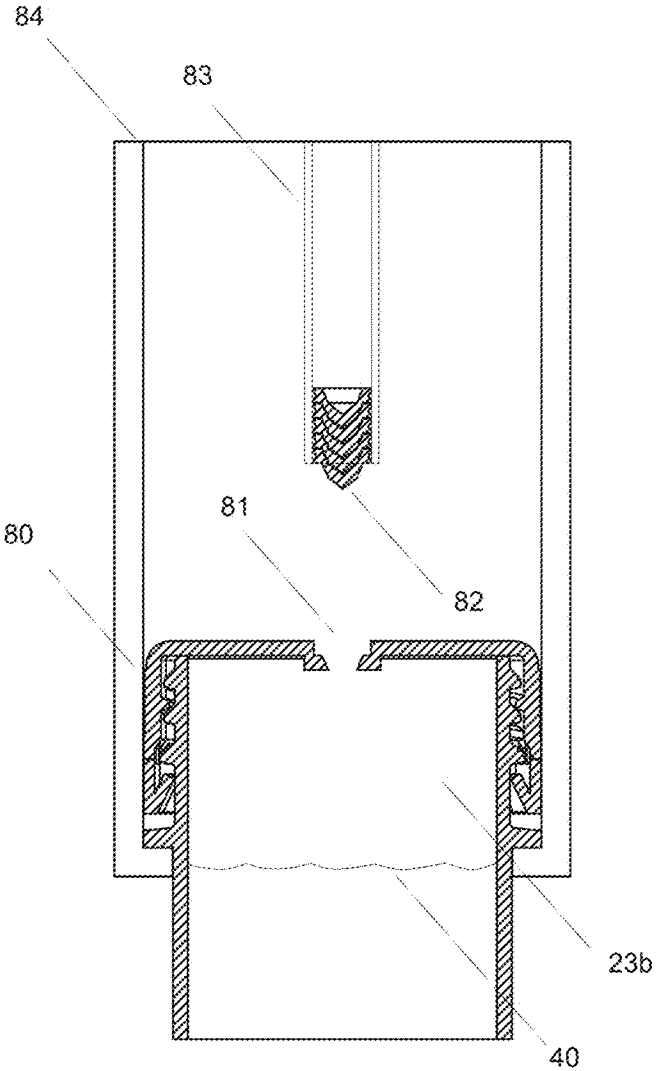
Figure 7A:
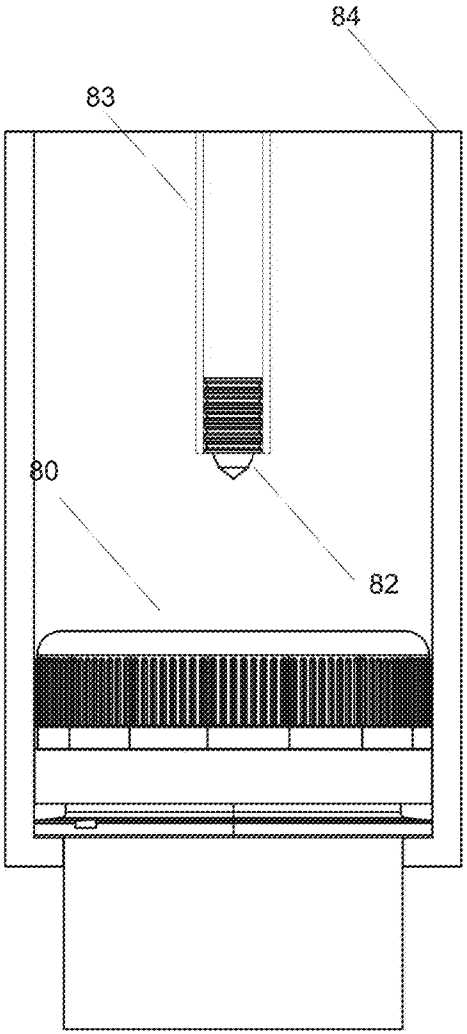

Now referring to FIGS. 7A-C (the compressive force not shown), while pressure is maintained within the sealing chamber 84, a plug mechanism 82 is moved downwardly from a delivery device 83 towards the aperture 81. It will be appreciated the plug mechanism could be of many different styles, for example a pressure-sensitive seal, an ultrasonic weld or the like.

Figure 8C:
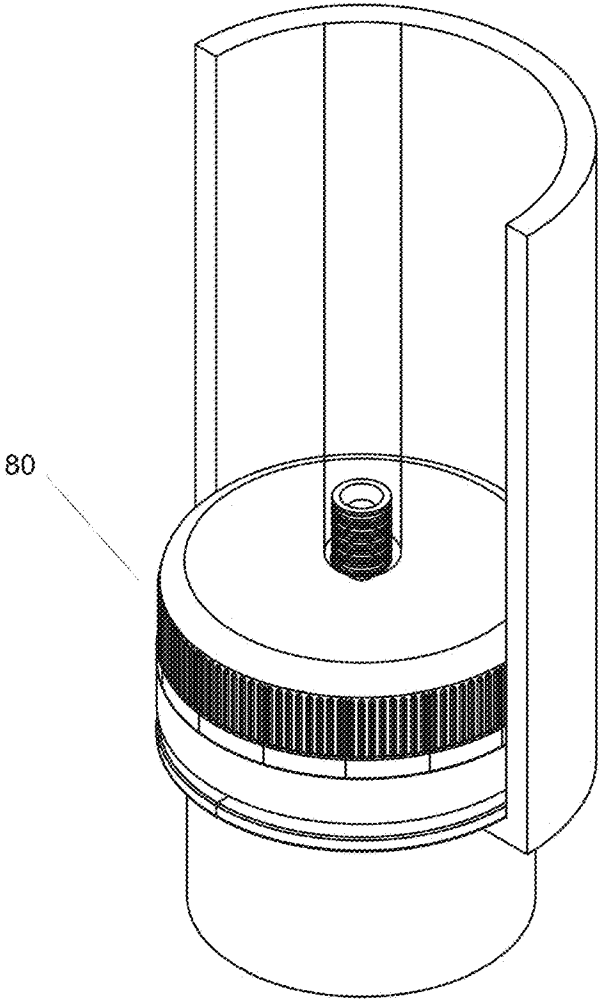
FIGS. 8A-C show part of one embodiment of cap-sealing device of FIGS. 7A-C closing the cap while under compression.
Figure 8B:
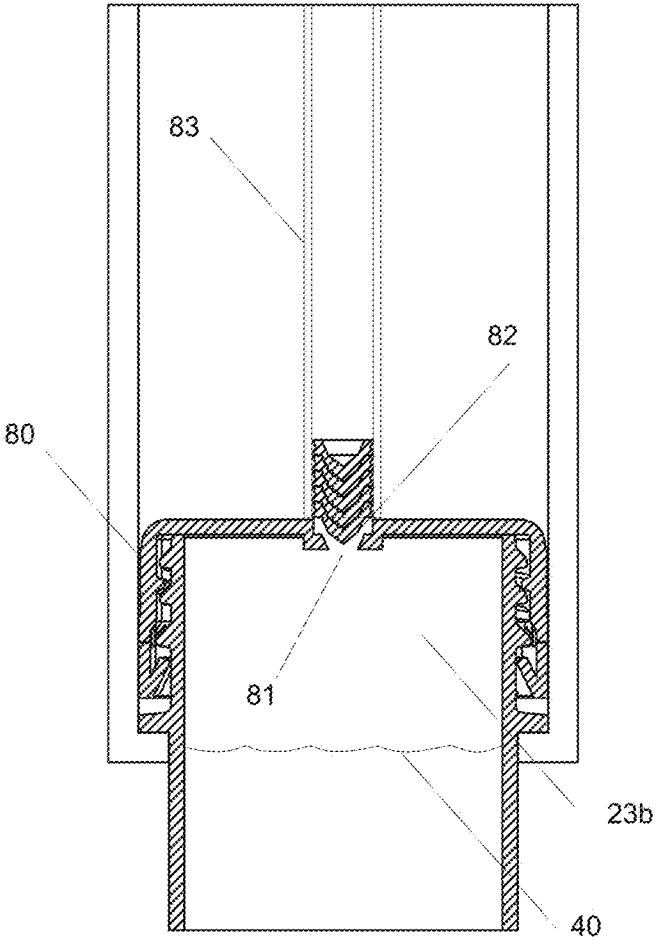
Figure 8A:
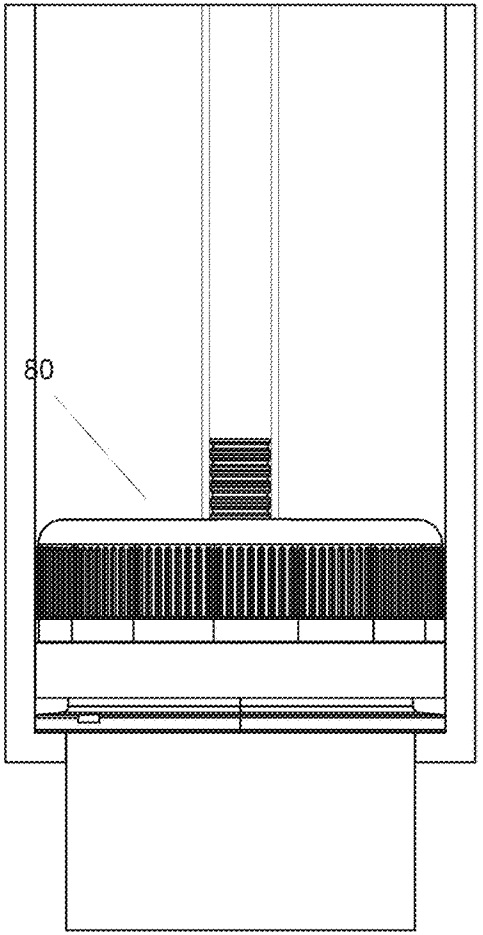

As can be seen in FIGS. 8A-C, while pressure is maintained within the sealing chamber 84, the hole is closed off permanently by the placement of the plug 82 into the hole 81.

Figure 9C:
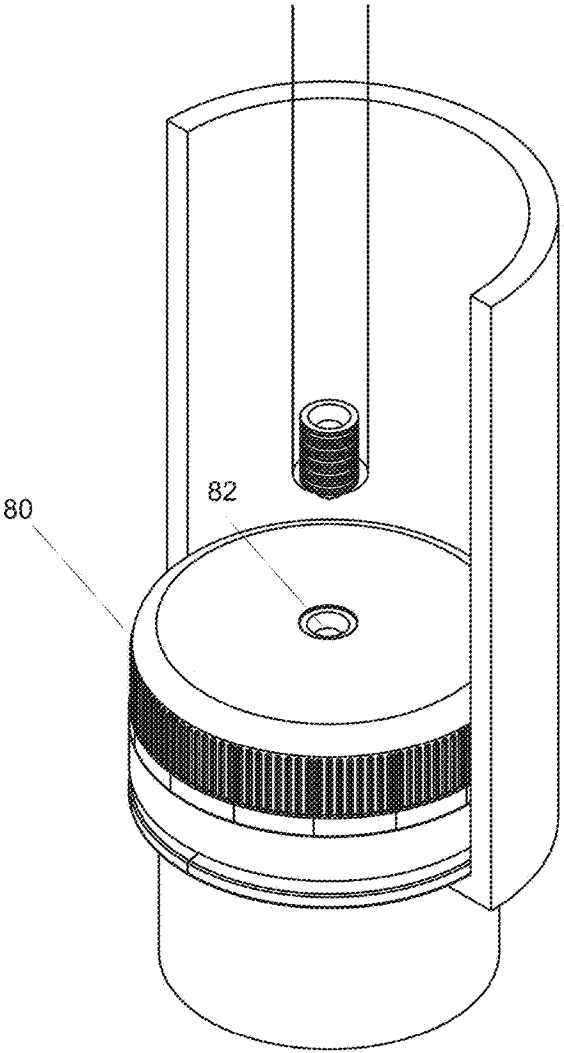
FIGS. 9A-C show withdrawal of the cap-sealing device of FIGS. 8A-C following sealing and subsequent decompression of the compression chamber.
Figure 9B:
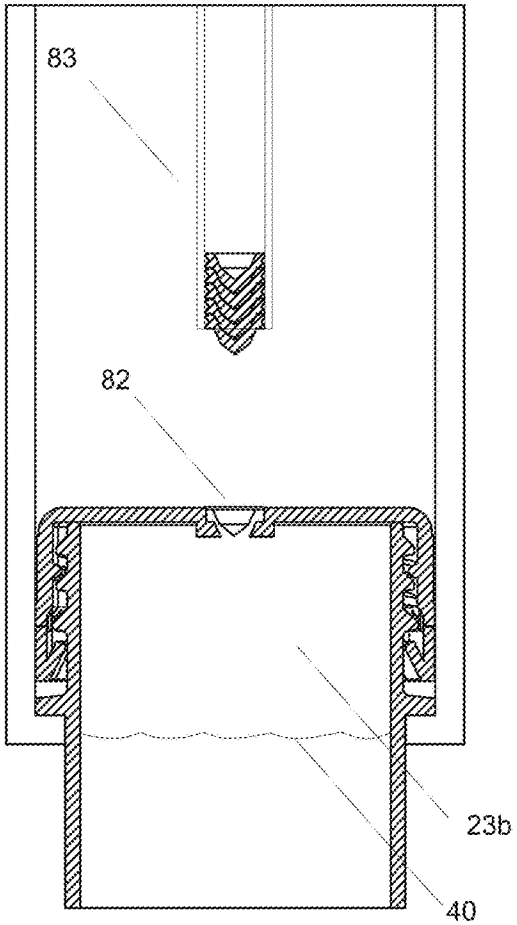
Figure 9A:
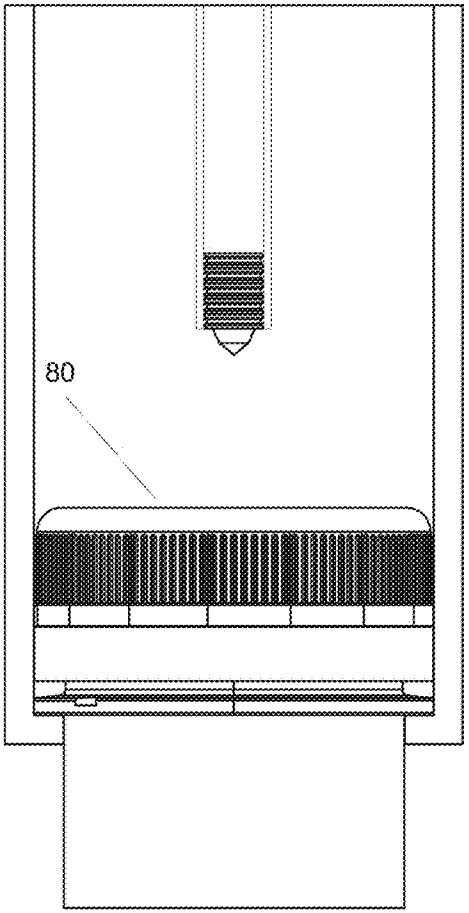

At this point, and as can be seen in FIGS. 9A-C, the headspace 23*b* is charged under a controlled pressure, dependent on the amount of gas delivered, and the sealing chamber may provide for withdrawal of the delivery device 83 following a release of pressure within the chamber as the container is ejected and returned to the filling line.

Figure 10C:
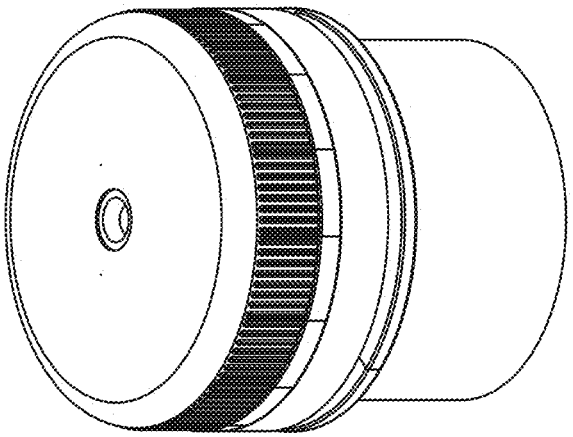
FIGS. 10A-C show the container cap of FIGS. 9A-C following release from the compression chamber (container not shown fully)
Figure 10B:
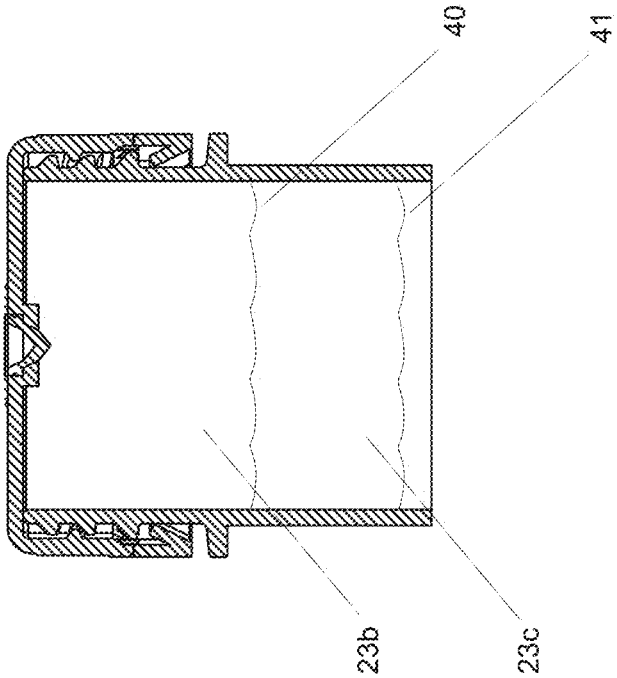
Figure 10A:
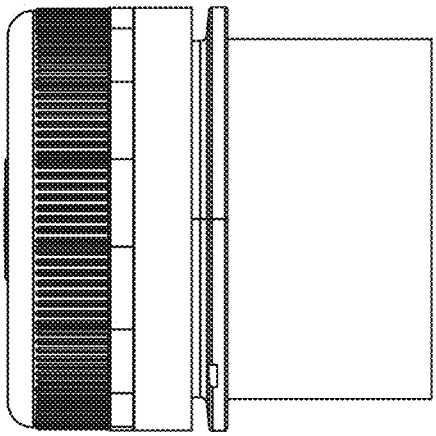

As shown in FIGS. 10A-C, as the bottle subsequently travels down the filling line and is cooled, the headspace 23*b* expands as the liquid volume shrinks. The fluid level 40 lowers to a new position 41 and the pressurized headspace 23*b* expands and loses some or all of its pressure as it forms a new headspace 23*c*.

Importantly, however, once the contents are cooled there is little or no residual vacuum in the container, or even perhaps a positive pressure.

Figure 10F:
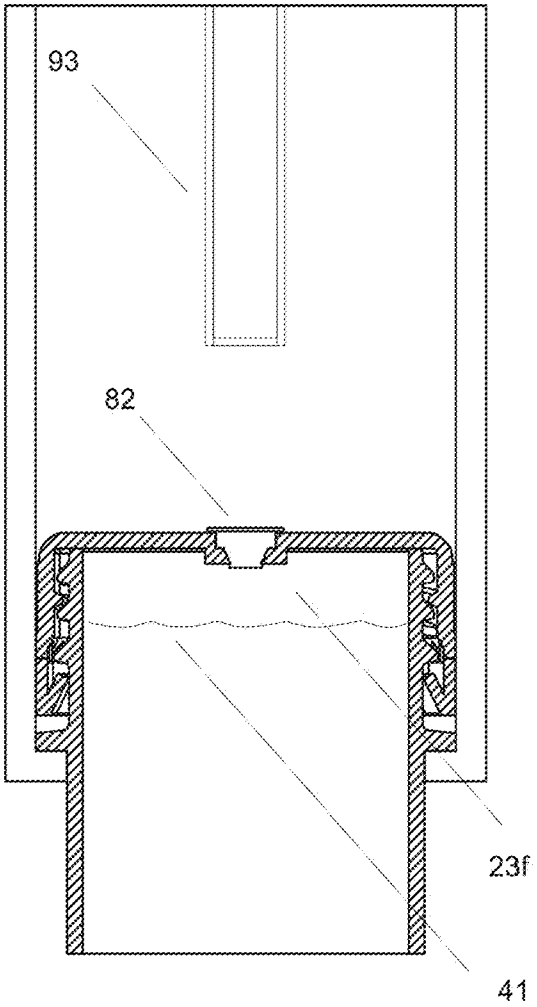
FIGS. 10D-F show a part of a further embodiment of the container cap of the present invention.
Figure 10E:
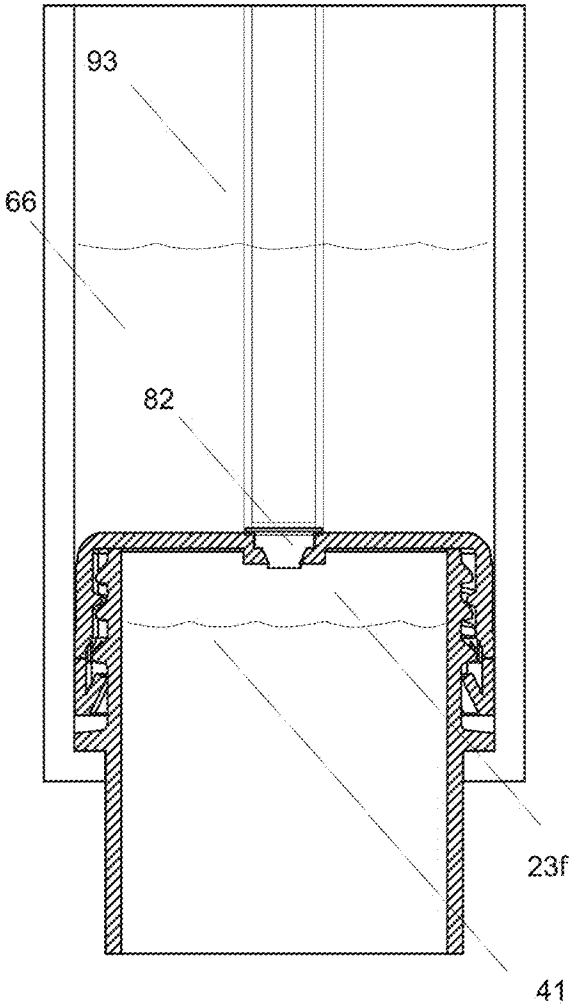
Figure 10D:
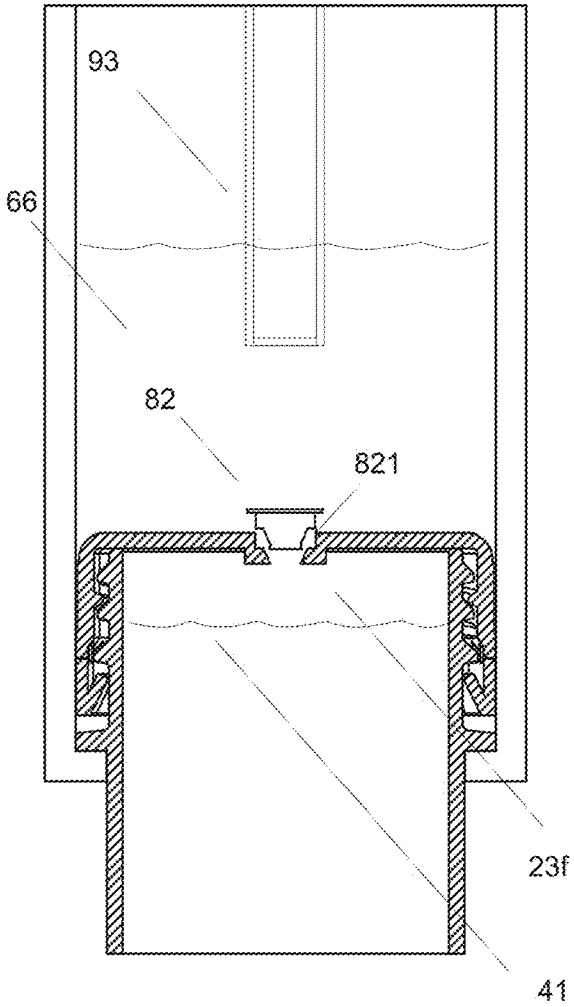

As an alternative, and as shown in FIGS. 10D-F, the plug 82 may be temporarily attached to the cap, for example by member 821, during production of the cap. A liquid, as in the example illustrated, or steam or gas, could be injected in the same manner under pressure to circumnavigate the plug and enter the container headspace under pressure, and a rod mechanism 93 is then forced downwardly to advance the plug 82 into the hole permanently. In this alternative there is no need to load the rod with multiple plug mechanisms.

Further embodiments of the present invention are now described and summarized in also referring to FIGS. 17A-D.

Figure 11C:
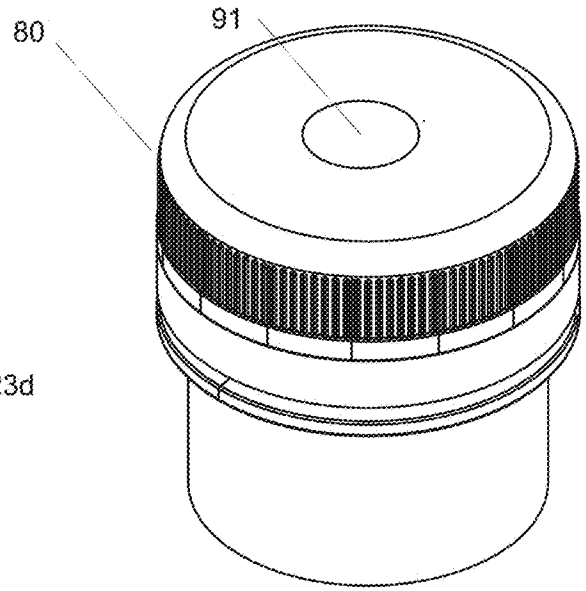
FIGS. 11A-C show enlarged views of part of a further embodiment of the cap of FIGS. 3A-C.
Figure 11B:
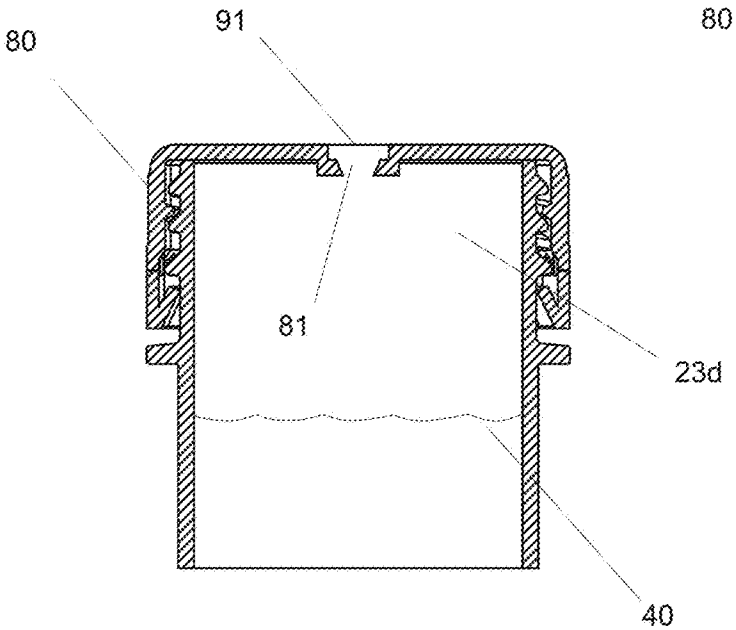
Figure 11A:
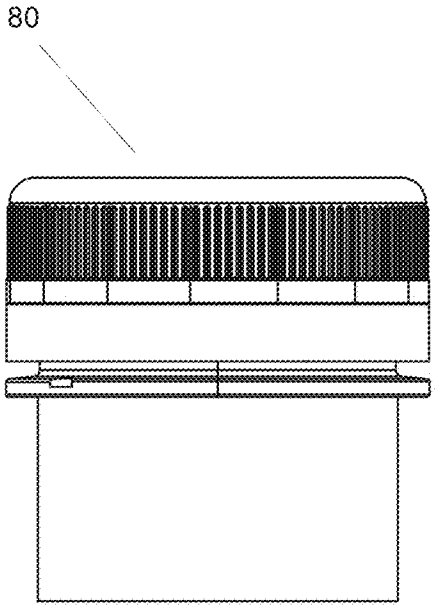

Referring to FIGS. 11A-C, following the introduction of a liquid, which may be already heated or suitable for subsequent heating, a cap may be applied including a small opening or aperture 81 which is temporarily covered by a communicating seal 91. Thus a headspace 23*d* is contained under the main cap body 80 and above the fluid level 40 in the container. The headspace 23*d* is not communicating with the outside air at this stage and is therefore at typical container pressure during the stages of cooling down on the filling line.

Figure 11F:
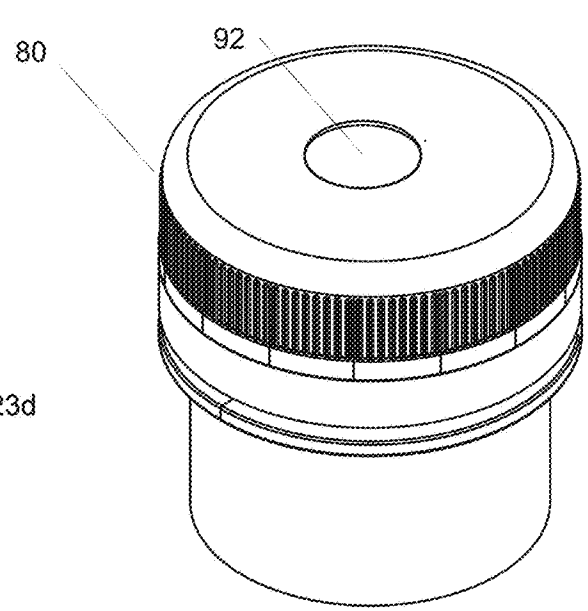
FIGS. 11D-F show enlarged views of a further part embodiment of the cap of FIGS. 3A-C.
Figure 11E:
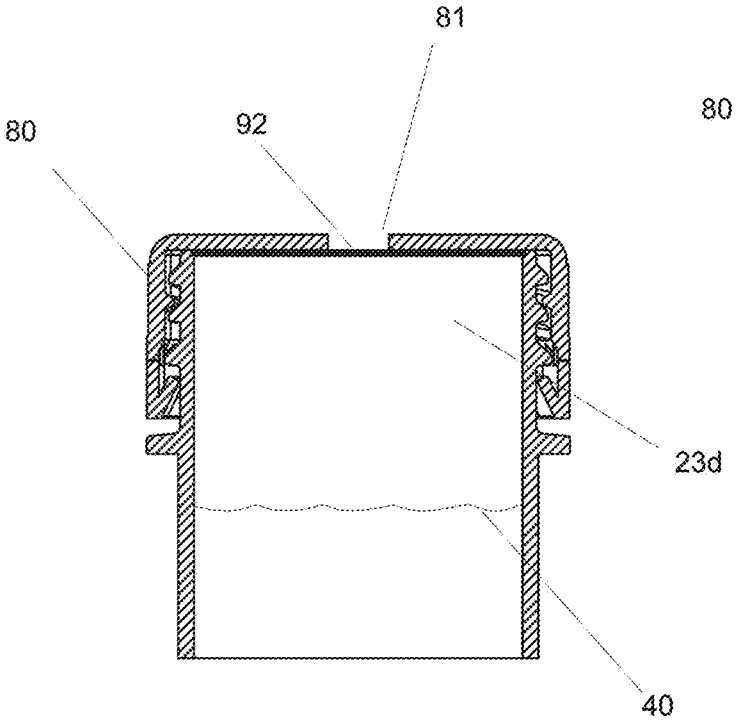
Figure 11D:
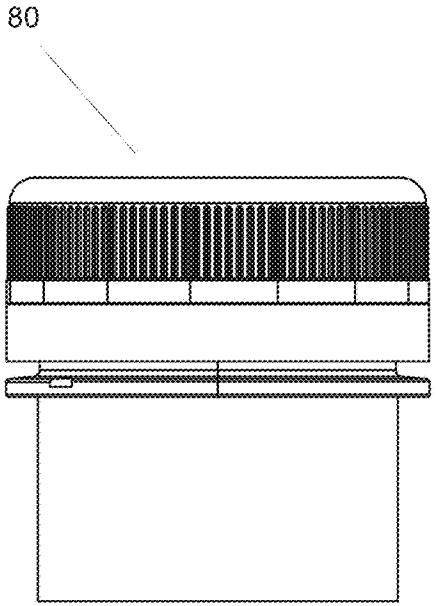

Alternatively, as seen in FIGS. 11D-F, the opening may be temporarily covered by a liner seal contained within the underneath side of the cap and affixed to cover the hole. Construction of the cap would be virtually the same as any other cap containing an induction seal or internal liner, except the cap would contain a small hole that is non-communicating when the liner is in situ.

Figure 12C:
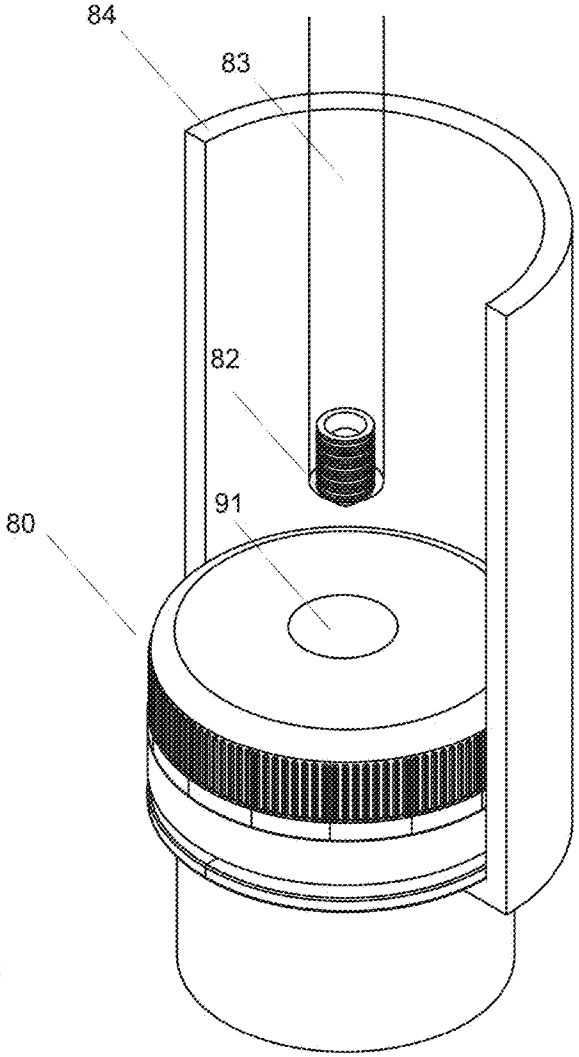
FIGS. 12A-C show part of one embodiment of a cap-sealing device suitable for use with caps such as those illustrated in FIGS. 11A-F.
Figure 12B:
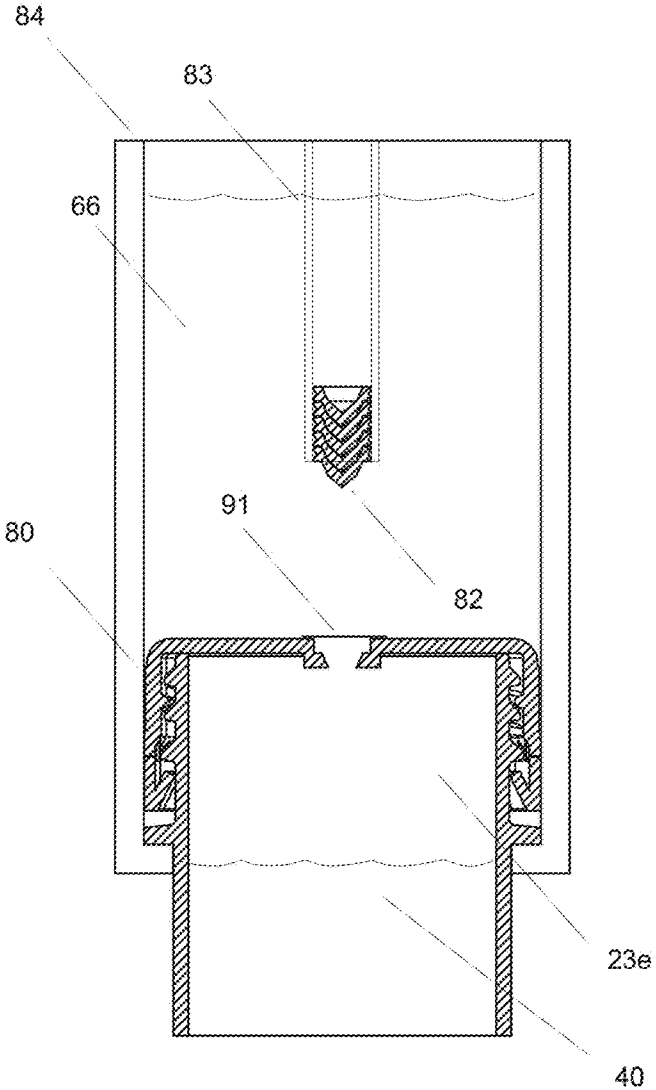
Figure 12A:
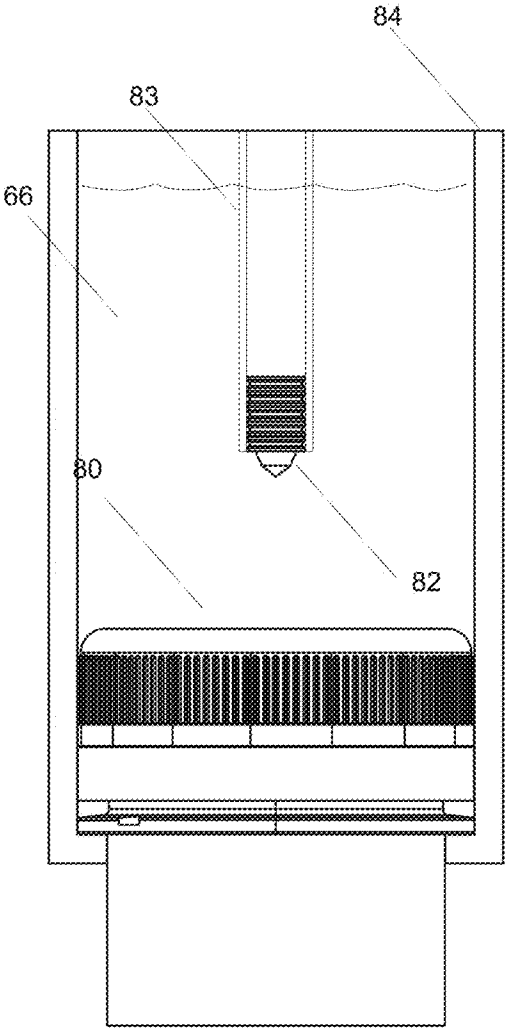

As seen in FIGS. 12A-C, and again also referring inclusively to the example shown in FIGS. 11A-C, once the container has been typically cooled to a level providing for labelling and distribution, the headspace 23*e* will be in an expanded state with a lowered fluid level, and will have created a vacuum due to the contraction of the heated liquid within the container.

As seen in this preferred part embodiment of the present invention, in order to remove the vacuum pressure a sealing chamber 84 is applied over the neck finish and cap combination to seal the communicating seal 91 from the outside air (the upper, closed end of the structure 84 is not shown).

Following the introduction of a sterilizing medium 66, for example by way of injecting heated water, preferably above 95 degrees C., or a mixture of heated water and steam, or steam itself, or a mixture of steam and gas, the sterilizing medium provides for the sterilization of the internal surfaces of the sealing chamber 84 and the communicating seal 91.

Figure 13C:
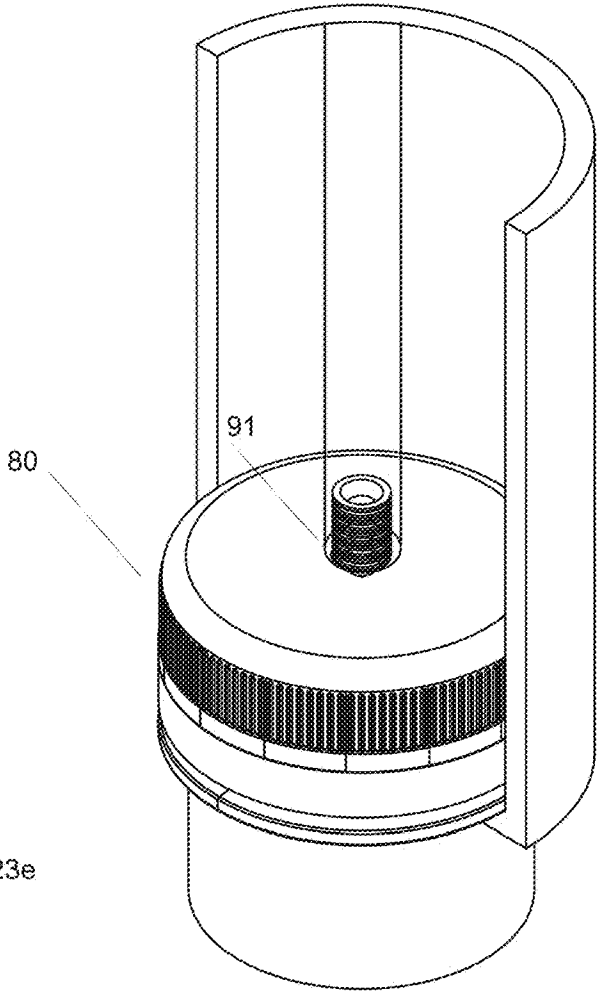
FIGS. 13A-C show part of one embodiment of cap-sealing device of FIGS. 12A-C piercing the cap while under sterilization.
Figure 13B:
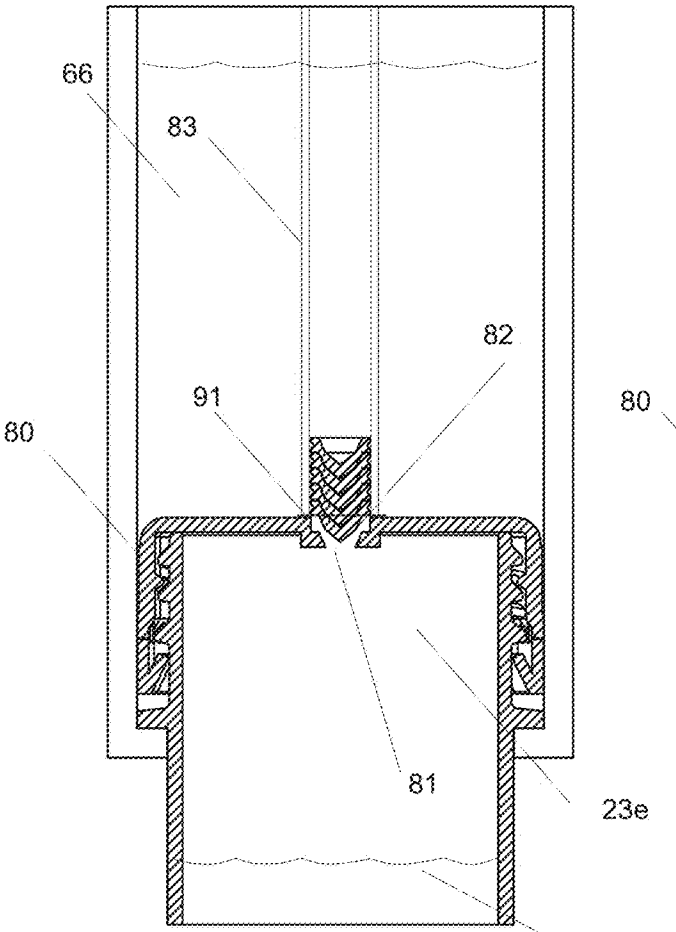
Figure 13A:
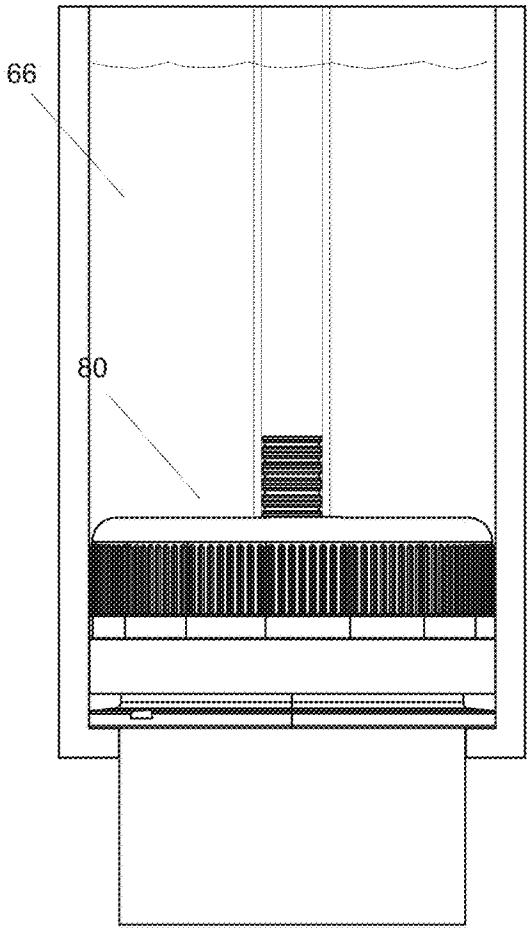
Figure 14C:
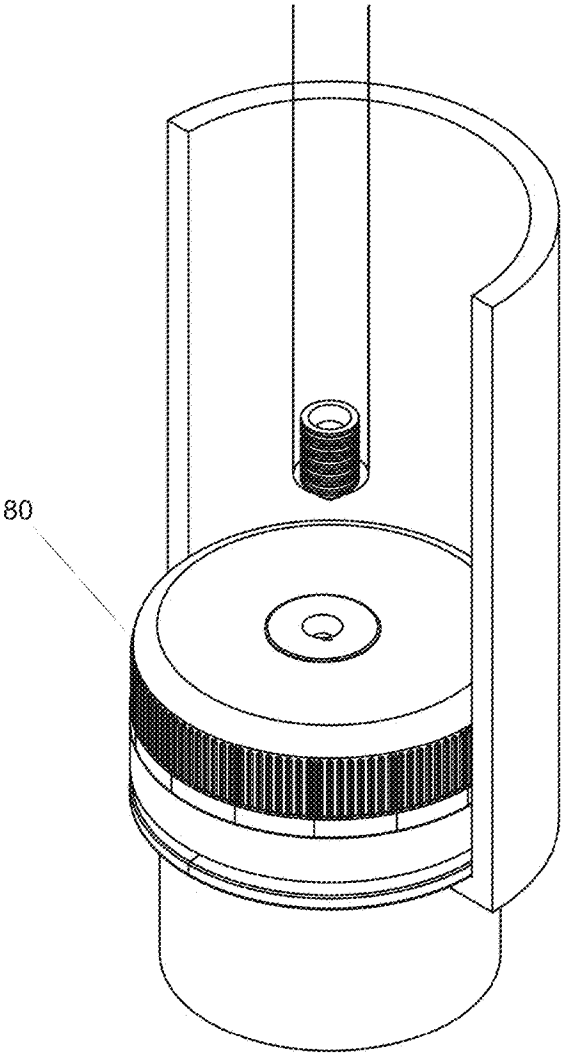
FIGS. 14A-C show withdrawal of the piercing and delivery device of FIGS. 13A-C following sterilization and subsequent pressure equalisation of the headspace.
Figure 14B:
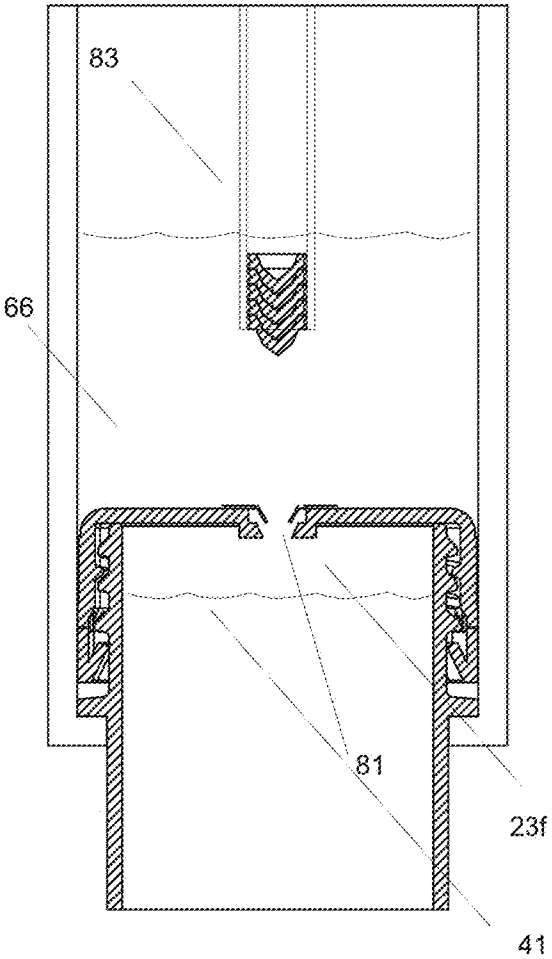
Figure 14A:
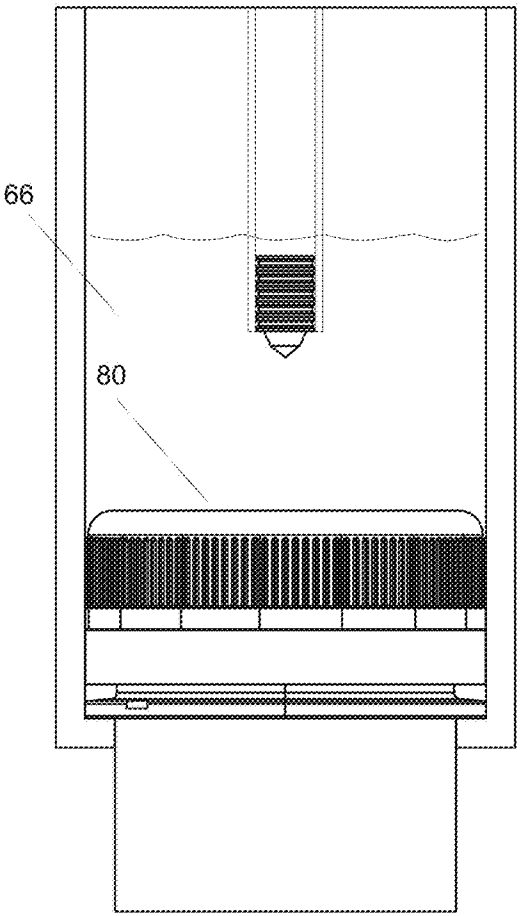

Now referring to FIGS. 13A-C, while the sterilizing medium is maintained within the sealing chamber 84, a plug mechanism 82 is placed downwardly from a delivery device 83 towards the aperture 81. The plug mechanism pierces the communicating seal 91 and is withdrawn again temporarily as shown in FIGS. 14A-C, providing for communication between the sterilized volume within the sealing chamber above the cap 80 and the headspace 23*e* below the cap. The container pressure rises and so the fluid level 40 will drop unless replenished with liquid from the sealing chamber.

As can be seen in FIGS. 14A-C, the sterilizing medium, for example heated water at 95 degrees C., is immediately drawn into the container through the open hole 81 due to the communicating seal being pierced. This causes equalization of pressure or removal of vacuum pressure within the container, such that the level of the headspace 23*f* rises higher. In another preferred embodiment the liquid would in fact be injected into the container under a small pressure supplied from the sealing chamber 84 such that the pressure within the container would in fact be a positive pressure and the headspace would in fact be very small.

The integrity of the product volume within the container is not compromised as the environment above the cap has been sterilized prior to communicating with the headspace, and the additional liquid supplied into the container replaces the volume lost due to shrinkage of heated liquid within the container prior to the method of headspace replacement described.

Figure 15C:
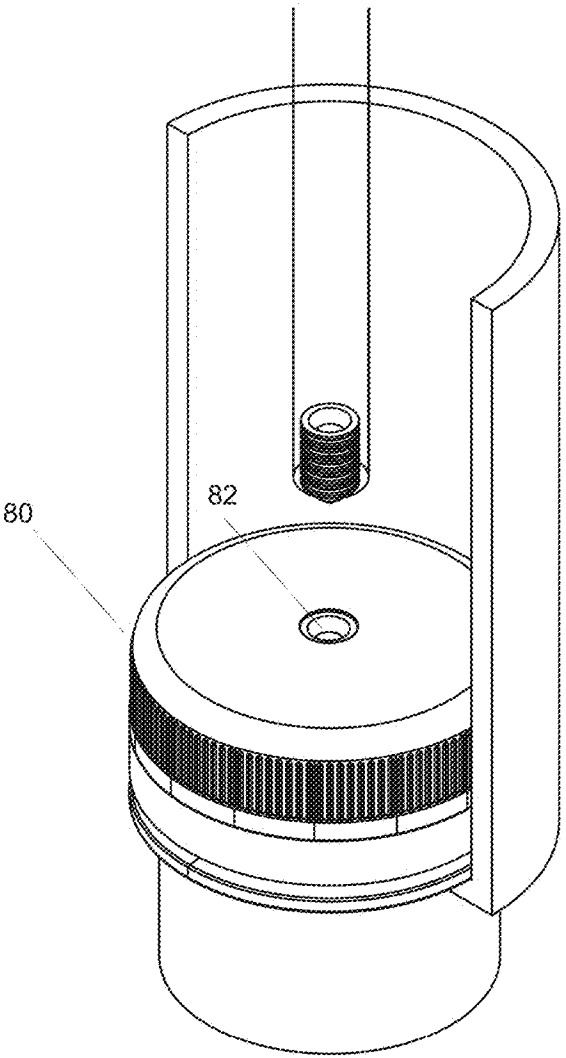
FIGS. 15A-C show the resealing of the container cap of FIGS. 14A-C prior to container release from the sterilization chamber (container not shown fully)
Figure 15B:
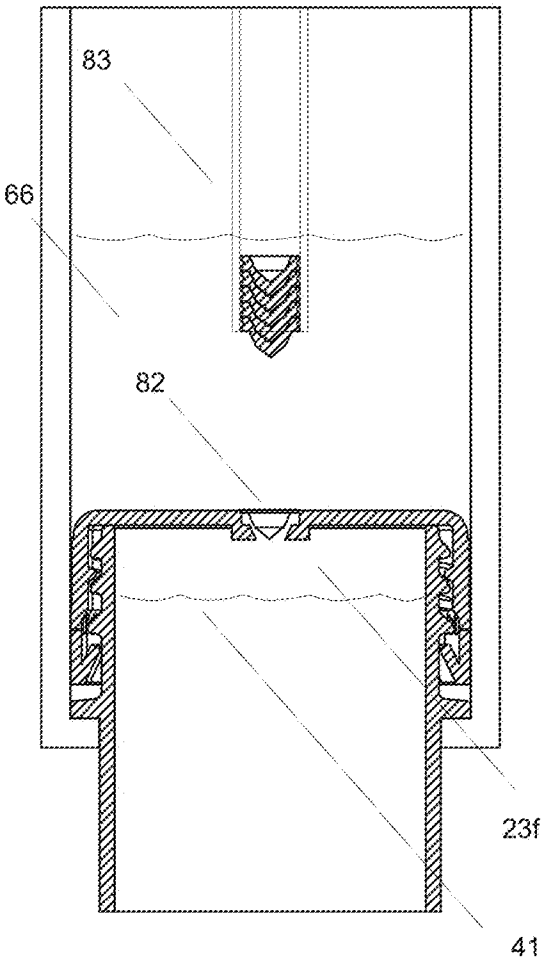
Figure 15A:
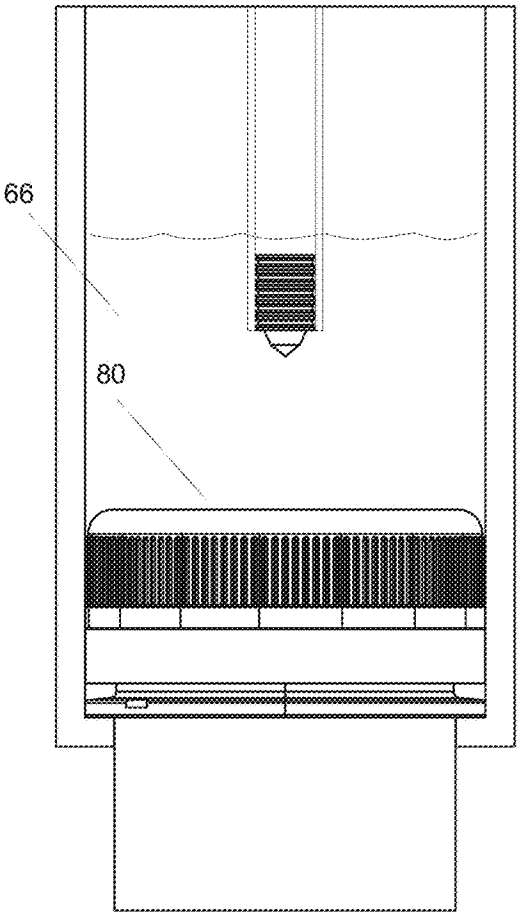

Following the pressure equalization, and now referring to FIGS. 15A-C, the delivery device 83 is advanced again such that the plug 82 will be injected into the hole to close it off permanently. At this point, the headspace 23*f* is under a controlled pressure dependent on the volume of liquid having been delivered to compensate for previous liquid contraction, as described above.

The sealing chamber may now provide for withdrawal of the delivery device 83 which may now be done following a release of sterilizing medium and/or pressure within the chamber as the container is ejected and returned to the filling line.

It will be appreciated that many variations of sealing chamber may be utilised, for example the sealing chamber may only seal directly to the top surface of the cap, rather than enclosing the entire cap.

It will also be appreciated by those skilled in the art that many forms of seal may be employed to provide the temporary seal and also the plug mechanism to be utilised.

Figure 16C:
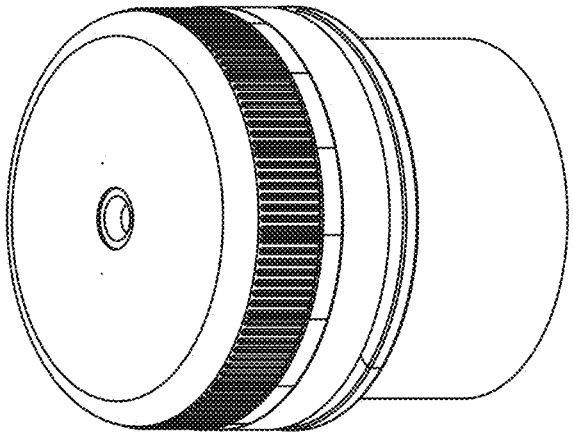
FIGS. 16A-C show additional views of a cap such as those illustrated in FIGS. 12A-C, 13A-C, 14A-C, and 15A-C according to one possible method of headspace modification.
Figure 16B:
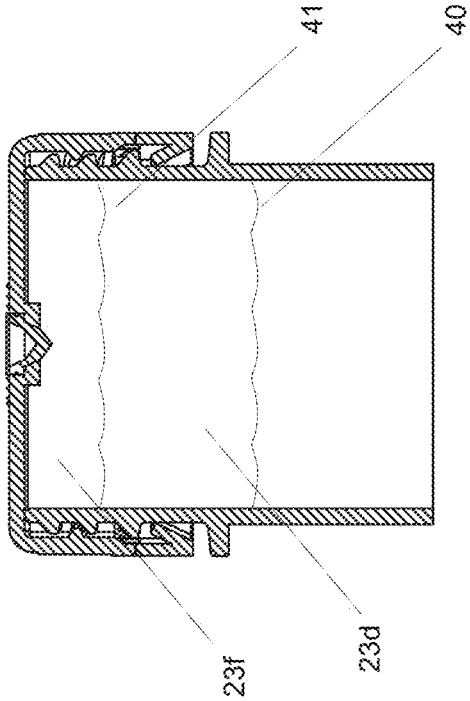
Figure 16A:
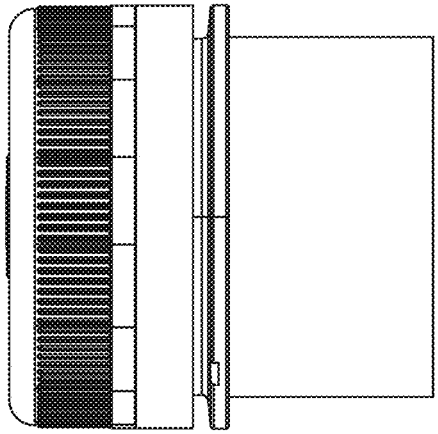

Thus a method of compensating vacuum pressure within a container is described. Referring to FIGS. 16A-C, the original headspace level 40, experienced following cooling of heated contents within a closed container, provides for a vacuum to be present within the first headspace 23*d*. Following compensation, according this embodiment of the present invention, the headspace level changes and perhaps rises to level 41 depending on the pressure contained within the headspace, and the pressure within the headspace 23*f* is now preferably virtually at ambient pressure, or preferably slightly positive, such that the sidewalls of the container are supported by the slight internal pressure.

Figure 17A:
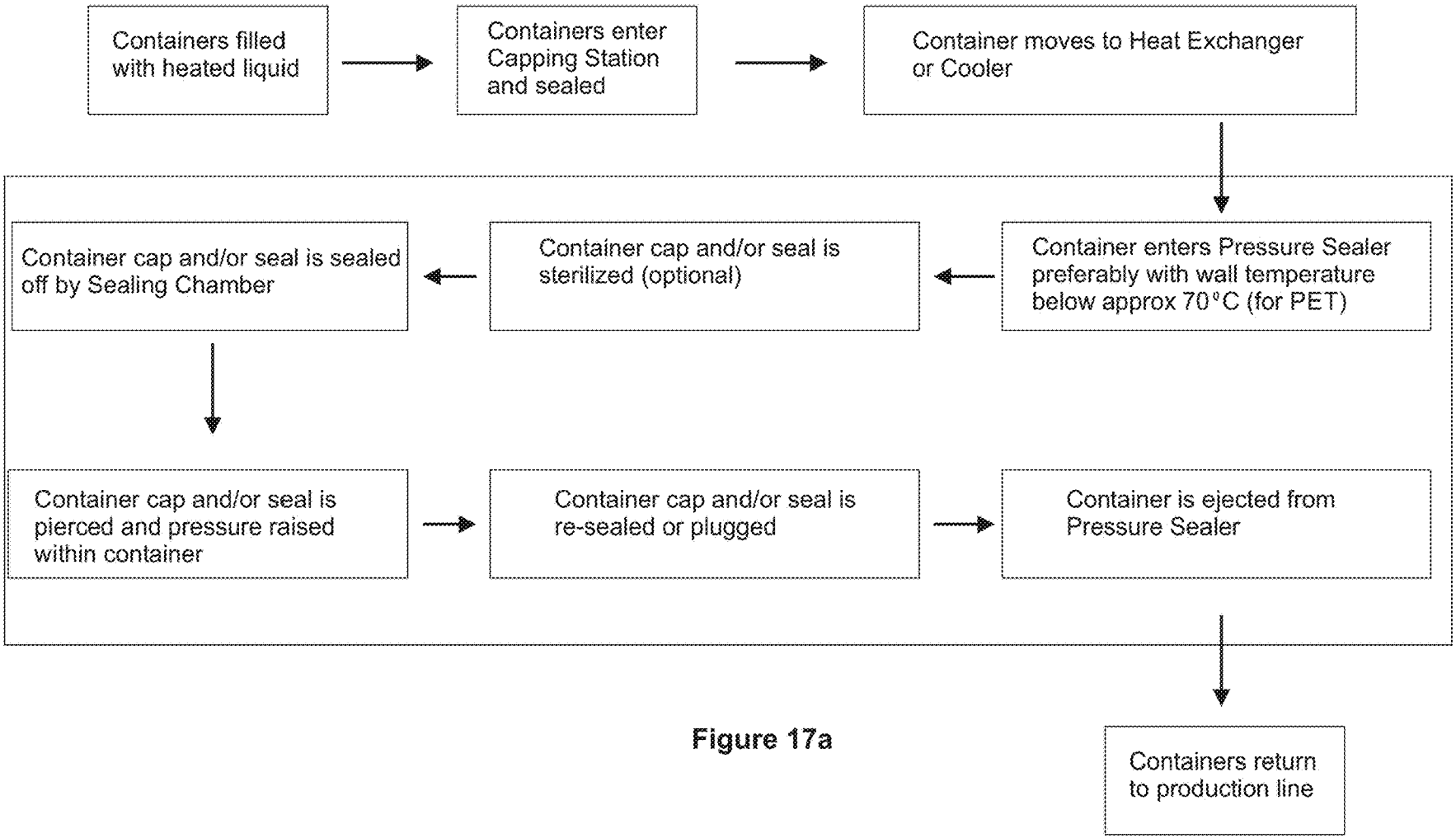
FIG. 17A-D show additional methods according to further possible embodiments of this invention.

This particular embodiment of the present invention is summarised in FIG. 17A.

Figure 17B:
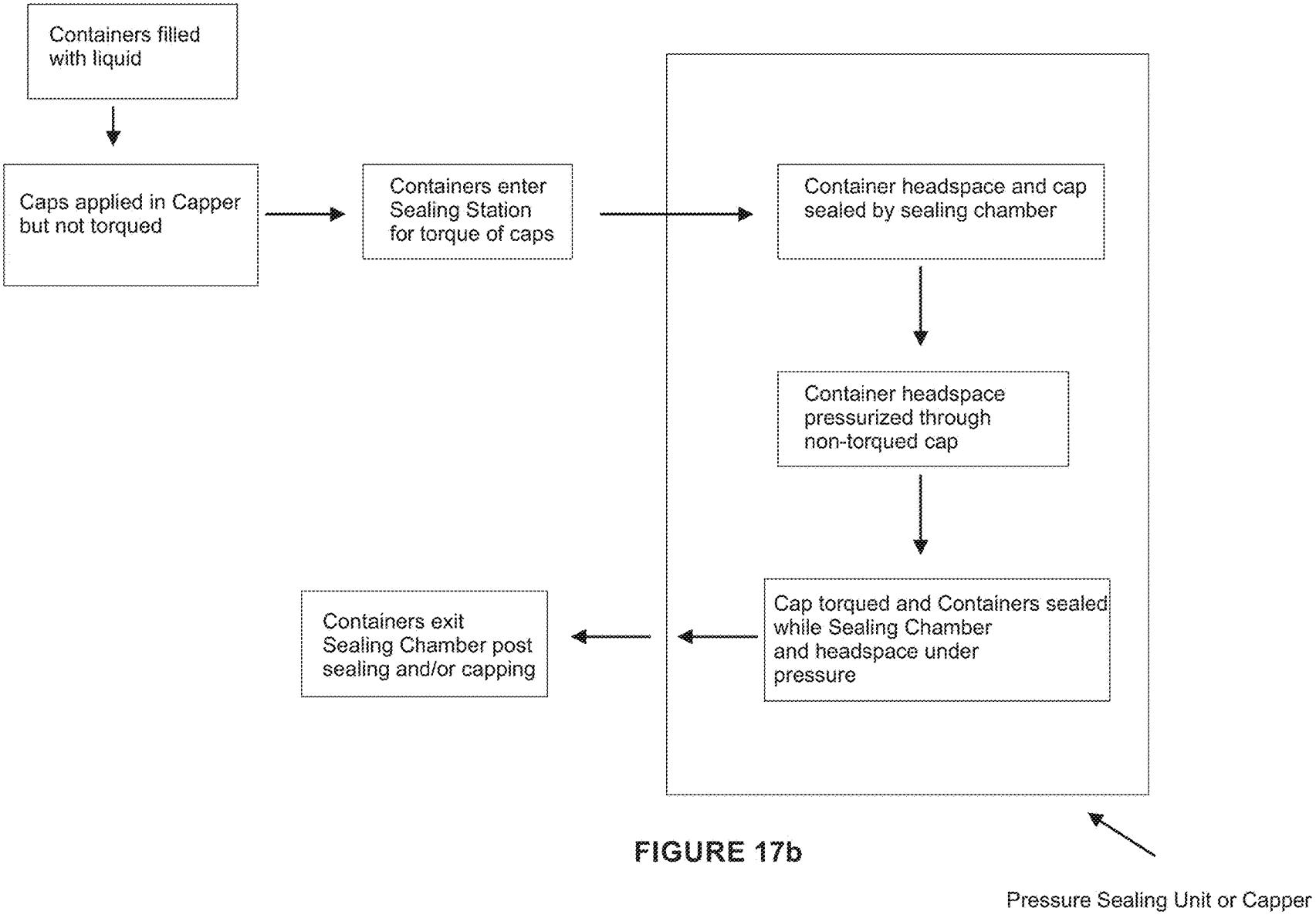

As a further alternative to the present invention, and with reference to FIG. 17B a method of pressurizing containers is illustrated whereby the Pressure Sealing Unit receives the filled containers after the containers have already been through a capping unit and received a cap. However, in this method the capping unit has not torqued down the cap, such that the headspace within the container is not sealed and is still in communication with the ambient environment through the gap that exists between the cap and the neck finish threads. The Pressure Sealing Unit subsequently seals the headspace from everything but the internal chamber of the sealing chamber, pressurizes the headspace within the sealing chamber and therefore the headspace within the container, and subsequently applies torque to the caps on the container in order to seal off the headspace with a raised pressure existing in the sealed container, which is then ejected from the pressure sealing unit.

Figure 17C:
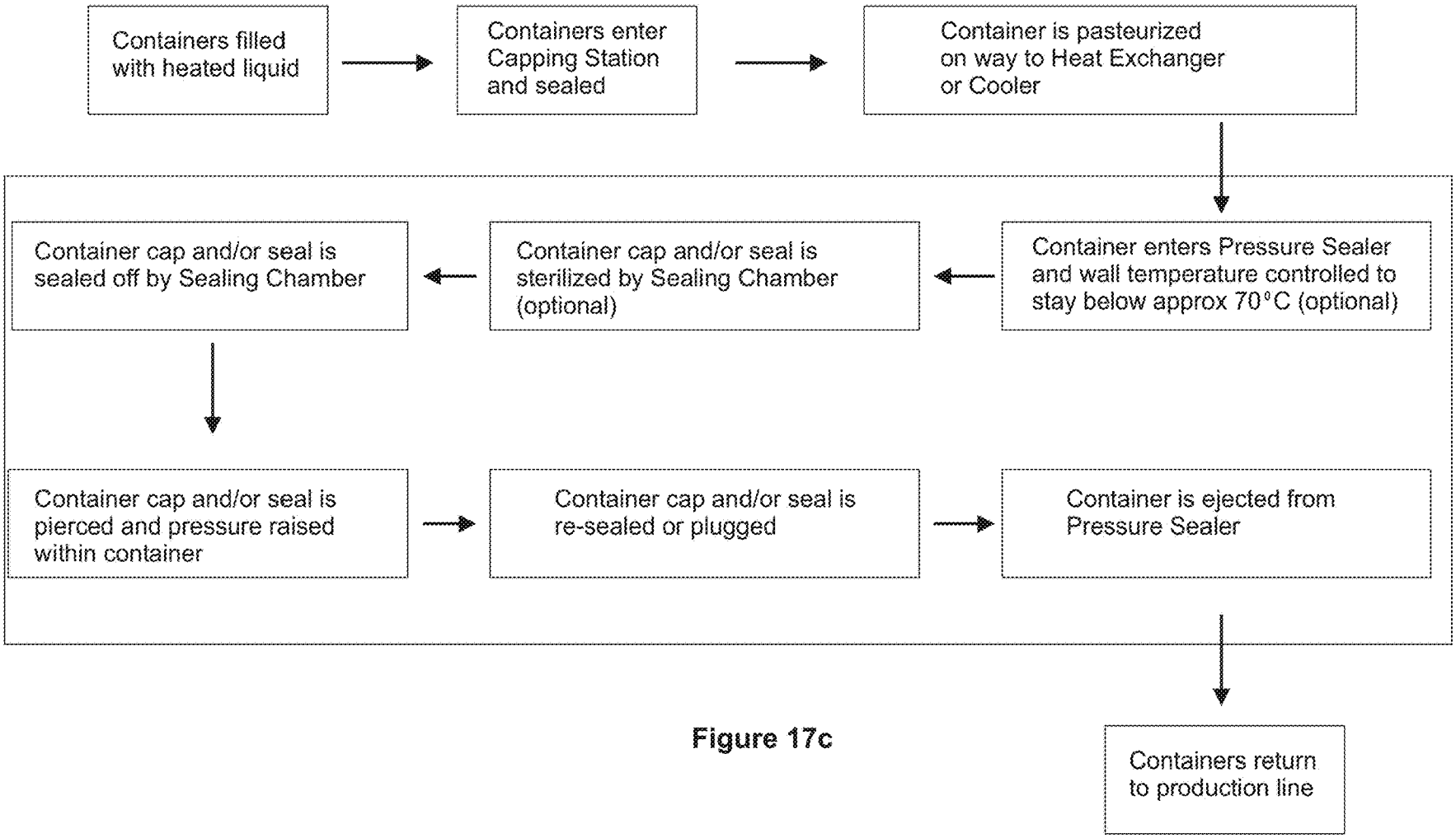

As a further alternative to the present invention, and with reference to FIG. 17C a method of pressurizing containers is illustrated whereby the Pressure Sealing Unit receives the filled containers after the containers have already been filled with a heated liquid, capped and left to pasteurize for an appropriate length of time, typically while being conveyed a distance from the capping unit to the cooling tunnel of a processing line. Once substantially pasteurized the containers enter the Pressure Sealing Unit where the cap or seal may be separately pasteurized or sterilized on its outside surfaces. The cap may be perforated either prior to entry to the Sealing Chamber or within the Sealing Chamber itself. The Pressure Sealing Unit subsequently seals the headspace from everything but the internal chamber of the sealing chamber, pressurizes the headspace within the sealing chamber and therefore the headspace within the container, and subsequently applies a seal or cap, plug or the like to the container in order to seal off the headspace with a raised pressure existing in the sealed container, which is then ejected from the pressure sealing unit. The containers are then returned to the production or processing line. The containers may be conditioned or temperature controlled throughout the Pressure Sealing Unit and placed into the Cooling Tunnel after exit from the Pressure Sealing Unit for cooling.

Figure 17D:
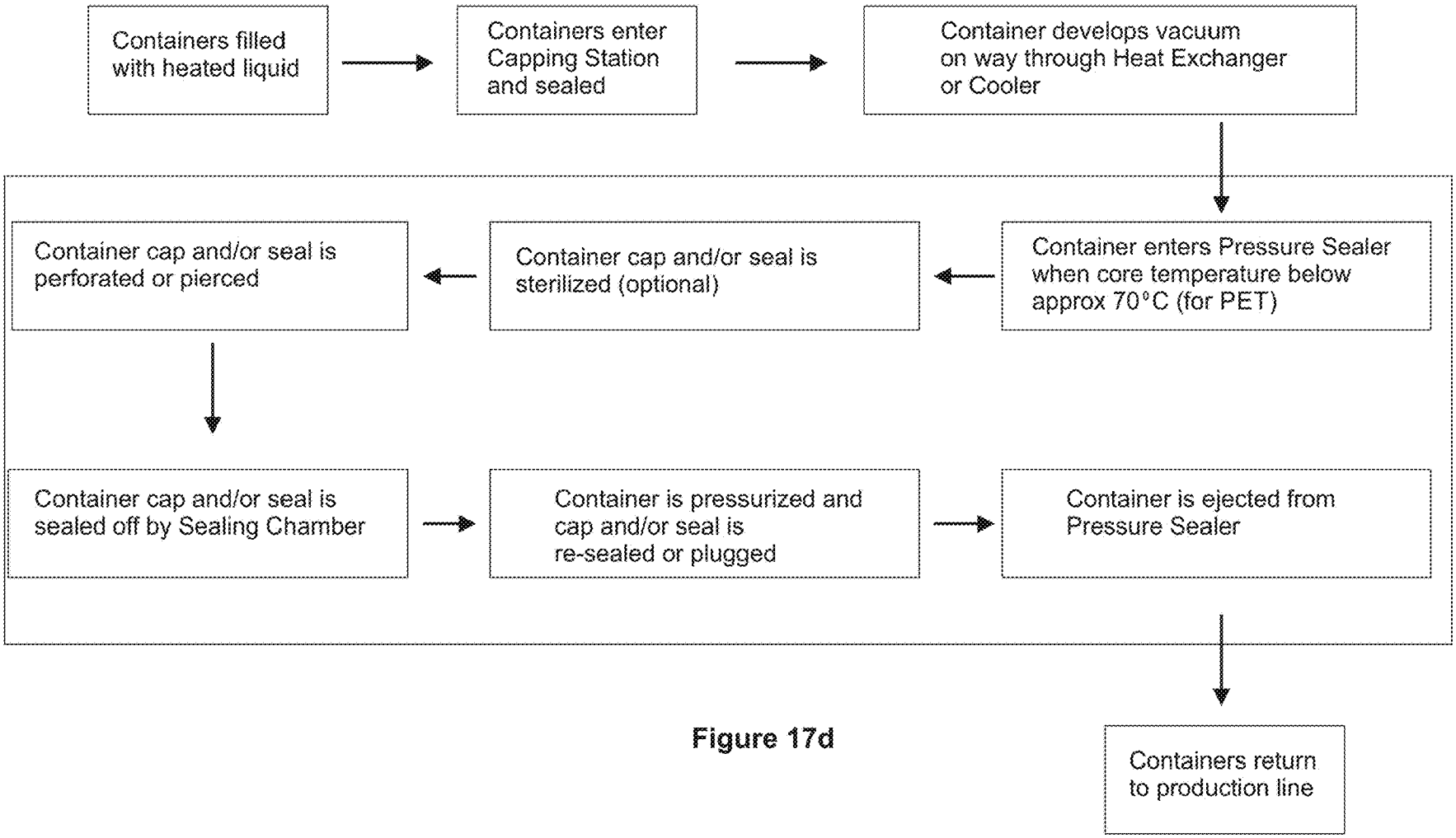

As a further alternative to the present invention, and with reference to FIG. 17D a method of pressurizing containers is illustrated whereby the Pressure Sealing Unit receives the filled containers after the containers have already been filled with a heated liquid, capped and left to pasteurize for an appropriate length of time, typically while being conveyed a distance from the capping unit to the cooling tunnel of a processing line. Once substantially pasteurized the containers enter the Cooling Tunnel and finish pasteurization, wherein the sidewalls cool down to between approximately 20 C and 40 C, and a vacuum develops within the container. The containers enter the Pressure Sealing Unit after exiting the Cooling tunnel where the cap or seal may be separately pasteurized or sterilized on its outside surfaces. The cap may be perforated either prior to entry to the Sealing Chamber or within the Sealing Chamber itself. The Pressure Sealing Unit may subsequently seal the headspace from everything but the internal chamber of the sealing chamber, and increase the pressure of the headspace within the sealing chamber and therefore the headspace within the container. A seal or cap, plug or the like is subsequently applied to the container in order to seal off the headspace with a raised pressure, and the container is then ejected from the pressure sealing unit. The containers are then returned to the production or processing line for labeling. The pressure in the containers may be increased only to remove the vacuum from the container or significantly increased, depending on the amount of pressurization applied. Even a return to generally ambient conditions represents a reasonably significant increase from vacuum conditions that may be in the order of greater than 1 psi negative vacuum.

Figure 18:
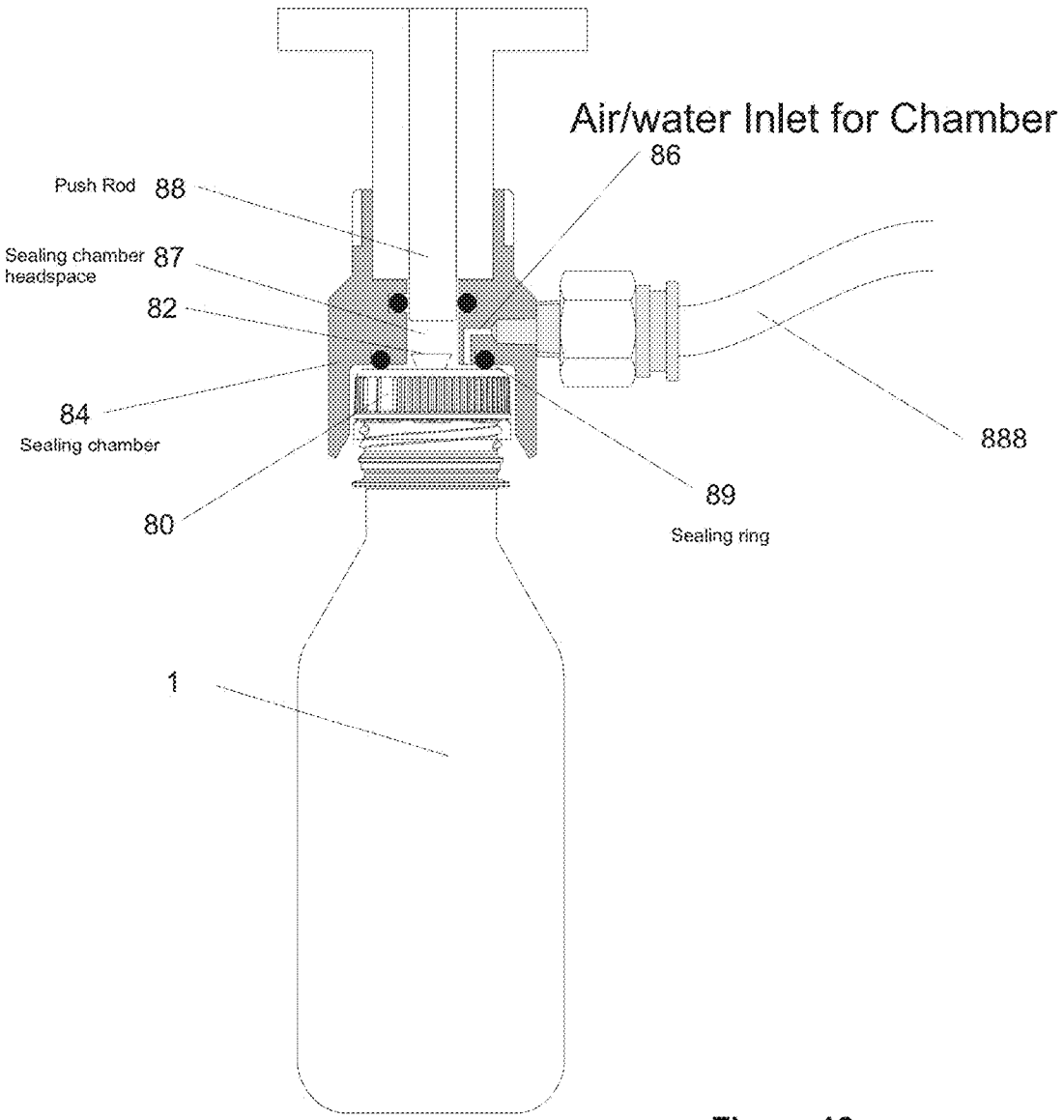
FIG. 18: shows a further possible part embodiment of the invention using a sealing chamber.

A further embodiment is provided in FIG. 18. In this part embodiment of the invention the cap 80 has a plug 82 temporarily attached by a member (not shown). A sealing chamber 84 encloses the cap and provides an internal sealed chamber headspace 87 through the compression of sealing rings 89 against the upper surface of the cap. Gas or liquid, or a combination of both, is injected into the chamber headspace 87 from a pressure source 888 through an inlet 86 and through the spaces around the plug into the headspace of the container. Once the required pressure within the container is obtained, the push rod 88 is advanced downwardly to force the plug 82 into position within the cap and therefore seal the container headspace under the required pressure. This provides for a calculated internal pressure to be achieved precisely at the time of sealing the container, when the plug is advanced into final position. This provides for forward compensation of the effects of subsequent vacuum generated by a cooling of any heated contents within the container.

Figure 19A:
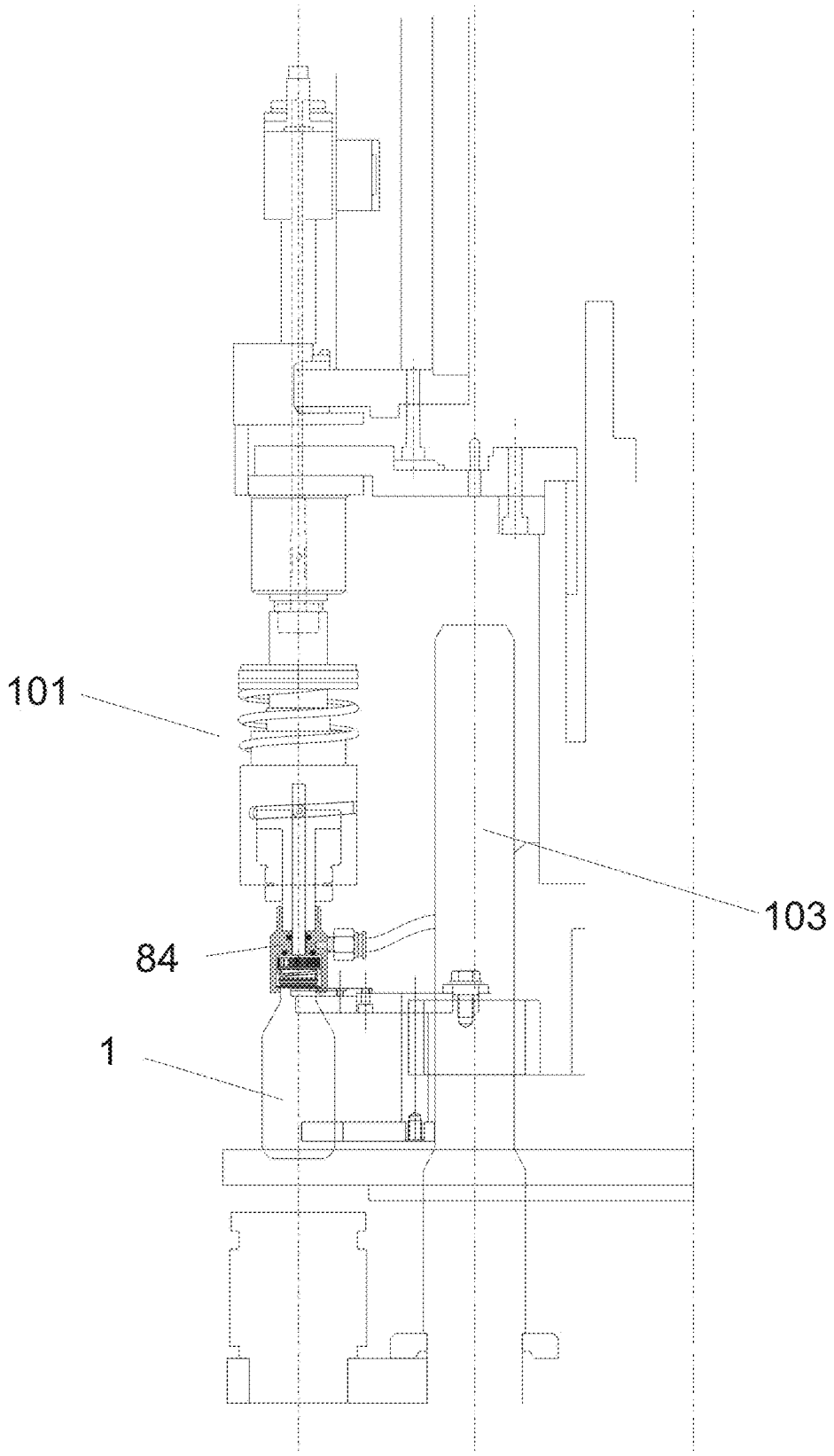
FIG. 19A-B show a possible part embodiment of the invention in the form of a sealing machine.
Figure 19B:
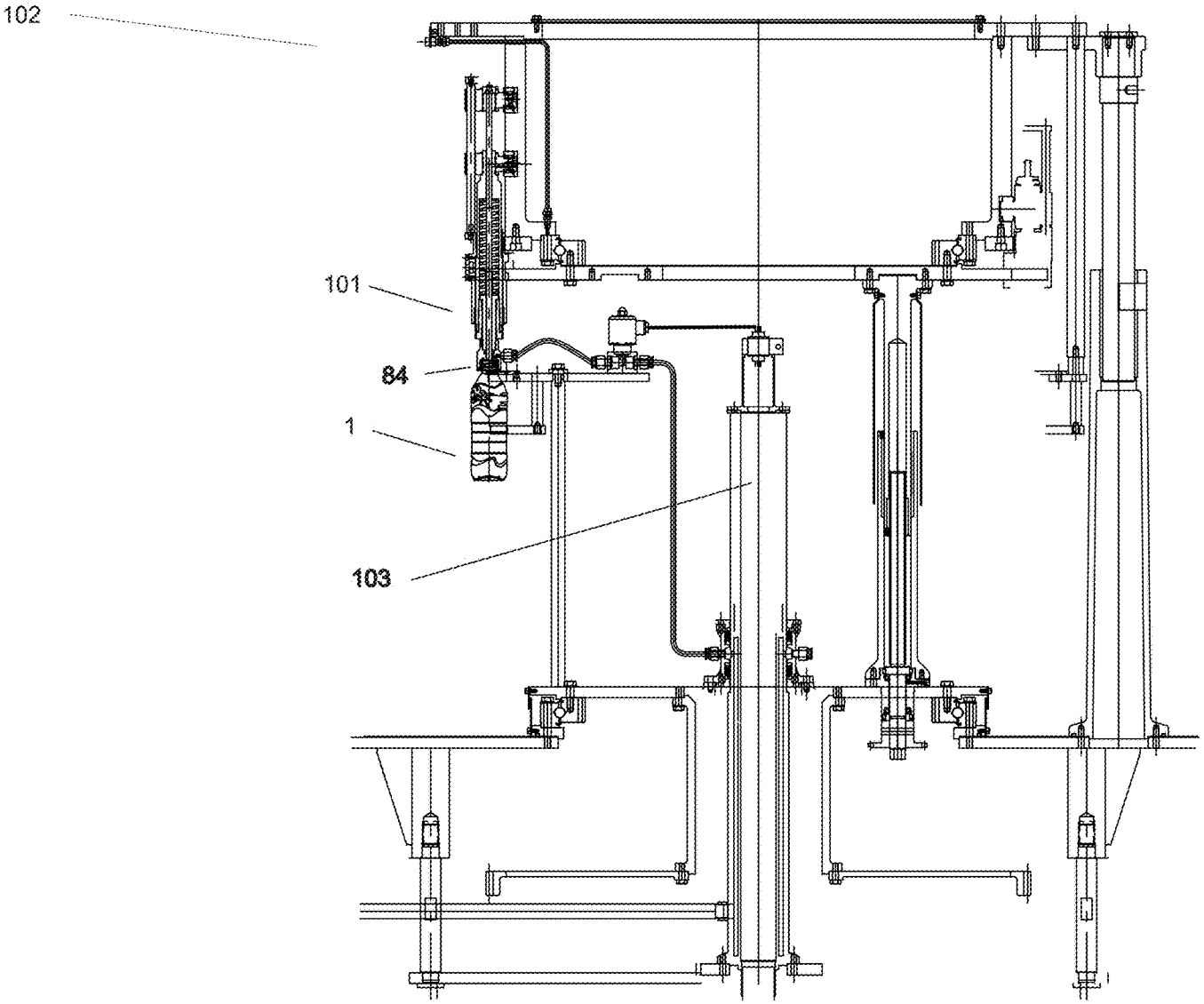
Figure 20C:
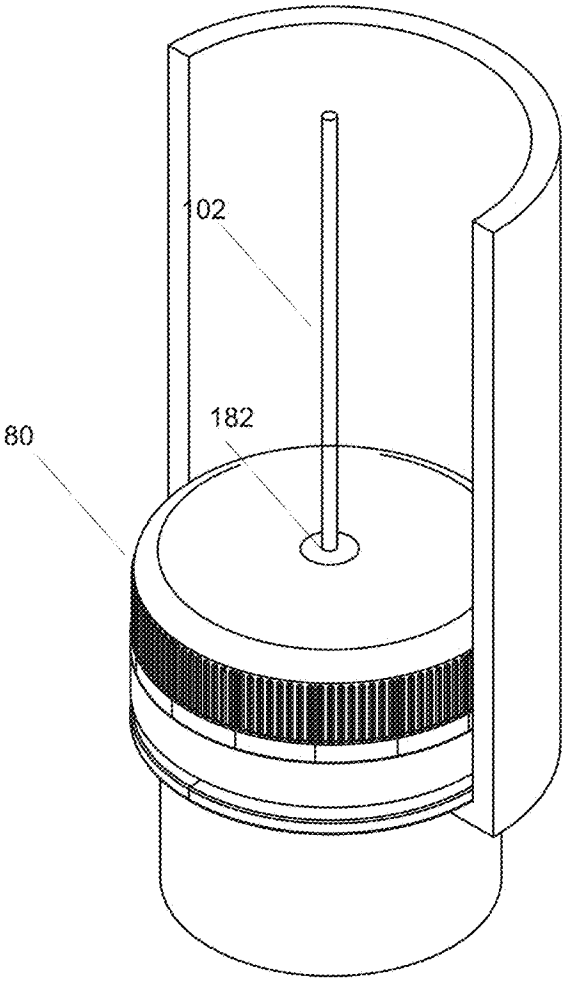
FIG. 20A-F and FIGS. 21A-F show a further possible embodiment of the invention using a pressure chamber.
Figure 20B:
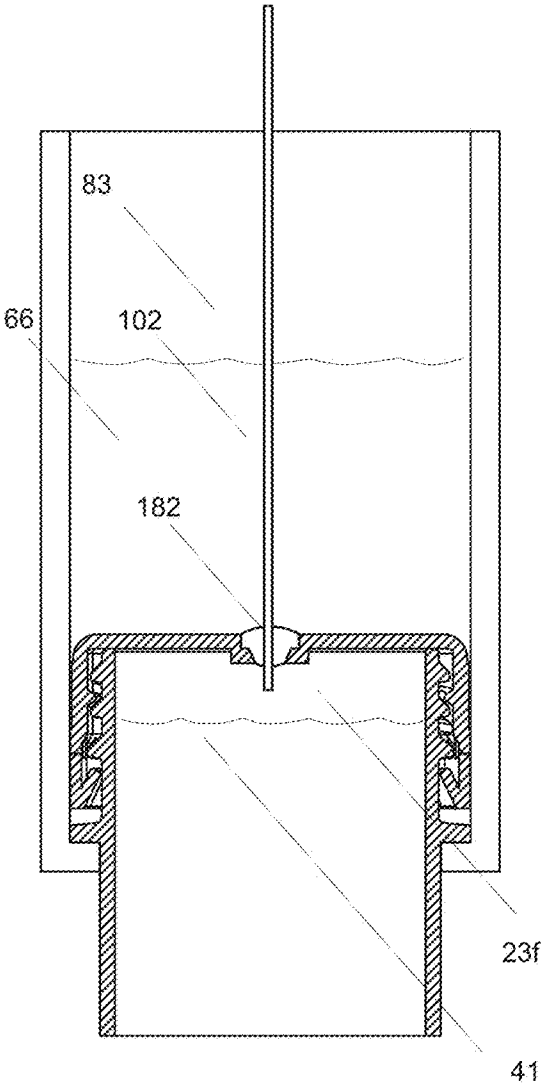
Figure 20A:
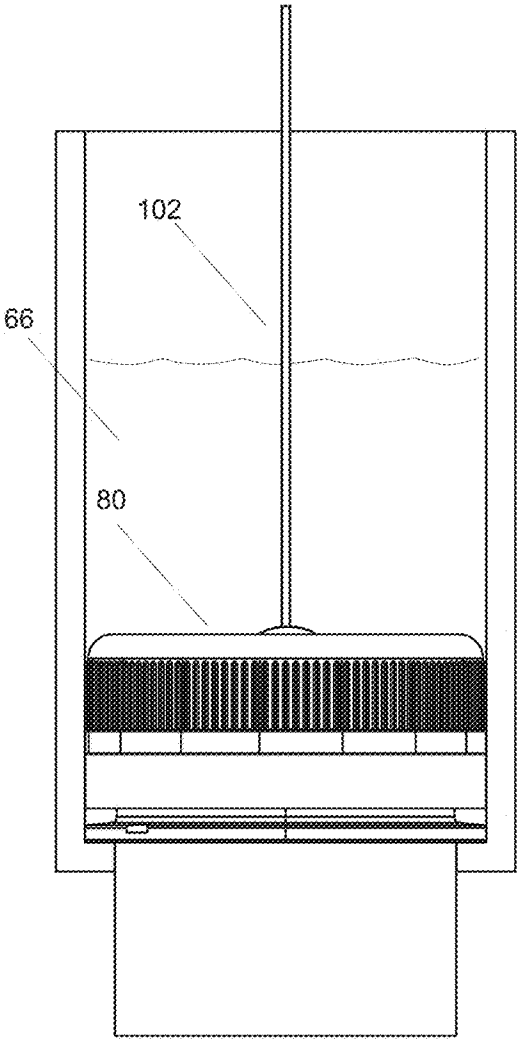
Figure 20F:
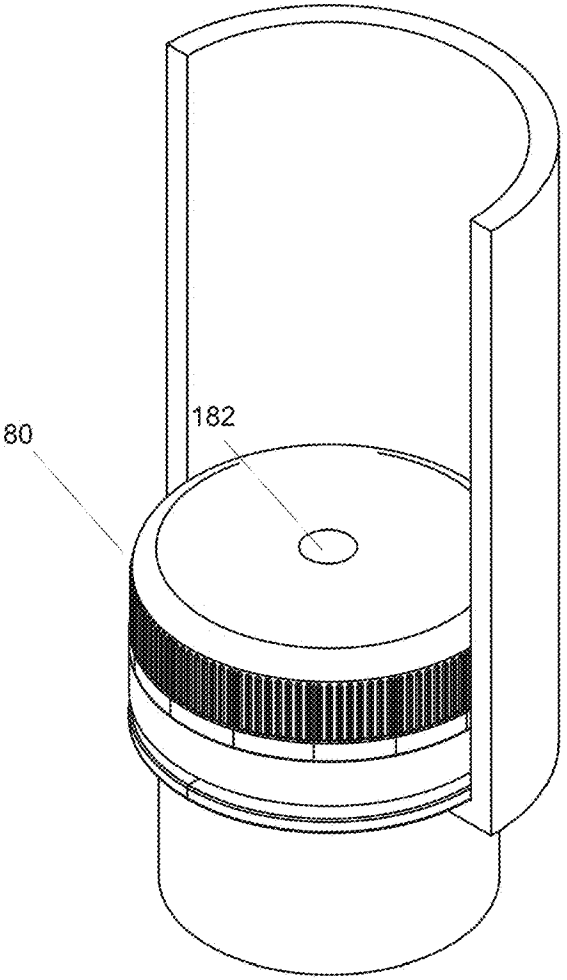
Figure 20E:
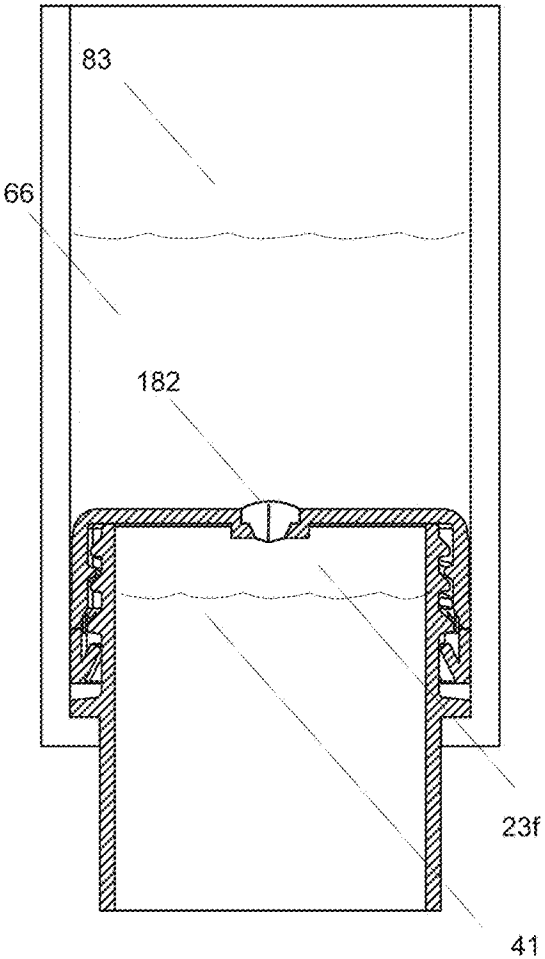
Figure 20D:
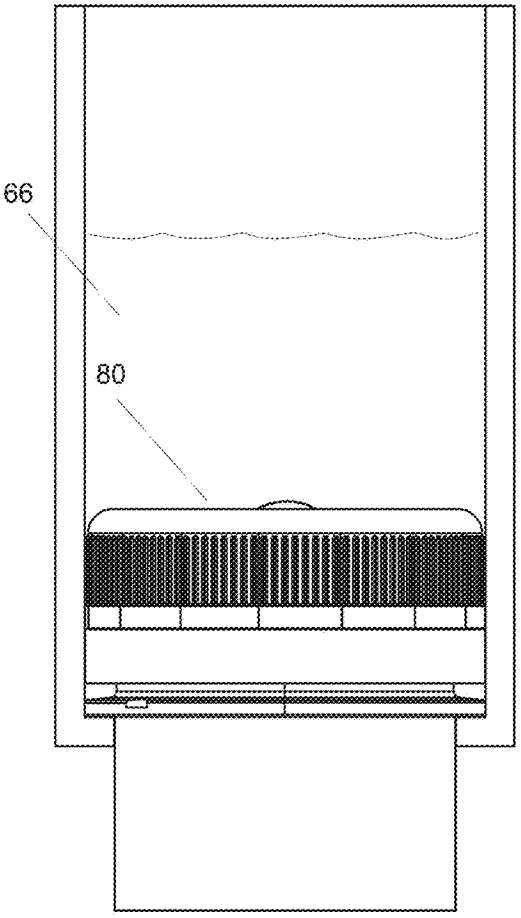

With reference to FIGS. 19A and 19B, the present invention may be manufactured to function exclusive of cap application and for final sealing of any temporary cap hole or pathway only. A typical capping machine head unit 101 encapsulates the sealing chamber 84 and provides the function of sealing and pressurising the container through applying the cap to seal the container while under increased pressure. Alternatively, a typical capping unit may have optionally already torqued the cap into position, but the container would remain unsealed due to the presence of a plug, being in an 'unplugged' position within the cap, and allowing the passage of liquid or gas between the inside and outside of the container. The precise moment of sealing the container occurs as the plug is rammed into position and the headspace within the cap is not at ambient pressure, as would be typical of prior art capping procedures within the filling and capping area, but instead, with the present invention, a headspace modification unit 102 including the capping head unit 101, the pressurizing and sealing unit 84, and the rotatable turret 103, which may optionally be of typical rotary style in mechanics, may receive capped containers 1, and subsequently pressurize the container immediately prior to sealing the container with a cap sealing plug.

As an alternative, the headspace modification unit 102, including the capping head unit 101, the pressurizing and sealing unit 84, and the rotatable turret 103, can also perform the usual function of a typical capping machine. The unit could receive empty containers, apply caps containing the plugs and subsequently torque the caps into position as well as pressurize the container prior to ultimately sealing the container through advancing the plug or some other sealing method.

Still further examples of alternative embodiments of the present invention are illustrated in FIGS. 20A-F. The cap 80 may incorporate a rubber, or other suitable material, plug 182 within the cap. This would provide the advantage of having an initially leakproof seal to the container prior to pressurising the headspace. In this way, the container could be charged with pressure from a liquid or gas either prior to the cooling of the contents, for example immediately after filling and capping by way of overpressure, or the procedure could occur after the contents have been cooled and there is a vacuum within the container. By way of example, the cap and sealing plug 182 could be sterilized by very heated water 66 after the liquid contents have cooled. This would sterilize the upper surface of the cap and a heated liquid could then be injected to compensate for vacuum pressure. Following withdrawal of the injecting needle 202 the sterilizing heated liquid could be removed as the container is ejected from the pressure chamber. The rubber seal 182 would have closed off and sealed the container to prevent any communication between the headspace under the cap and outside air present as the chamber is opened.

Figure 21C:
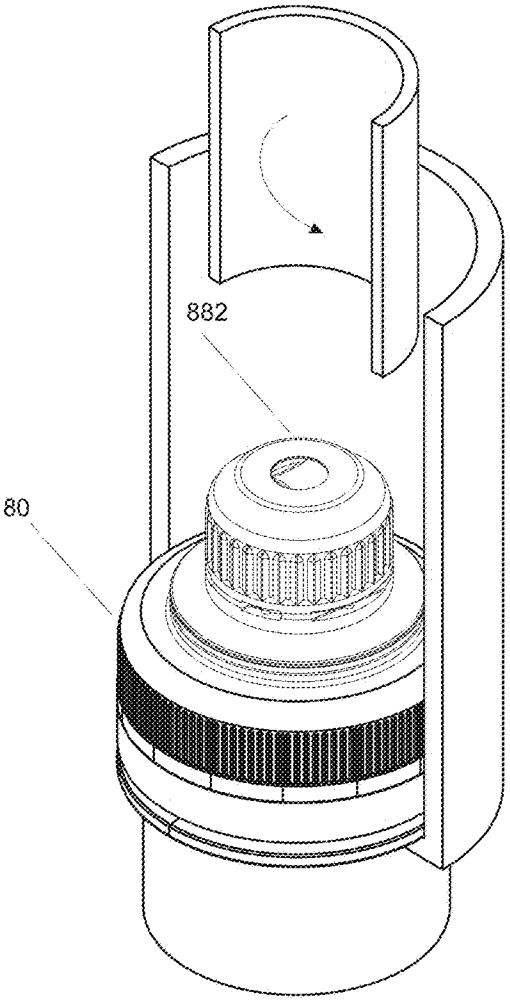
Figure 21B:
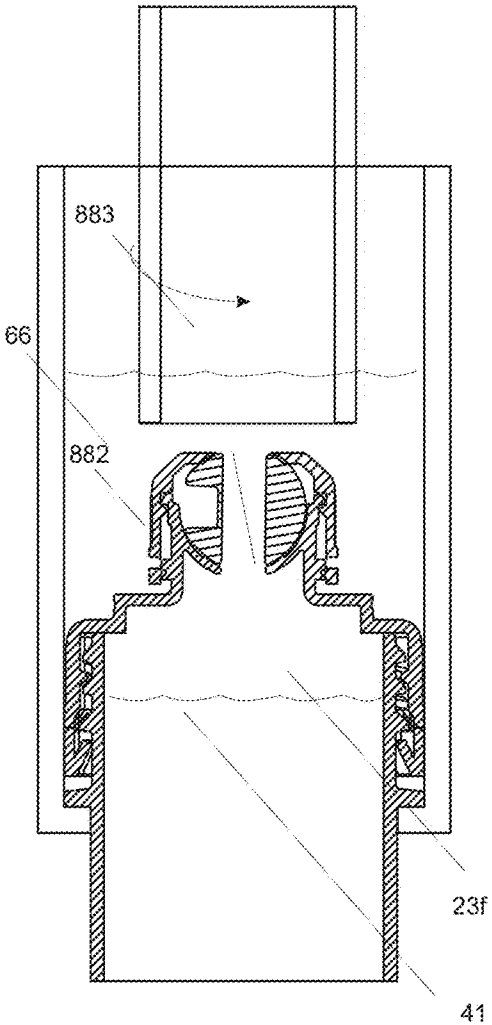
Figure 21A:
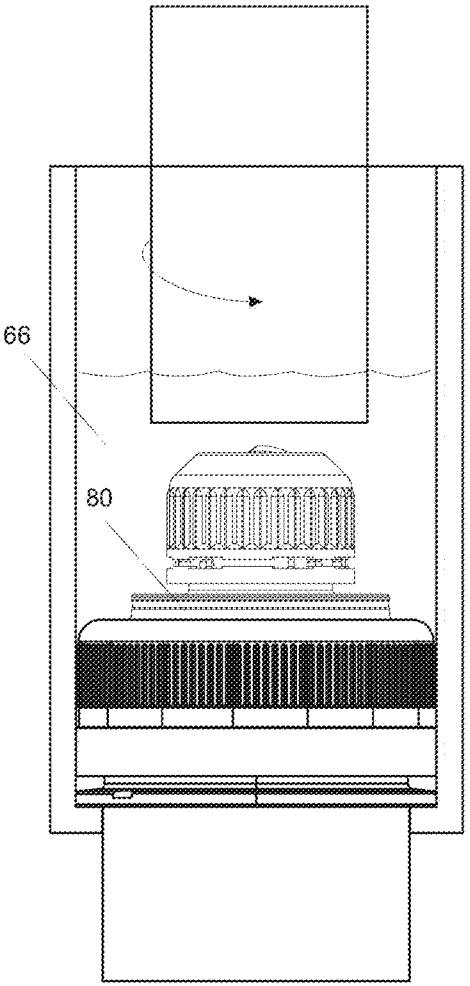
Figure 21F:
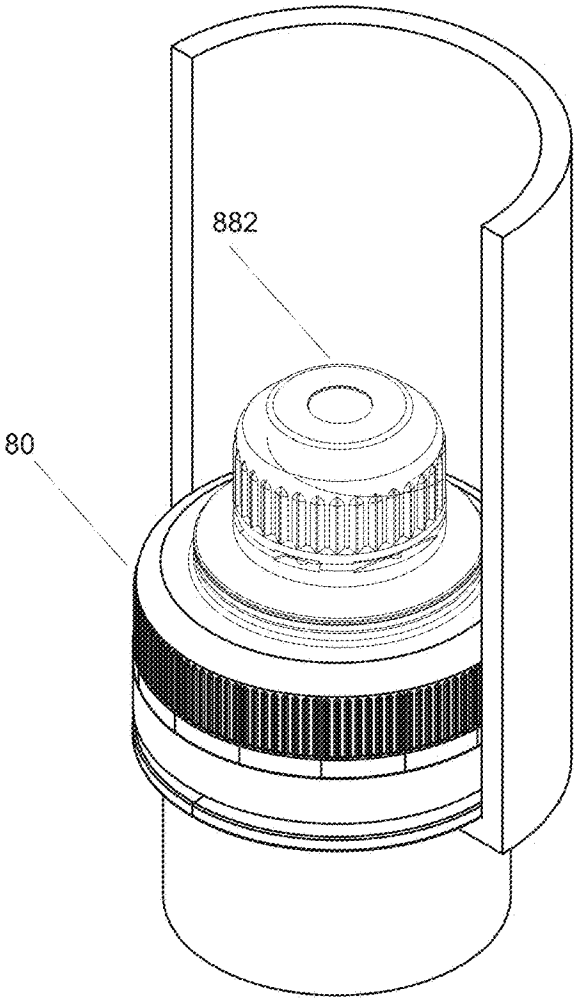
Figure 21E:
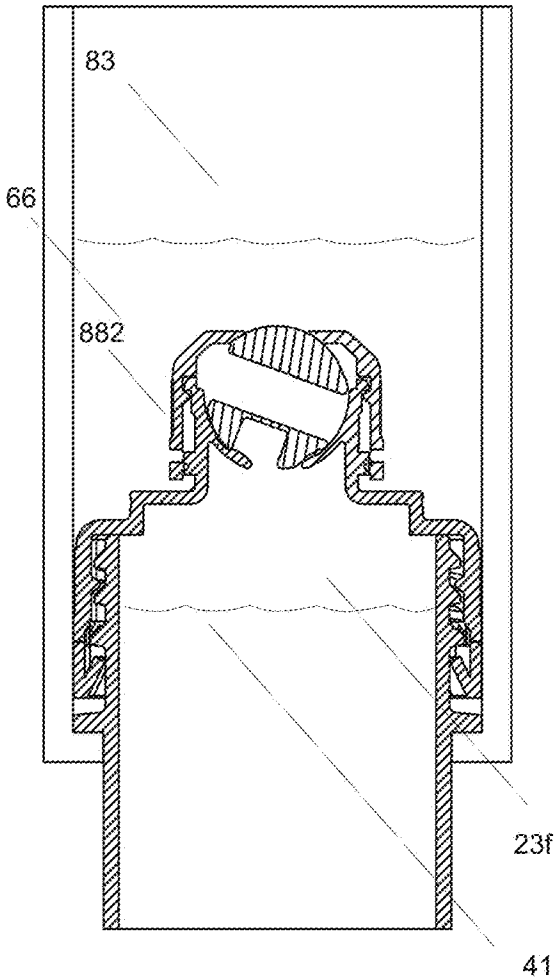
Figure 21D:
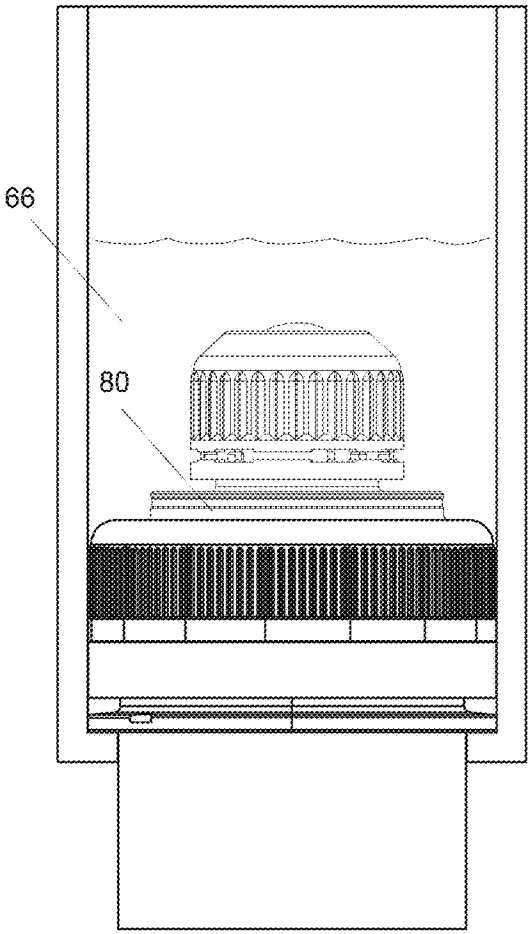

A further alternative for a suitable plug mechanism within a cap 80 is illustrated in FIGS. 21A-F. A ball-valve type closure 882 could be utilized to provide a hole through which headspace modification may occur within the pressure chamber unit as previously described. Once the headspace has been pressurized, a rotating push rod 883 can close the ball valve while the headspace is maintained under exact pressure as illustrated in FIGS. 21D-F.

Figure 22A:
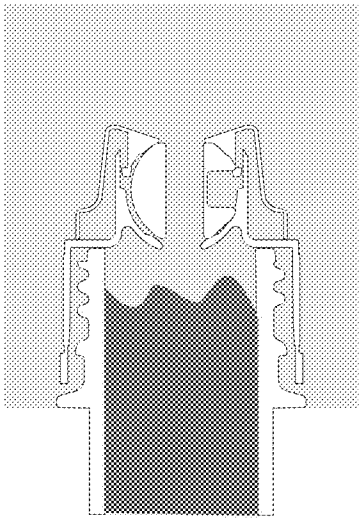
FIGS. 22A-C and FIGS. 23A-C show diagrammatically a possible method of the present invention.
Figure 22B:
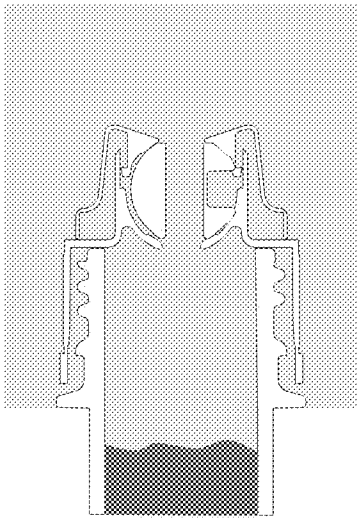
Figure 22C:
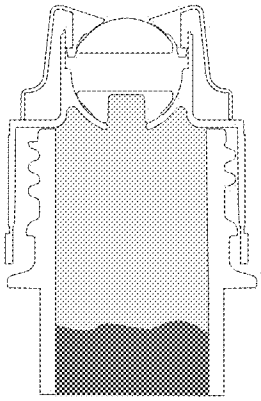

FIGS. 22A-C shows a typical example method of headspace modification using the method of the present invention. An empty container (not shown below the neck finish) is filled or even 'overfilled' to the brim of the neck finish, and a cap is applied that has an opening through which headspace modification can be achieved, for example a ball closure device. The capped neck finish, at least, is contained within a pressure chamber (not shown) and the container is placed under a calculated pressure. This increase in pressure may be by injection of a gas as in the illustrated example, or by overinjection of further liquid. During this process the container will increase in size to a degree allowing the fluid level to drop (if gas is being injected) and the ball-valve closure may then be closed to maintain the increased pressure within the container.

Figure 23A:
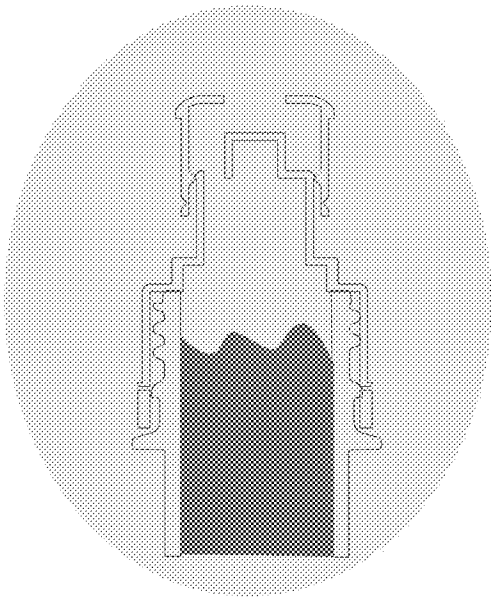
Figure 23B:
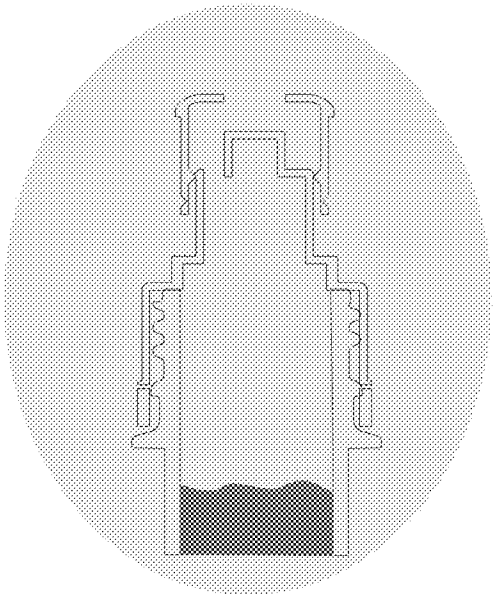
Figure 23C:
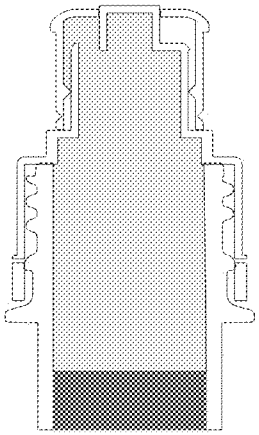

The same method procedure may occur using a more typical 'push-pull' type sport closure as illustrated in similar manner in FIGS. 23A-C.

Figure 24:
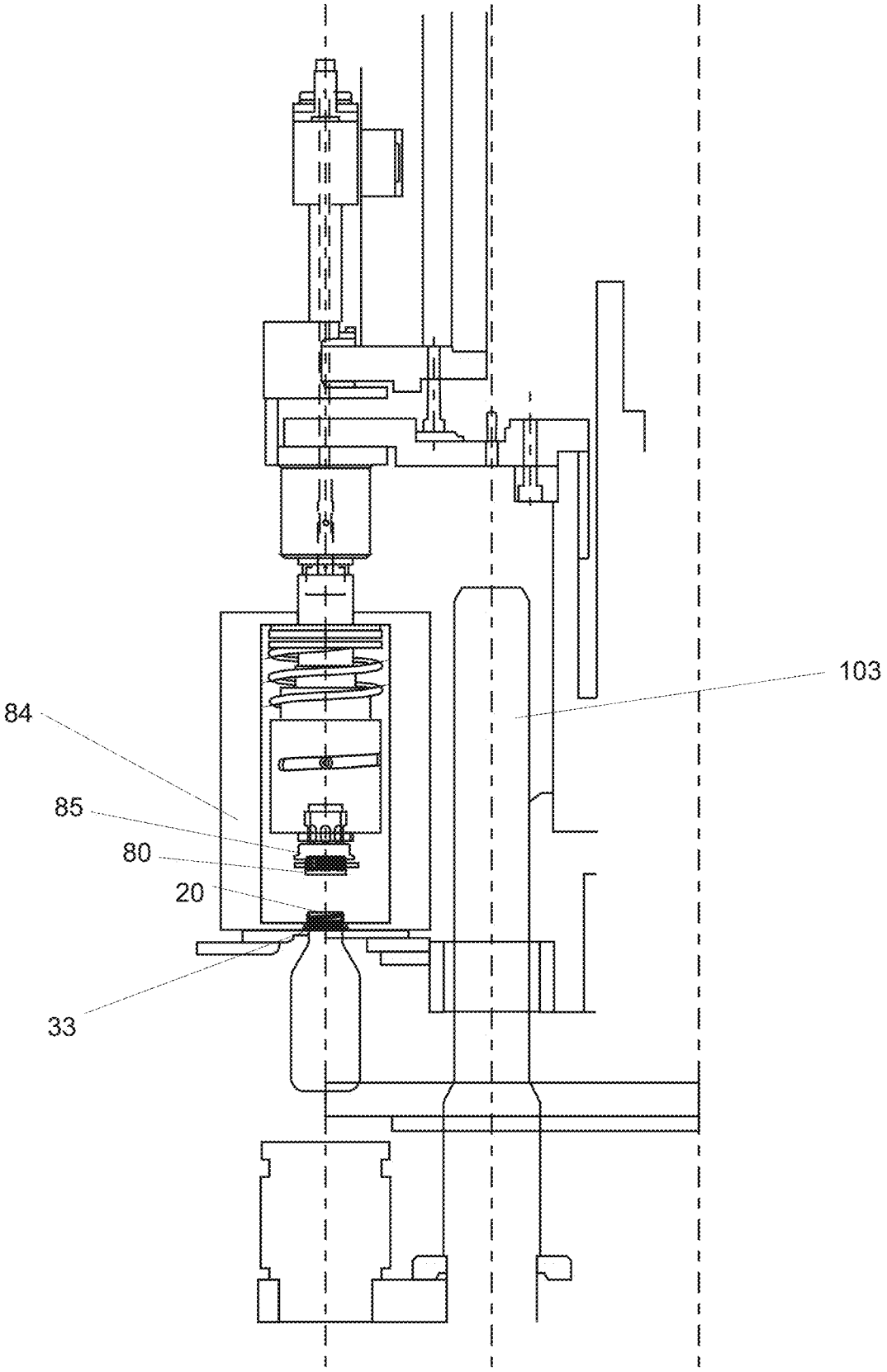
FIGS. 24 to 27: show diagrammatically a further possible embodiment of the invention in the form of a capping machine.

FIG. 24 shows how a container could be contained within a typical sealing chamber 84 from immediately below the neck support ring 33 of the container.

Figure 25:
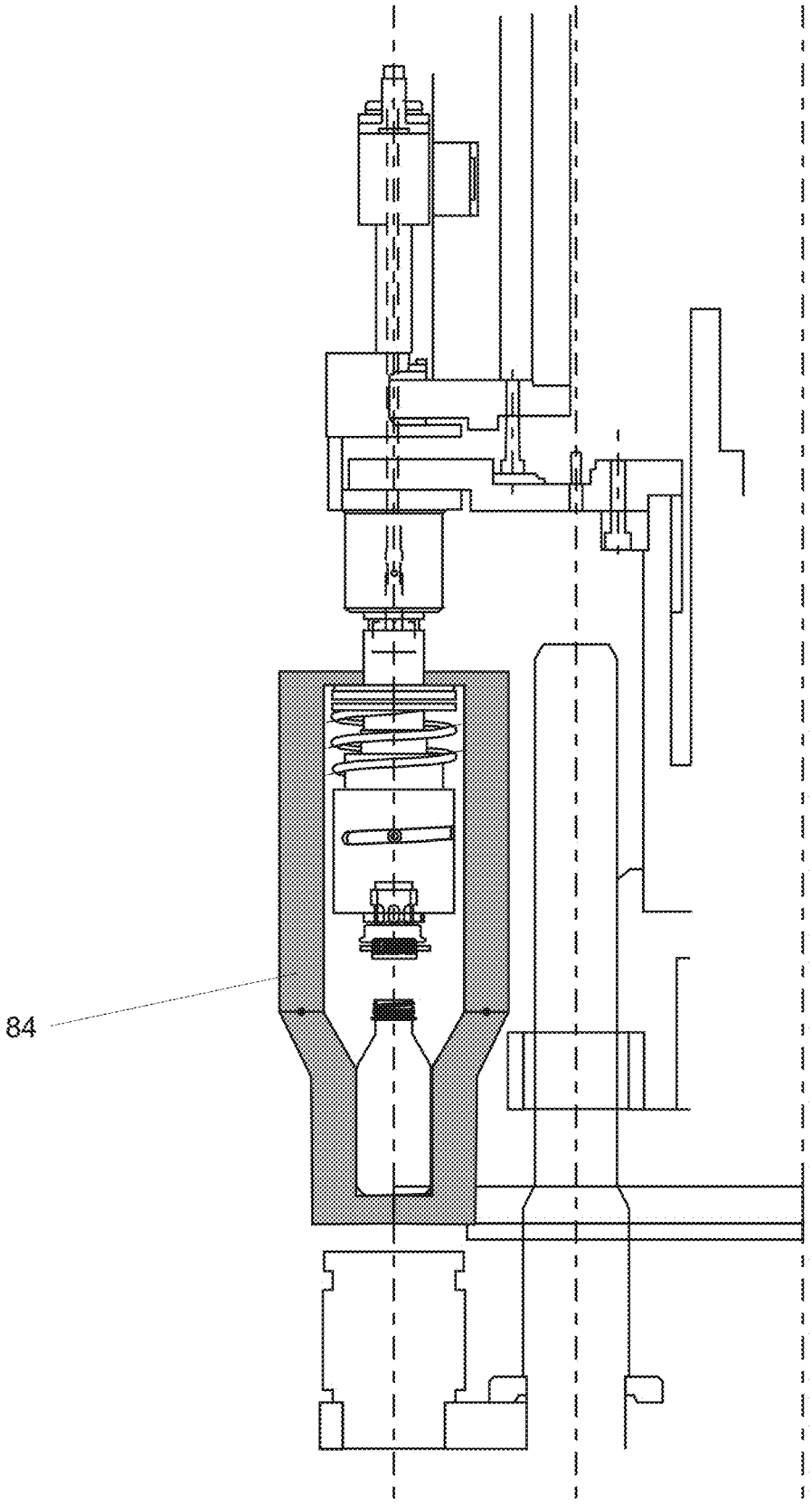

FIG. 25 illustrates how the whole container could be contained within a sealing chamber 84. In this embodiment the container will not be stressed from the increased pressure until after ejection from the sealing chamber.

Figure 26:
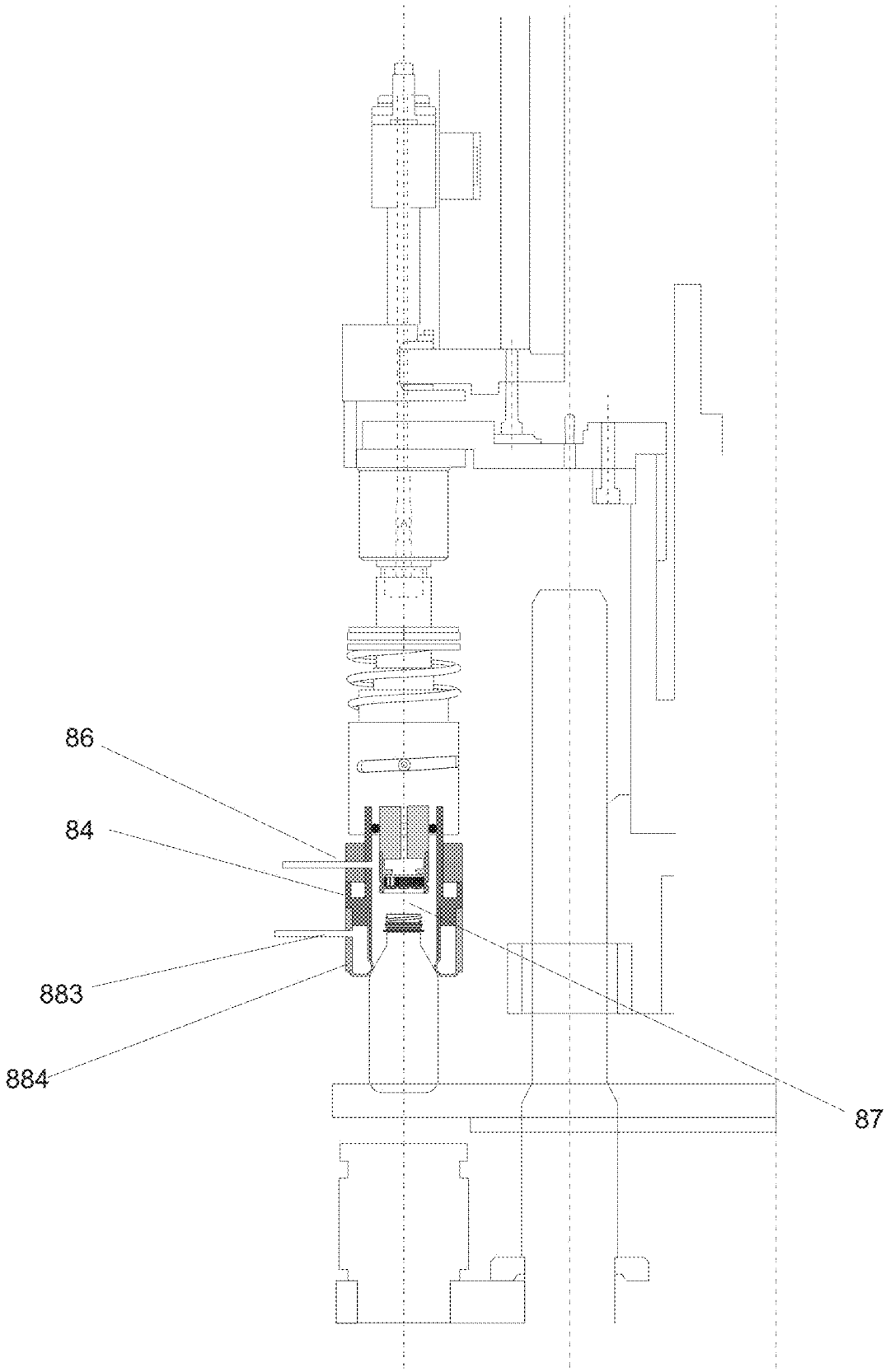

FIG. 26 shows an alternative embodiment of the present invention. It is envisaged that the sealing chamber 84 could comprise optionally a lower end sealing skirt 884. In this example, a sealing ring of soft material may be inflated under pressure of water or gas through an inlet 883 to form a close contact with the container shoulder. Gas or liquid may then be charged into the pressure chamber headspace 87 through inlet 86 to modify the container headspace prior to final sealing.

Figure 27:
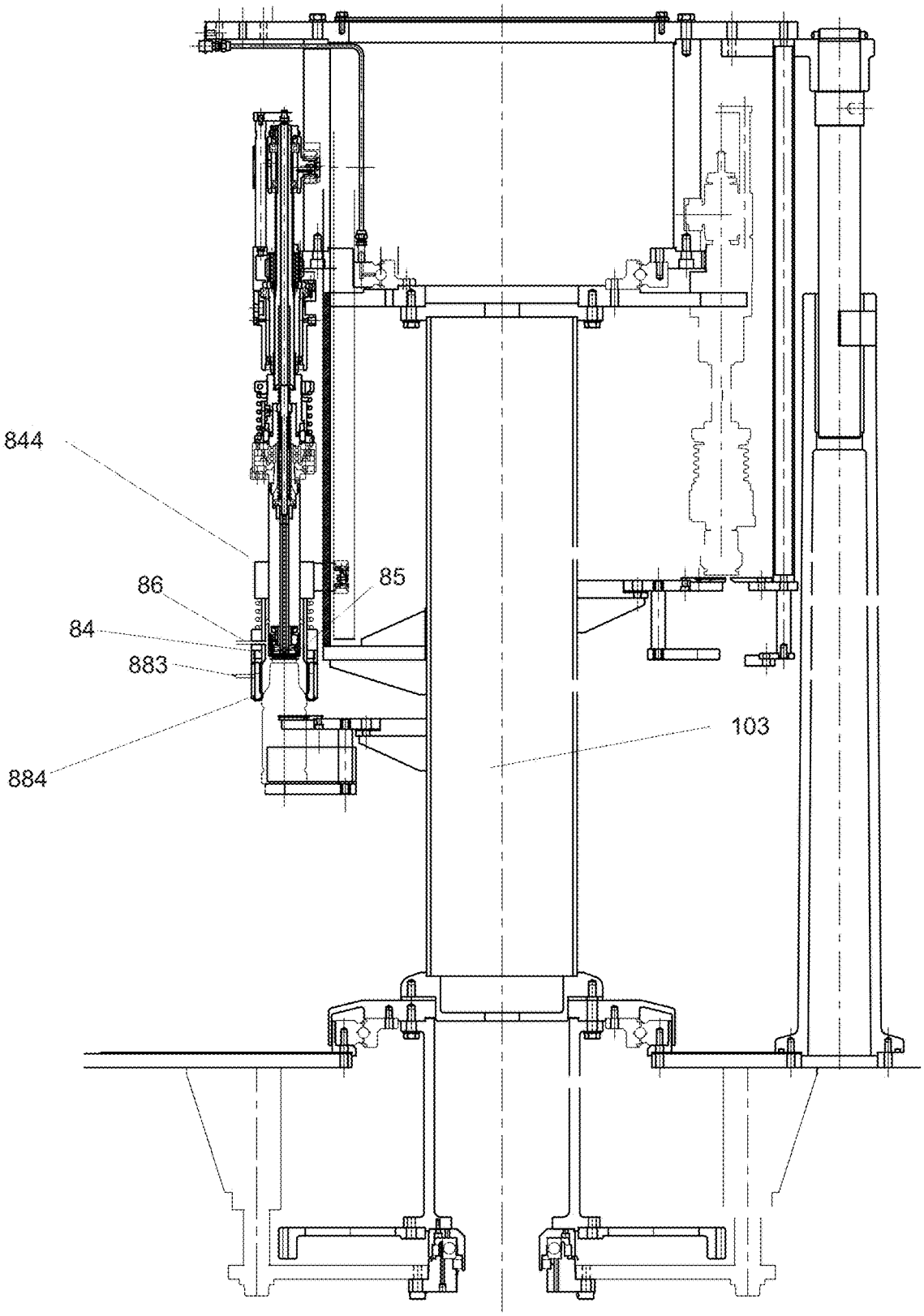
Figures 28A, 28B, 28C, 28D:
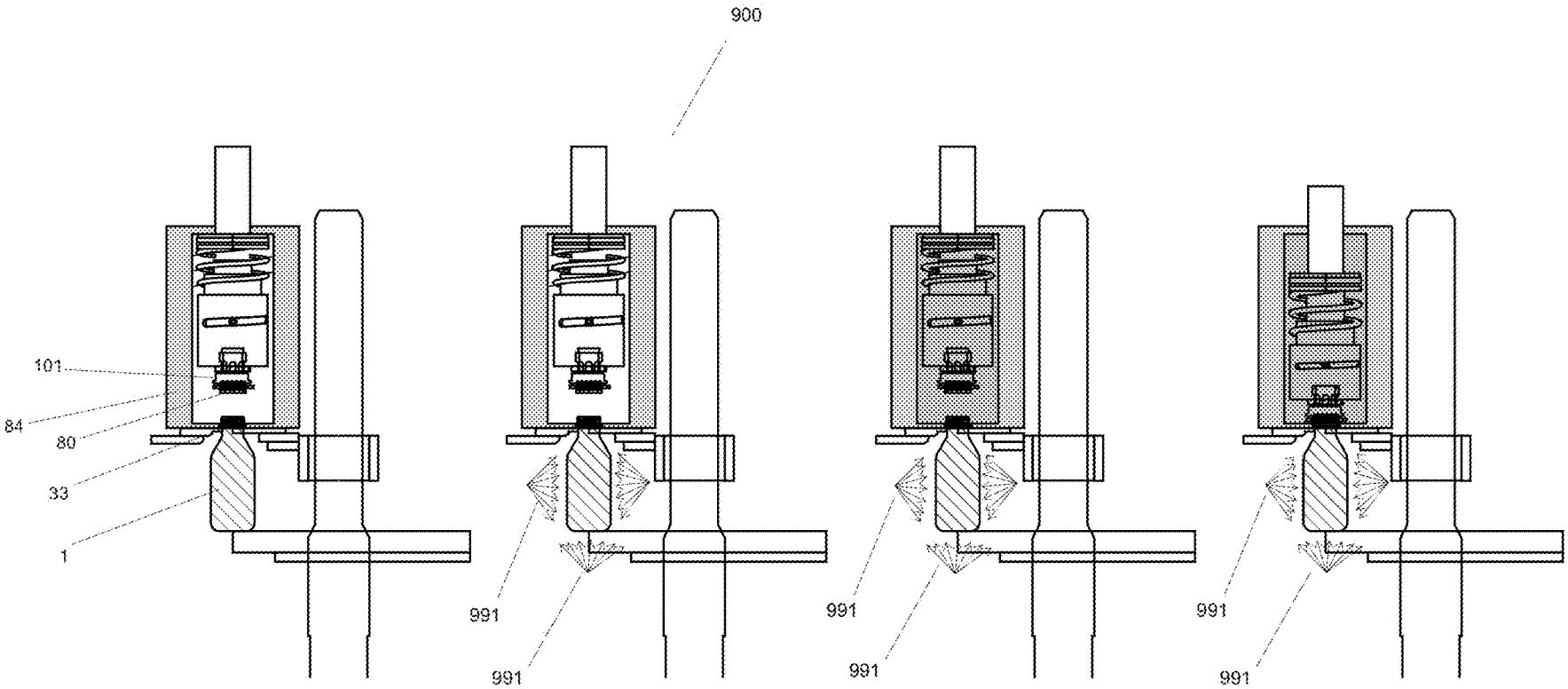
FIGS. 28A-D and FIGS. 29A-D show further alternative embodiments of the invention using a cold water spray or cold water bath to cool the containers.
Figures 29A, 29B, 29C, 29D:
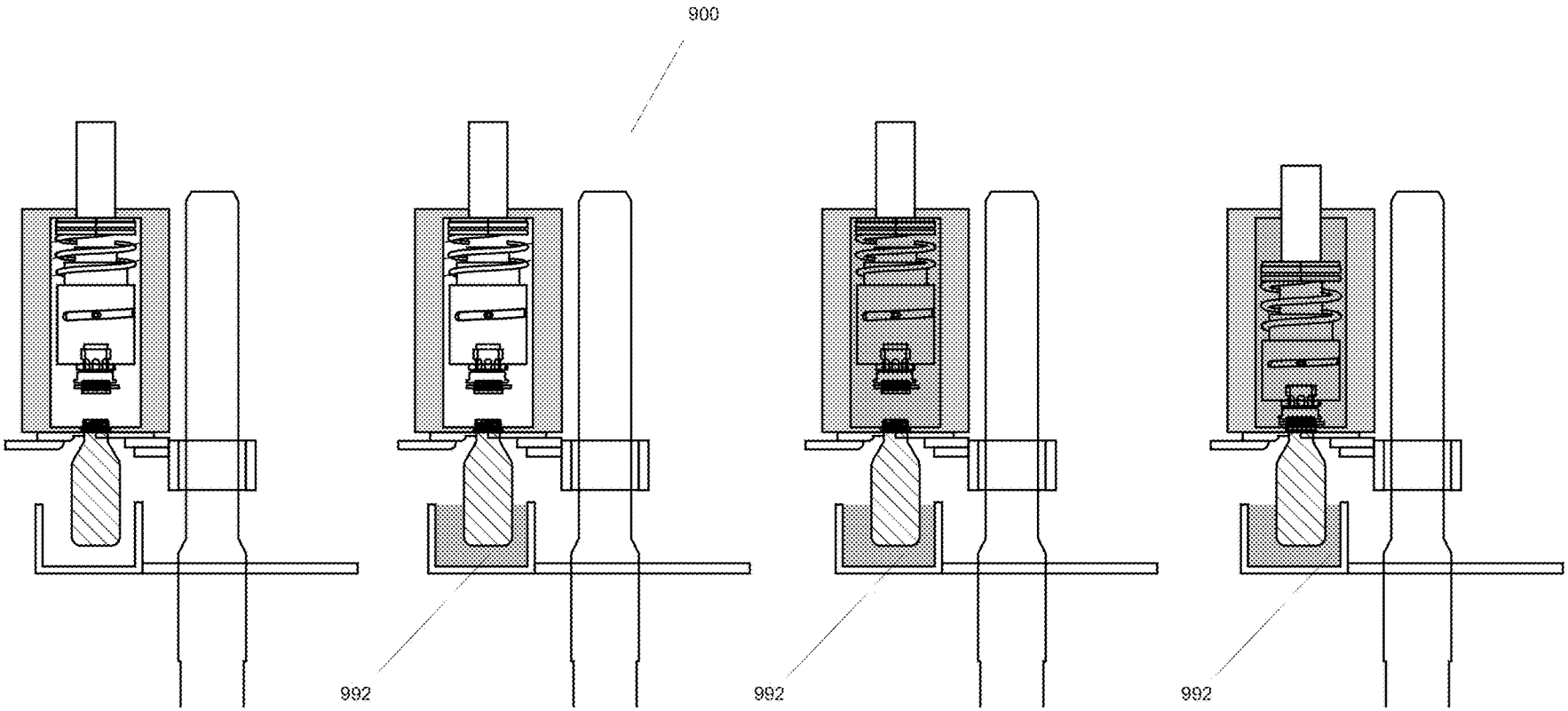

FIG. 27 shows how the sealing chamber of FIG. 26 could be incorporated into a typical capping unit station with rotary head applicators. This would allow for a modified capping unit to apply a cap in the normal manner, but to modify the headspace prior to application of torque to seal the cap on the container. Apparatus 844 moves the pressure chamber into engagement with a surface on the container to provide a sealed connection.

In facilitating the present invention, the complete or substantial removal of vacuum pressure by displacing the headspace prior to the liquid contraction now results in being able to remove a substantial amount of weight from the sidewalls due to the removal of mechanically distorting forces.

With reference to FIGS. 28A-D, a further alternative embodiment of the present invention is provided. A rotary sealing unit 900 is disclosed that clamps the hot-filled container 1 by the neck finish and just under the neck support ring 33. As the unit contains the upper neck thread of the container and prepares to increase the pressure contained in the pressure chamber 84 of the sealing unit, and the headspace of the container, the container is subjected to temperature modification. In this example a cold water spray 991, typically below ambient temperature and preferably between approximately 4 degrees C. and 15 degrees C.

The cold water spray causes the container shell to immediately fall below the glass transition temperature of the sidewall material. The temperature within the container does not fall as rapidly however, and so the liquid contents are able to subsequently be used to sterilise the internal cap surface when the container is released from the Pressure Chamber and laid down in a horizontal position, typically for a period exceeding 30 seconds.

The container sidewalls are forcibly cooled until the central core temperature of the container falls below the glass transition temperature of the sidewalls. The cold spray of this example is maintained throughout the pressurisation and sealing period, beyond release from the unit and through the period immediately subsequent when the container is inverted, as is typical. The container liquid temperature will fall below the threshold value required soon after inversion has been completed. Once this has occurred the container may be returned to the production line without further cooling prior to entering the main cooling tunnels typically found some minutes down the production line.

As the container has now been 'pre-chilled' the efficiency of the main cooling process is improved also.

It will be appreciated that many cooling methods may be employed, for example a cold water bath 992 or the like, as illustrated in FIGS. 29A-D, may be used instead of a spray. The cooling may be directed only at the base region or all over the container. A cooling jet of air may be used instead of a liquid for further example. Other cold gases may be used, eg nitrogen, or even ice may be used in some applications.

It will be appreciated that by preventing the material of the sidewalls of the container to be above a certain temperature, and below the temperature of the liquid contents for a critical period of time, then the pressure increase induced in the container will not cause damage to structures that would otherwise occur.

Preferably the cooling is applied for a period of time between 1 and 2 minutes, which time allows for the container to be pressurized, inverted to sterilise the cap underside with still-hot contents, and for the liquid to fall rapidly to below about 60 degrees C.

The time required will vary depending on line speed and fill temperature, however, and the cooling time required may be extended to over 2 to 4 minutes.

Figure 30:
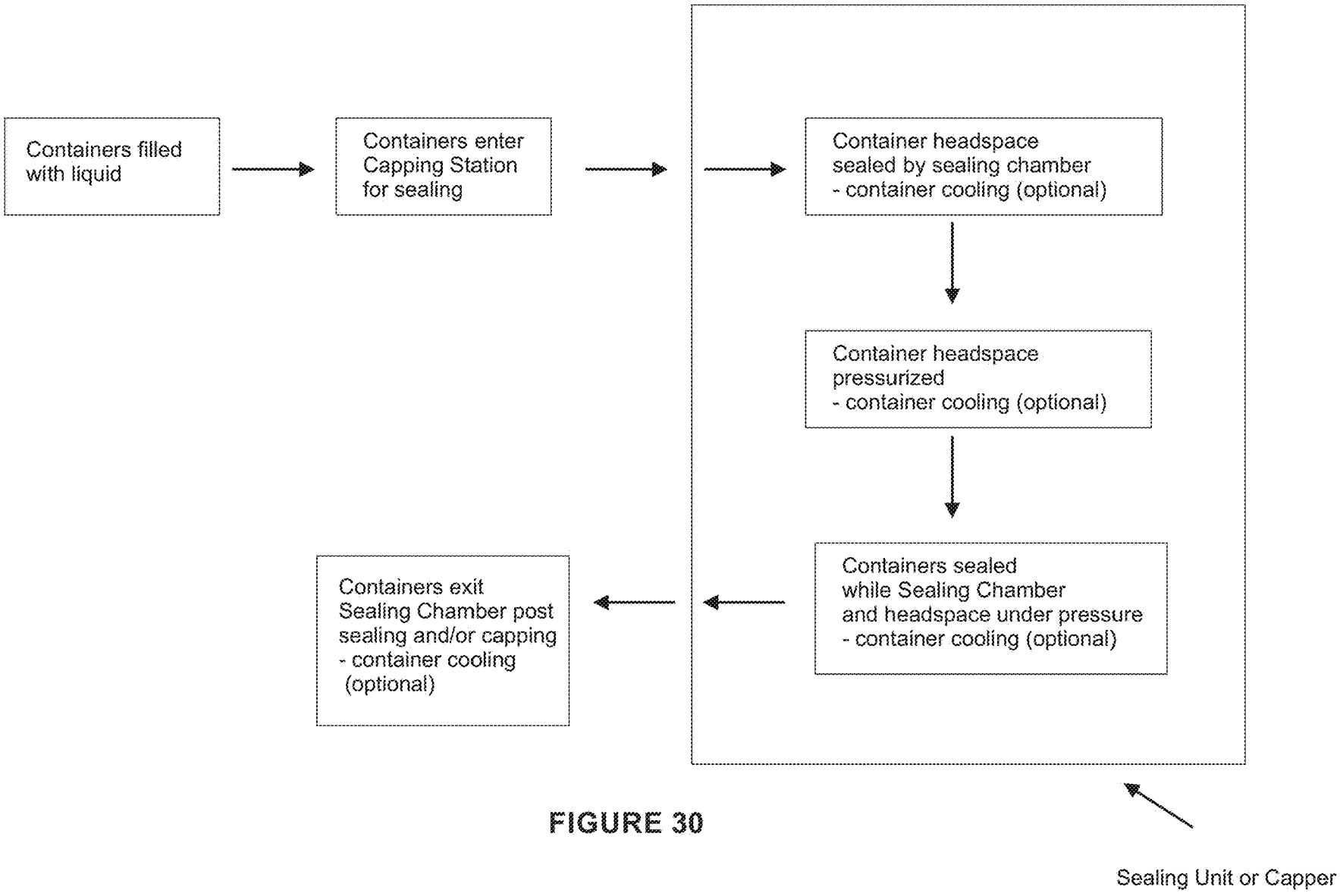
FIG. 30 shows a method according to one embodiment of the invention with a Sealing Unit or Capper capable of pressurizing the headspace of a container prior to capping or sealing, optional cooling of the container surface within the Sealing Unit and following release.
Figure 31:
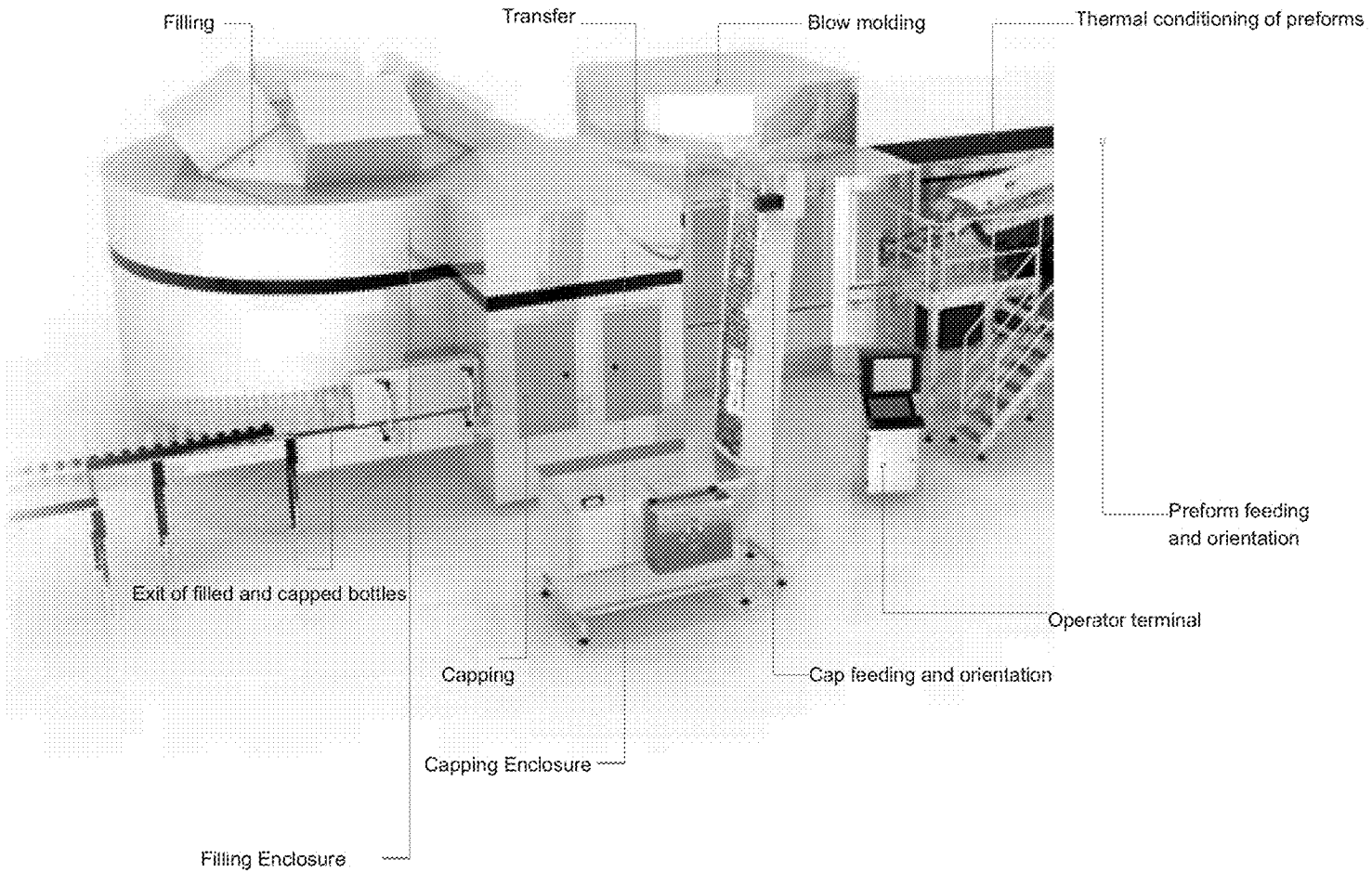

It is a preferred object of the present invention to provide a device which enables the pressurisation and sealing of freshly filled containers after sealing off the upper neck region of the container, and to initiate the differential cooling process to prevent the sidewall temperature exceeding approximately 70 degrees C. and so avoid the deformation of container sidewalls that occurs through high thermal stresses and high pressure stresses. The process is summarized with reference to FIG. 30.

In a preferred embodiment of the present invention, the bottles must have a retained internal temperature above 80 degrees C. for up to 30 seconds, and preferably up to 1 minute, more preferably up to 2 minutes, and occasionally even more preferably up to 3 minutes. During this time the temperature of the container body shell must be kept differentially below 70 degrees C. and preferably below 60 degrees C. for this time. During this period of time the containers may be inverted or laid horizontally to sterilize the inside underneath of the cap.

According to a preferred embodiment, the containers are rotated through an angle of between 70 degrees and 110 degrees, more preferably between 80 degrees and 95 degrees, so that they are transported approximately in a horizontal orientation.

The temperature of cooling medium and rate of application must be carefully controlled to provide only for the outside container surface to be held below 70 degrees C., and so cause the internal container temperature to be maintained above 70 degrees C., and more preferably above 80 degrees C., and even more preferably above 90 degrees C.

Of course it will be appreciated that if the glass transition point of an alternative sidewall material is above the fill temperature then applying a cooling period during sealing or inversion would not be required.

A particular advantage of the present method and system is the greater and more precise control of fluid injection into the headspace of a container. The injection is not based on measured dose of gas, but on a measured or pre-determined pressure to be achieved. Therefore each container receives a specific dose dependent on the fill point level within the container. The system provides for a first pressure to be present above the fill point, and to then raise this pressure to a second, higher level. This allows for much lower pressure dosing for hot fill containers. In prior methods a minimum pressure value can only be assured by over pressurisation on average, such that the lowest dose achieved will meet specifications. This has resulted in generally high pressures achieved during the early stages of hot fill, when the container is hot and malleable. As a result the container is stressed significantly in most occasions, necessitating the need for example for petaloid bases and container designs more suitable to carbonated or pressure vessels. This reduces significantly the design options available for containers, and requires additional weight in the container surrounding the base in order to achieve reasonable results.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A method of filling a container with a fluid including introducing the fluid through an open end of the container so that the fluid, at least substantially, fills the container, heating the fluid before or after its introduction into the container, applying a seal or cap to said container, moving the container to within a pressure sealing chamber, wherein the container has a headspace below the seal or cap, enclosing the seal or cap of the container within the sealing chamber, wherein the container has a first headspace pressure below the seal or cap when enclosed within the sealing chamber, providing a pressure within the pressure sealing chamber that is greater than the first headspace pressure, providing an opening or aperture in said seal or cap, providing an additional amount of fluid, liquid and/or gas through the opening or aperture to raise the first headspace pressure to a second headspace pressure, wherein the additional fluid, liquid or gas is heated or a steam, sealing the opening or aperture under the raised second headspace pressure, so as to compensate for a pressure reduction in the headspace of the container under the seal or cap following a cooling of the heated fluid contents.

2. A method as claimed in claim 1 wherein cooling of said container includes a forcible cooling of said container to bring at least part of an outside wall of the container to a temperature below 75 degrees C. substantially immediately after sealing or capping said container.

3. A method as claimed in claim 2 wherein said cooling occurs substantially within one minute of said sealing or capping.

4. A method as claimed in claim 1 in which the opening or aperture is provided within said seal or cap with a temporary or partial seal through which the additional fluid liquid and/or gas is provided.

5. A method as claimed in claim 4 in which said seal or cap has a liner material on an inside surface, said liner temporarily sealing the opening or aperture.

6. A method of filling a container with a fluid including introducing the fluid through an open end of the container so that the fluid, at least substantially, fills the container, moving the container into a pressure sealing chamber wherein the container has a headspace above the fluid contents, enclosing the open end of the container within the sealing chamber, wherein the container has a first headspace pressure above the fluid when enclosed within the sealing chamber, providing an increased pressure within the pressure sealing chamber and passing at least one additional fluid, liquid and/or gas through the open end under pressure to raise the first headspace pressure to a second headspace pressure within the container, wherein the at least one additional fluid, liquid and/or gas is heated or steam injected through the open end, providing a seal or cap and sealing the open end under the increased second headspace pressure conditions, and removing the container from the pressure sealing chamber.

7. A method of filling a container as claimed in claim 6, including heating the fluid introduced through the open end of the container before or after it has been introduced into the container, providing for subsequent pressure reduction in the headspace of the container under the seal or cap by cooling the heated fluid contents, including forcibly cooling at least a part of the outside walls of said containers after sealing or capping said containers to bring at least part of an outside wall of the container to a temperature below 75 degrees C.

8. A method as claimed in claim 7 wherein said cooling occurs substantially immediately or within one minute of said sealing or capping.

9. A method as claimed in claim 7 in which the open end is provided with a temporary or partial seal through which the at least one liquid and/or gas is provided.

10. A method as claimed in claim 7, wherein said containers is filled with a heated liquid above 80 degrees C.

11. A method as claimed in claim 10, wherein at least part of an outside wall of the container is cooled to a temperature below 75 degrees C. substantially immediately after sealing or capping the container within the pressure sealing chamber.

12. A method as claimed in claim 11, including the step of maintaining a temperature below 60 degrees C. on at least a part of an outside wall of the container.

13. A method as claimed in claim 11, including the step of maintaining a temperature above 75 degrees C. on at least a part of an inside volume of the container.

14. A method as claimed in claim 11, including the step of maintaining a temperature above 80 degrees C. on at least a part of an inside volume of the container.

15. A method as claimed in claim 11, including the step of maintaining a temperature above 85 degrees C. on at least a part of an inside volume of the container.

16. A method as claimed in claim 1 or 6, including the step of sealing the container under a neck support ring within the sealing chamber.

* * * * *